US008081178B2

(12) United States Patent
Yamazaki

(10) Patent No.: US 8,081,178 B2
(45) Date of Patent: Dec. 20, 2011

(54) ELECTRO-OPTICAL DEVICE, DRIVING CIRCUIT, AND ELECTRONIC APPARATUS

(75) Inventor: Katsunori Yamazaki, Matsumoto (JP)

(73) Assignee: Sony Corporation, Tokyo (JP)

( * ) Notice: Subject to any disclaimer, the term of this patent is extended or adjusted under 35 U.S.C. 154(b) by 911 days.

(21) Appl. No.: 12/107,512

(22) Filed: Apr. 22, 2008

(65) Prior Publication Data

US 2009/0015570 A1 Jan. 15, 2009

(30) Foreign Application Priority Data

Jul. 10, 2007 (JP) ..... 2007-181436
Jul. 11, 2007 (JP) ..... 2007-181768

(51) Int. Cl.
*G09G 5/00* (2006.01)

(52) U.S. Cl. ..... 345/209; 345/94; 345/89; 345/92; 345/100; 345/204; 345/96

(58) Field of Classification Search ..... 345/87–104, 345/204, 208–210, 211
See application file for complete search history.

(56) References Cited

U.S. PATENT DOCUMENTS

| | | | | |
|---|---|---|---|---|
| 5,805,247 | A * | 9/1998 | Oh-e et al. | 349/42 |
| 6,897,845 | B2 * | 5/2005 | Ozawa | 345/94 |
| 2008/0036751 | A1 * | 2/2008 | Yamazaki | 345/205 |
| 2008/0055300 | A1 * | 3/2008 | Yamazaki | 345/212 |
| 2008/0094388 | A1 * | 4/2008 | Yamazaki | 345/212 |
| 2008/0291223 | A1 * | 11/2008 | Yamazaki et al. | 345/690 |
| 2009/0015570 | A1 * | 1/2009 | Yamazaki | 345/204 |

FOREIGN PATENT DOCUMENTS

| | | |
|---|---|---|
| JP | A-07-128683 | 5/1995 |
| JP | A-07-281641 | 10/1995 |
| JP | A-11-327518 | 11/1999 |
| JP | A-2001-134245 | 5/2001 |
| JP | A-2002-196358 | 7/2002 |
| JP | A-2003-344837 | 12/2003 |
| JP | A-2005-300948 | 10/2005 |
| JP | A-2005-338256 | 12/2005 |
| JP | A-2007-047349 | 2/2007 |
| JP | A-2007-047350 | 2/2007 |
| JP | A-2008-033298 | 2/2008 |

OTHER PUBLICATIONS

U.S. Appl. No. 11/812,348, filed Jun. 18, 2007, Shin Fujita.

* cited by examiner

*Primary Examiner* — Lun-Yi Lao
*Assistant Examiner* — Kelly B Hegarty
(74) *Attorney, Agent, or Firm* — K&L Gates LLP

(57) ABSTRACT

Pixels include liquid crystal capacitors and holding capacitors having first ends connected to pixel electrodes and second ends connected to common electrodes corresponding to the first to 320th rows. A common electrode driving circuit includes TFTs for individual rows. In a partial mode, when a period in which a level of a scanning signal is high is long, a control signal Vg-c is brought to a high level during the period so that the TFTs are turned on. Since gate voltages are applied to the TFTs, a problem in that the gate voltages are reduced due to voltage leakage and the common electrodes are brought into high-impedance states is avoided. Alternatively, potentials of the common electrodes are fixed to a voltage of a common signal, which is a low-level when positive-polarity writing is specified to all the rows and a high-level when negative-polarity writing is specified to all the rows.

13 Claims, 36 Drawing Sheets

FIG. 6

| ROWS | FULL SCREEN MODE | | | | PARTIAL MODE | | | | | | | | | | | | | |
|---|---|---|---|---|---|---|---|---|---|---|---|---|---|---|---|---|---|---|
| | | | | | 1 | 2 | 3 | 4 | 5 | 6 | 7 | 8 | 9 | 10 | 11 | 12 | 1 | |
| 1 | + | − | + | − | − | × | × | × | × | × | + | × | × | × | × | × | | NON-DISPLAY ROWS |
| 2 | − | + | − | + | − | × | × | × | × | × | + | × | × | × | × | × | | |
| 3 | + | − | + | − | − | × | × | × | × | × | + | × | × | × | × | × | | |
| 4 | − | + | − | + | − | × | × | × | × | × | + | × | × | × | × | × | | |
| ⋮ | | | | | | | | | | | | | | | | | | |
| 79 | + | − | + | − | − | × | × | × | × | × | + | × | × | × | × | × | | |
| 80 | − | + | − | + | − | × | × | × | × | × | + | × | × | × | × | × | | |
| 81 | + | − | + | − | − | × | × | + | × | × | + | × | × | − | × | × | | DISPLAY ROWS |
| 82 | − | + | − | + | − | × | × | + | × | × | + | × | × | − | × | × | | |
| 83 | + | − | + | − | − | × | × | + | × | × | + | × | × | − | × | × | | |
| 84 | − | + | − | + | − | × | × | + | × | × | + | × | × | − | × | × | | |
| ⋮ | | | | | | | | | | | | | | | | | | |
| 159 | + | − | + | − | − | × | × | + | × | × | + | × | × | − | × | × | | |
| 160 | − | + | − | + | − | × | × | + | × | × | + | × | × | − | × | × | | |
| 161 | + | − | + | − | − | × | × | × | × | × | + | × | × | × | × | × | | NON-DISPLAY ROWS |
| 162 | − | + | − | + | − | × | × | × | × | × | + | × | × | × | × | × | | |
| 163 | + | − | + | − | − | × | × | × | × | × | + | × | × | × | × | × | | |
| 164 | − | + | − | + | − | × | × | × | × | × | + | × | × | × | × | × | | |
| ⋮ | | | | | | | | | | | | | | | | | | |
| 319 | + | − | + | − | − | × | × | × | × | × | + | × | × | × | × | × | | |
| 320 | − | + | − | + | − | × | × | × | × | × | + | × | × | × | × | × | | |
| Vg−c | L | L | L | L | L | H | H | L | L | L | L | H | H | L | L | L | | |

TIME →

FIG. 12

| ROWS | FULL SCREEN MODE | | | | PARTIAL MODE | | | | | | | | | | | | | |
|---|---|---|---|---|---|---|---|---|---|---|---|---|---|---|---|---|---|---|
| | | | | | 1 | 2 | 3 | 4 | 5 | 6 | 7 | 8 | 9 | 10 | 11 | 12 | 1 | |
| 1 | + | − | + | − | + | × | × | × | × | × | − | × | × | × | × | × | | NON-DISPLAY ROWS |
| 2 | − | + | − | + | − | × | × | × | × | × | + | × | × | × | × | × | | |
| 3 | + | − | + | − | + | × | × | × | × | × | − | × | × | × | × | × | | |
| 4 | − | + | − | + | − | × | × | × | × | × | + | × | × | × | × | × | | |
| ⋮ | | | | | | | | | | | | | | | | | | |
| 79 | + | − | + | − | + | × | × | × | × | × | − | × | × | × | × | × | | |
| 80 | − | + | − | + | − | × | × | × | × | × | + | × | × | × | × | × | | |
| 81 | + | − | + | − | + | × | × | − | × | × | − | × | × | + | × | × | | DISPLAY ROWS |
| 82 | − | + | − | + | − | × | × | + | × | × | + | × | × | − | × | × | | |
| 83 | + | − | + | − | + | × | × | − | × | × | − | × | × | + | × | × | | |
| 84 | − | + | − | + | − | × | × | + | × | × | + | × | × | − | × | × | | |
| ⋮ | | | | | | | | | | | | | | | | | | |
| 159 | + | − | + | − | + | × | × | − | × | × | − | × | × | + | × | × | | |
| 160 | − | + | − | + | − | × | × | + | × | × | + | × | × | − | × | × | | |
| 161 | + | − | + | − | + | × | × | × | × | × | − | × | × | × | × | × | | NON-DISPLAY ROWS |
| 162 | − | + | − | + | − | × | × | × | × | × | + | × | × | × | × | × | | |
| 163 | + | − | + | − | + | × | × | × | × | × | − | × | × | × | × | × | | |
| 164 | − | + | − | + | − | × | × | × | × | × | + | × | × | × | × | × | | |
| ⋮ | | | | | | | | | | | | | | | | | | |
| 319 | + | − | + | − | + | × | × | × | × | × | − | × | × | × | × | × | | |
| 320 | − | + | − | + | − | × | × | × | × | × | + | × | × | × | × | × | | |
| Vg−c | L | L | L | L | L | H | H | L | L | L | L | H | H | L | L | L | | |

TIME →

FIG. 24

| | | FULL SCREEN MODE | | | | PARTIAL MODE | | | | | | | | | | | | | |
|---|---|---|---|---|---|---|---|---|---|---|---|---|---|---|---|---|---|---|---|
| | | | | | | 1 | 2 | 3 | 4 | 5 | 6 | 7 | 8 | 9 | 10 | 11 | 12 | 1 | |
| ROWS | 1 | | + | − | + | − | − | × | × | × | × | × | + | × | × | × | × | × | NON-DISPLAY ROWS |
| | 2 | | − | + | − | + | − | × | × | × | × | × | + | × | × | × | × | × | |
| | 3 | | + | − | + | − | − | × | × | × | × | × | + | × | × | × | × | × | |
| | 4 | | − | + | − | + | − | × | × | × | × | × | + | × | × | × | × | × | |
| | ⋮ | | | | | | | | | | | | | | | | | | |
| | 79 | | + | − | + | − | − | × | × | × | × | × | + | × | × | × | × | × | |
| | 80 | | − | + | − | + | − | × | × | × | × | × | + | × | × | × | × | × | |
| | 81 | | + | − | + | − | − | × | × | + | × | × | + | × | × | − | × | × | DISPLAY ROWS |
| | 82 | | − | + | − | + | − | × | × | + | × | × | + | × | × | − | × | × | |
| | 83 | | + | − | + | − | − | × | × | + | × | × | + | × | × | − | × | × | |
| | 84 | | − | + | − | + | − | × | × | + | × | × | + | × | × | − | × | × | |
| | ⋮ | | | | | | | | | | | | | | | | | | |
| | 159 | | + | − | + | − | − | × | × | + | × | × | + | × | × | − | × | × | |
| | 160 | | − | + | − | + | − | × | × | + | × | × | + | × | × | − | × | × | |
| | 161 | | + | − | + | − | − | × | × | × | × | × | + | × | × | × | × | × | NON-DISPLAY ROWS |
| | 162 | | − | + | − | + | − | × | × | × | × | × | + | × | × | × | × | × | |
| | 163 | | + | − | + | − | − | × | × | × | × | × | + | × | × | × | × | × | |
| | 164 | | − | + | − | + | − | × | × | × | × | × | + | × | × | × | × | × | |
| | ⋮ | | | | | | | | | | | | | | | | | | |
| | 319 | | + | − | + | − | − | × | × | × | × | × | + | × | × | × | × | × | |
| | 320 | | − | + | − | + | − | × | × | × | × | × | + | × | × | × | × | × | |
| Vg−c | | | L | L | L | L | L | H | H | L | L | L | L | H | H | L | L | L | |
| Vc | | nul | | | | | Vsh | | nul | | | | | Vsl | | nul | | | |

TIME →

FIG. 30

| ROWS | FULL SCREEN MODE | | | | | PARTIAL MODE | | | | | | | | | | | | | |
|---|---|---|---|---|---|---|---|---|---|---|---|---|---|---|---|---|---|---|---|
| | | | | | | 1 | 2 | 3 | 4 | 5 | 6 | 7 | 8 | 9 | 10 | 11 | 12 | 1 | |
| 1 | | + | − | + | − | + | × | × | × | × | × | − | × | × | × | × | × | | NON-DISPLAY ROWS |
| 2 | | − | + | − | + | − | × | × | × | × | × | + | × | × | × | × | × | | |
| 3 | | + | − | + | − | + | × | × | × | × | × | − | × | × | × | × | × | | |
| 4 | | − | + | − | + | − | × | × | × | × | × | + | × | × | × | × | × | | |
| ⋮ | | | | | | | | | | | | | | | | | | | |
| 79 | | + | − | + | − | + | × | × | × | × | × | − | × | × | × | × | × | | |
| 80 | | − | + | − | + | − | × | × | × | × | × | + | × | × | × | × | × | | |
| 81 | | + | − | + | − | + | × | × | − | × | × | − | × | × | + | × | × | | DISPLAY ROWS |
| 82 | | − | + | − | + | − | × | × | + | × | × | + | × | × | − | × | × | | |
| 83 | | + | − | + | − | + | × | × | − | × | × | − | × | × | + | × | × | | |
| 84 | | − | + | − | + | − | × | × | + | × | × | + | × | × | − | × | × | | |
| ⋮ | | | | | | | | | | | | | | | | | | | |
| 159 | | + | − | + | − | + | × | × | − | × | × | − | × | × | + | × | × | | |
| 160 | | − | + | − | + | − | × | × | + | × | × | + | × | × | − | × | × | | |
| 161 | | + | − | + | − | + | × | × | × | × | × | − | × | × | × | × | × | | NON-DISPLAY ROWS |
| 162 | | − | + | − | + | − | × | × | × | × | × | + | × | × | × | × | × | | |
| 163 | | + | − | + | − | + | × | × | × | × | × | − | × | × | × | × | × | | |
| 164 | | − | + | − | + | − | × | × | × | × | × | + | × | × | × | × | × | | |
| ⋮ | | | | | | | | | | | | | | | | | | | |
| 319 | | + | − | + | − | + | × | × | × | × | × | − | × | × | × | × | × | | |
| 320 | | − | + | − | + | − | × | × | × | × | × | + | × | × | × | × | × | | |
| Vg−c | | L | L | L | L | L | H | H | L | L | L | L | H | H | L | L | L | | |
| Vc−c | nul | | | | | | Vsl | | nul | | | | Vsh | | nul | | | | |
| Vc−d | nul | | | | | | Vsh | | nul | | | | Vsl | | nul | | | | |

TIME →

ELECTRO-OPTICAL DEVICE, DRIVING CIRCUIT, AND ELECTRONIC APPARATUS

BACKGROUND

1. Technical Field

The present invention relates to a technique of suppressing unevenness of an electro-optical device such as a liquid crystal device.

2. Related Art

In general, in an electro-optical device such as a liquid crystal device, pixel capacitors (liquid crystal capacitors) are arranged in intersections of scanning lines and data lines. To suppress voltage amplitudes of the data lines generated when the pixel capacitors are AC-driven, a technique in which common electrodes are provided for individual scanning lines (rows), and when selection voltages are applied to the scanning lines, the corresponding common electrodes are connected through transistors to power supply lines for supplying voltage corresponding to a writing polarity is known (refer to Japanese Unexamined Patent Application Publication No. 2005-300948).

However, in this technique, since the transistors are turned off in a non-selection period which is a period in which the selection voltages are not applied to the scanning lines, the common electrodes are not electrically connected, that is, the common electrodes are brought into voltage uncertain states (high impedance states). Therefore, since the common electrodes are influenced through parasitic capacitors by voltage changes of the data lines and noises, voltages of the common electrodes are readily varied. Since the rows are influenced by the variations of the voltages of the common electrodes, display unevenness represented by horizontal lines, is generated, and therefore, display quality is deteriorated.

SUMMARY

An advantage of some aspects of the invention is that there is provided an electro-optical device which has a configuration in which common electrodes are individually driven and which is capable of suppressing generation of display unevenness, a driving circuit, and an electronic apparatus.

According to an embodiment of the invention, there is provided a driving circuit included in an electro-optical device, including a plurality of scanning lines, a plurality of data lines, and a plurality of common electrodes provided for the individual scanning lines, pixels which are arranged at intersections of the scanning lines and the data lines, which include pixel switching elements which have first ends connected to the corresponding data lines and which are brought into conduction states when selection voltages are applied to the corresponding scanning lines, which include pixel capacitors having first ends connected to second ends of the corresponding pixel switching elements and second ends connected to the corresponding common electrodes, and which have levels of gradation corresponding to holding voltages of the pixel capacitors, a scanning line driving circuit which applies the selection voltages to the plurality of scanning lines in a predetermined order, a common electrode driving circuit which drives the plurality of common electrodes individually, and a data line driving circuit which supplies, to pixels corresponding to scanning lines to which the selection voltages are applied, data signals having voltages corresponding to levels of gradation for the corresponding pixels through corresponding data lines. The common electrode driving circuit includes switching circuits which are turned on or turned off in accordance with voltages held in gate electrodes of the switching circuits, and which apply voltages of a low-level side or voltages of a high-level side to the corresponding common electrodes when being turned on, includes first voltage-applying circuits which apply on-voltages to the gate electrodes of the switching circuits when the selection voltages are applied to the scanning lines corresponding to the common electrodes so that the switching circuits are turned on, and includes second voltage-applying circuits which apply on-voltages to the gate electrodes of the switching circuits when instruction signals are transmitted through a predetermined control line in a period in which the selection voltages are not applied to the scanning lines. With this configuration, even when an operation of applying the selection voltages to the scanning lines is terminated, fixed voltages are applied to the common electrodes using the switching circuits, and accordingly, potentials of the common electrodes are prevented from being varied.

The first voltage-applying circuits may each include first and second transistors, the switching circuits may each include third and fourth transistors, and the second voltage-applying circuits may each include fifth and sixth transistors. The first transistors may have gate electrodes connected to the corresponding scanning lines and source electrodes connected to a first power supply line to which voltages which cause the third transistors to be turned on or off are supplied. The second transistors may have gate electrodes connected to the corresponding scanning lines and source electrodes connected to a second power supply line to which voltages which cause the fourth transistors to be turned on or off are supplied. The third transistors may have gate electrodes connected to drain electrodes of the first transistors and source electrodes connected to a third power supply line to which one of voltages of the low-level side and voltages of the high-level side are supplied. The fourth transistors may have gate electrodes connected to drain electrodes of the second transistors and source electrodes connected to a fourth power supply line to which the other of the voltages of the low-level side and the voltages of the high-level side are supplied. Drain electrodes of the third transistors and drain electrodes of the fourth transistors may be connected to the corresponding common electrodes. The fifth transistors may have gate electrodes connected to the control line, source electrodes connected to one of the first and second power supply lines, and drain electrodes connected to the gate electrodes of the third transistors. The sixth transistors may have gate electrodes connected to the control line, source electrodes connected to the other of the first and second power supply lines, and drain electrodes connected to the gate electrodes of the fourth transistors. With this configuration, the components of the common electrode driving circuit may be configured similarly to the pixel switching elements.

In the common electrode driving circuit, the source electrodes of the fifth transistors corresponding to the scanning lines and the common electrodes may be connected to the first power supply line and the source electrodes of the sixth transistors corresponding to the scanning lines and the common electrodes may be connected to the second power supply line.

The driving circuit included in an electro-optical device may operate in a first mode in which effective display is performed using all the pixels and in a second mode in which effective display is performed only using pixels corresponding to a number of scanning lines among all the pixels. In the first mode, the scanning line driving circuit performs, in a predetermined cycle, an operation of applying the selection voltages to the plurality of scanning lines in the predetermined order, the voltages which are inverted every time each of the selection voltages is applied to a corresponding one of the scanning lines so as to cause the third transistors to be turned on or turned off are supplied to the first power supply line, the voltages of the low-level side or the voltages of the high-level side are supplied to the third power supply lines at least in a period of one frame, and voltages which cause the fifth and sixth transistors to be turned off are supplied to the control line. In the second mode, the scanning line driving circuit alternately performs a first operation of applying the selection voltages to the plurality of scanning lines in the predetermined order and a second operation of applying a number of selection voltages to a corresponding number of scanning lines in a predetermined order in a cycle longer than the predetermined cycle, one of voltages which cause the third transistors to be turned on and voltages which cause the third transistors to be turned off are applied to the first power supply line in the first operation, and the other of the voltages which cause the third transistors to be turned on and the voltages which cause the third transistors to be turned off are applied to the first power supply line in the second operation while the selection voltages are applied to the number of scanning lines, the voltages of the low-level side or the voltages of the high-level side are applied to the third power supply line at least in a period of one frame, and voltages which cause the fifth and sixth transistors to be turned on are supplied to the control line in the entirety or part of a period from when the first operation is terminated to when the second operation is started, and voltages which cause the fifth and sixth transistors to be turned off are supplied to the control line in all other periods. With this configuration, since the writing polarities are inverted for individual rows of the pixels, display quality is improved. Note that in this embodiment, an odd number and an even number are merely relative concepts for specifying the rows alternately arranged.

In the common electrode driving circuit, source electrodes of fifth transistors corresponding to scanning lines and common electrodes of odd-numbered rows may be connected to the second power supply line, and source electrodes of sixth transistors corresponding to scanning lines and common electrodes of the odd-numbered rows may be connected to the first power supply line, source electrodes of fifth transistors corresponding to scanning lines and common electrodes of even-numbered rows may be connected to the first power supply line, and source electrodes of sixth transistors corresponding to scanning lines and common electrodes of the even-numbered rows may be connected to the second power supply line.

The driving circuit included in an electro-optical device may operate in a first mode in which effective display is performed using all the pixels and in a second mode in which effective display is performed only using pixels corresponding to a number of pixels among all the pixels. In the first mode, the scanning line driving circuit performs, in a predetermined cycle, an operation of applying the selection voltages to the plurality of scanning lines in the predetermined order, the voltages which cause the third transistors to be turned on or turned off are inverted every time each of the selection voltages is applied to a corresponding one of the scanning lines and the inverted voltages are supplied to the first power supply line, and the voltages of the low-level side or the voltages of the high-level side are supplied to the third power supply lines at least in a period of one frame, and voltages which cause the fifth and sixth transistors to be turned off are supplied to the control line. In the second mode, the scanning line driving circuit alternately performs a first operation of applying the selection voltages to the plurality of scanning lines in the predetermined order and a second operation of applying the selection voltages to a number of scanning lines in a predetermined order in a cycle longer than the predetermined cycle, voltages which cause the third transistors to be turned on and turned off are inverted every time one of the selection voltages are applied to a corresponding one of the scanning lines and the inverted voltages are supplied to the first power supply line in the first and second operations, the voltages of the low-level side or the voltages of the high-level side are applied to the third power supply line at least in a period of one frame, and voltages which cause the fifth and sixth transistors to be on-states in the entirety or part of a period from when the first operation is terminated to when the second operation is started are supplied to the control line, and voltages which cause the fifth and sixth transistors to be off-states in all other periods are supplied to the control line. With this configuration, since, as with the first mode, the writing polarities are inverted for individual rows of the pixels used for the effective display in the second mode, the display quality is improved.

According to another embodiment of the invention, there is provided a driving circuit included in an electro-optical device, including a plurality of scanning lines, a plurality of data lines, and a plurality of common electrodes provided for the individual scanning lines, pixels which are arranged at intersections of the scanning lines and the data lines, which include pixel switching elements which have first ends connected to the corresponding data lines and which are brought into conduction states when selection voltages are applied to the corresponding scanning lines, which include pixel capacitors having first ends connected to second ends of the corresponding pixel switching elements and second ends connected to the corresponding common electrodes, and which have levels of gradation corresponding to holding voltages of the pixel capacitors, a scanning line driving circuit which applies the selection voltages to the plurality of scanning lines in a predetermined order, a common electrode driving circuit which drives the plurality of common electrodes individually, and a data line driving circuit which supplies, to pixels corresponding to scanning lines to which the selection voltages are applied, data signals having voltages corresponding to levels of gradation for the corresponding pixels through corresponding data lines. The common electrode driving circuit includes, for individual common electrodes, switching circuits which are turned on or turned off in accordance with voltages held in gate electrodes of the switching circuits and which apply voltages of a low-level side or voltages of a high-level side to the corresponding common electrodes when being turned on, first voltage-applying circuits which apply on-voltages to the gate electrodes of the switching circuits when the selection voltages are applied to the scanning lines corresponding to the common electrodes so that the switching circuits are turned on, and second voltage-applying circuits which apply the voltages of the low-level side or the voltages of the high-level side again to the individual common electrodes when instruction signals are supplied through a predetermined control line after an operation of applying the selection voltages to the scanning lines is terminated. With this configuration, even when an operation of applying the selection voltages to the scanning lines is terminated, fixed voltages are applied to the common electrodes using the switching circuits, and accordingly, potentials of the common electrodes are prevented from being varied.

The first voltage-applying circuits may each include first and second transistors, the switching circuits may each include third and fourth transistors, and the second voltage-applying circuits may each include fifth transistors. The first transistors may have gate electrodes connected to the corresponding scanning lines and source electrodes connected to a first power supply line to which voltages which cause the third transistors to be turned on or off are supplied. The second transistors may have gate electrodes connected to the corresponding scanning lines and source electrodes connected to a second power supply line to which voltages which cause the fourth transistors to be turned on or off are supplied. The third transistors may have gate electrodes connected to drain electrodes of the first transistors and source electrodes connected to a third power supply line to which one of voltages of the low-level side and voltages of the high-level side are supplied. The fourth transistors have gate electrodes connected to drain electrodes of the second transistors and source electrodes connected to a fourth power supply line to which the other of the voltages of the low-level side and the voltages of the high-level side are supplied. Drain electrodes of the third transistors and corresponding drain electrodes of the fourth transistors may be connected to the corresponding common electrodes. The fifth transistors may have gate electrodes connected to the control line, source electrodes connected to a signal line to which voltages of the low-level side or voltages of the high-level side are supplied, and drain electrodes connected to the common electrodes. With this configuration, the components of the common electrode driving circuit may be configured similarly to the pixel switching elements.

The source electrodes of the fifth transistors may be connected to the signal line provided in common for all rows of the scanning lines and the common electrodes. The driving circuit included in an electro-optical device may operate in a first mode in which effective display is performed using all the pixels and in a second mode in which effective display is performed only using pixels corresponding to a number of pixels among all the pixels. In the first mode, the scanning line driving circuit performs, in a predetermined cycle, an operation of applying the selection voltages to the plurality of scanning lines in the predetermined order, the voltages which cause the third transistors to be turned on or turned off are inverted every time each of the selection voltages is applied to a corresponding one of the scanning lines and the inverted voltages are supplied to the first power supply line, the voltages of the low-level side or the voltages of the high-level side are supplied to the third power supply lines at least in a period of one frame, and voltages which cause the fifth transistors to be turned off are supplied to the control line. In the second mode, the scanning line driving circuit alternately performs a first operation of applying the selection voltages to the plurality of scanning lines in the predetermined order and a second operation of applying the selection voltages to a number of scanning lines in a predetermined order in a cycle longer than the predetermined cycle, one of voltages which cause the third transistors to be turned on and voltages which cause the third transistors to be turned off are applied to the first power supply line in the first operation, and the other of the voltages which cause the third transistors to be turned on and the voltages which cause the third transistors to be turned off are applied to the first power supply line in the second operation while the selection voltages are applied to the number of scanning lines, the voltages of the low-level side or the voltages of the high-level side are applied to the third power supply line at least in a period of one frame, and voltages which cause the fifth transistors to be on-states in the entirety or part of a period from when the first operation is terminated to when the second operation is started are supplied to the control line, and voltages which cause the fifth transistors to be off-states in all other periods are supplied to the control line. With this configuration, since the writing polarities are inverted for individual rows of the pixels, display quality is improved. Note that in this embodiment, an odd number and an even number are merely relative concepts for specifying the rows alternately arranged.

Source electrodes of fifth transistors corresponding to scanning lines and common electrodes of odd-numbered rows may be connected to a first signal line to which one of voltages of the low-level side and voltages of the high-level side are supplied. Source electrodes of fifth transistors corresponding to scanning lines and common electrodes of even-numbered rows may be connected to a second signal line to which the other of voltages of the low-level side and voltages of the high-level side are supplied. The driving circuit included in an electro-optical device may operate in a first mode in which effective display is performed using all the pixels and in a second mode in which effective display is performed only using pixels corresponding to a number of pixels among all the pixels. In the first mode, the scanning line driving circuit performs, in a predetermined cycle, an operation of applying the selection voltages to the plurality of scanning lines in the predetermined order, the voltages which cause the third transistors to be turned on or turned off are inverted every time each of the selection voltages is applied to a corresponding one of the scanning lines and the inverted voltages are supplied to the first power supply line, the voltages of the low-level side or the voltages of the high-level side are supplied to the third power supply lines at least in a period of one frame, and voltages which cause the fifth transistors to be turned off are supplied to the control line. In the second mode, the scanning line driving circuit alternately performs a first operation of applying the selection voltages to the plurality of scanning lines in the predetermined order and a second operation of applying the selection voltages to a number of scanning lines in a predetermined order in a cycle longer than the predetermined cycle, the voltages which cause the third transistors to be turned on or turned off are inverted every time each of the selection voltages is applied to a corresponding one of the scanning lines and the inverted voltages are supplied to the first power supply line, the voltages of the low-level side or the voltages of the high-level side are applied to the third power supply line at least in a period of one frame, and voltages which cause the fifth transistors to be on-states in entire or part of a period from when the first operation is terminated to when the second operation is started are supplied to the control line, and voltages which cause the fifth transistors to be off-states in all other periods are supplied to the control line.

The invention is applicable to an electro-optical device in addition to a driving circuit included in an electro-optical device. In addition to the electro-optical device, the invention is applicable to an electronic apparatus including the electro-optical device.

BRIEF DESCRIPTION OF THE DRAWINGS

The invention will be described with reference to the accompanying drawings, wherein like numbers reference like elements.

FIG. 6 is a diagram illustrating an operation of the electro-optical device.

FIG. 12 is a diagram illustrating an operation of the electro-optical device.

FIG. 24 is a diagram illustrating an operation of the electro-optical device.

FIG. 30 is a diagram illustrating an operation of the electro-optical device.

DESCRIPTION OF EXEMPLARY EMBODIMENTS

Embodiments of the present invention will be described hereinafter with reference to the accompanying drawings.

First Embodiment

Figure 1:
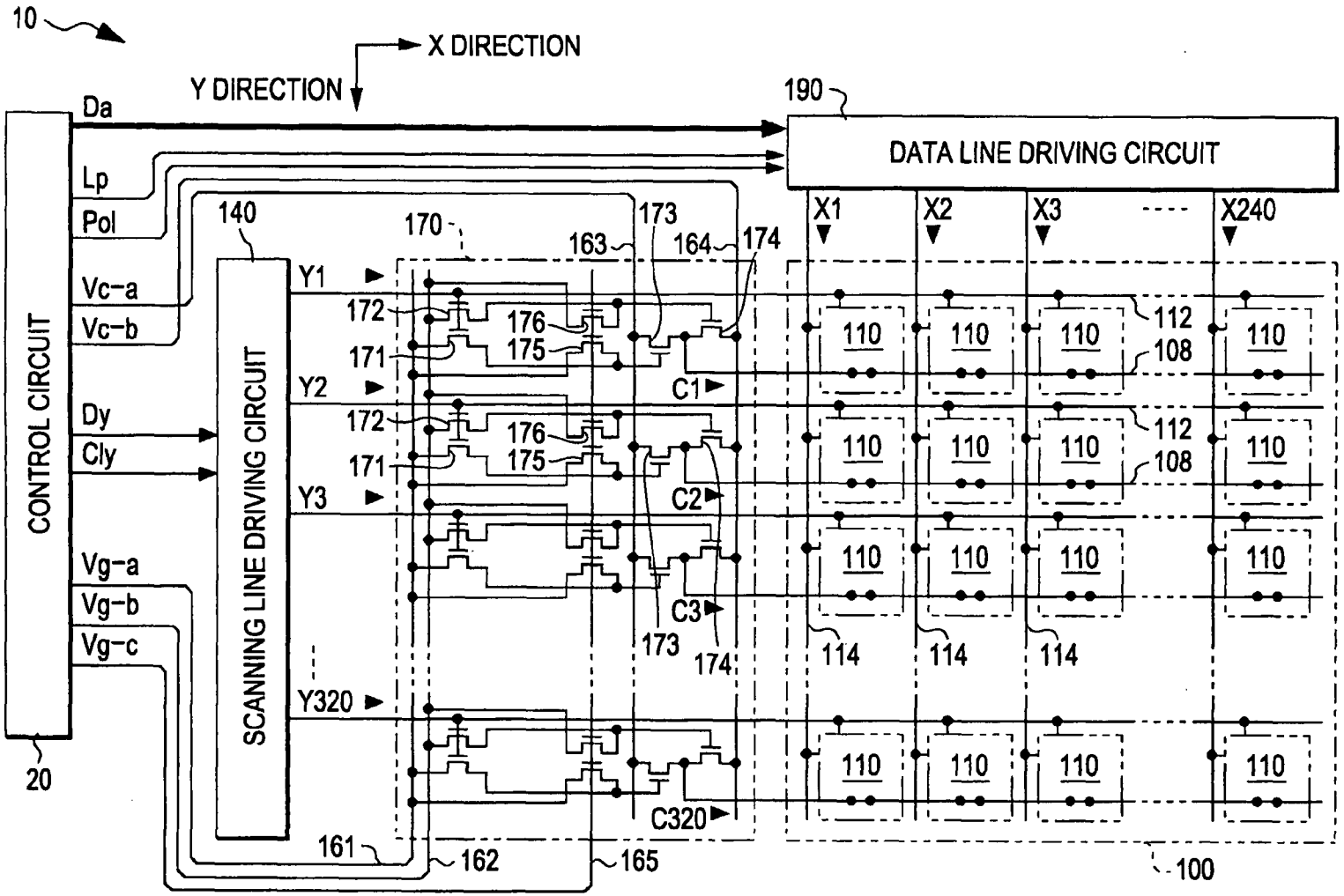
FIG. 1 is a diagram illustrating a configuration of an electro-optical device according to a first embodiment of the present invention.

A first embodiment of the invention will now be described. FIG. 1 is a diagram illustrating a configuration of an electro-optical device according to the first embodiment of the invention.

As shown in FIG. 1, an electro-optical device 10 includes a display region 100, and further includes a scanning line driving circuit 140, a common electrode driving circuit 170, and a data line driving circuit 190 which are arranged near the display region 100. That is, the electro-optical device 10 is configured as a peripheral-circuit incorporating panel. The electro-optical device 10 further includes a control circuit 20 connected to the peripheral-circuit incorporating panel through an FPC (flexible printed circuit) board, for example.

The display region 100 includes pixels 110. In this embodiment, first to 320th scanning lines 112 are arranged so as to extend in a row direction (X direction), and first to 240th data lines 114 are arranged so as to extend in a column direction (Y direction). The first to 320th scanning lines 112 intersect with the first to 240th data lines 114 and the pixels 110 are arranged at intersections. Although, in the display region 100 of this embodiment, the pixels 110 are arranged in a matrix of 320 rows and 240 columns, the invention is not limited to this arrangement.

In this embodiment, common electrodes 108 extending in the X direction are provided for individual first to 320th scanning lines 112. That is, the common electrodes 108 correspond to the first to 320th scanning lines 112.

Figure 2:
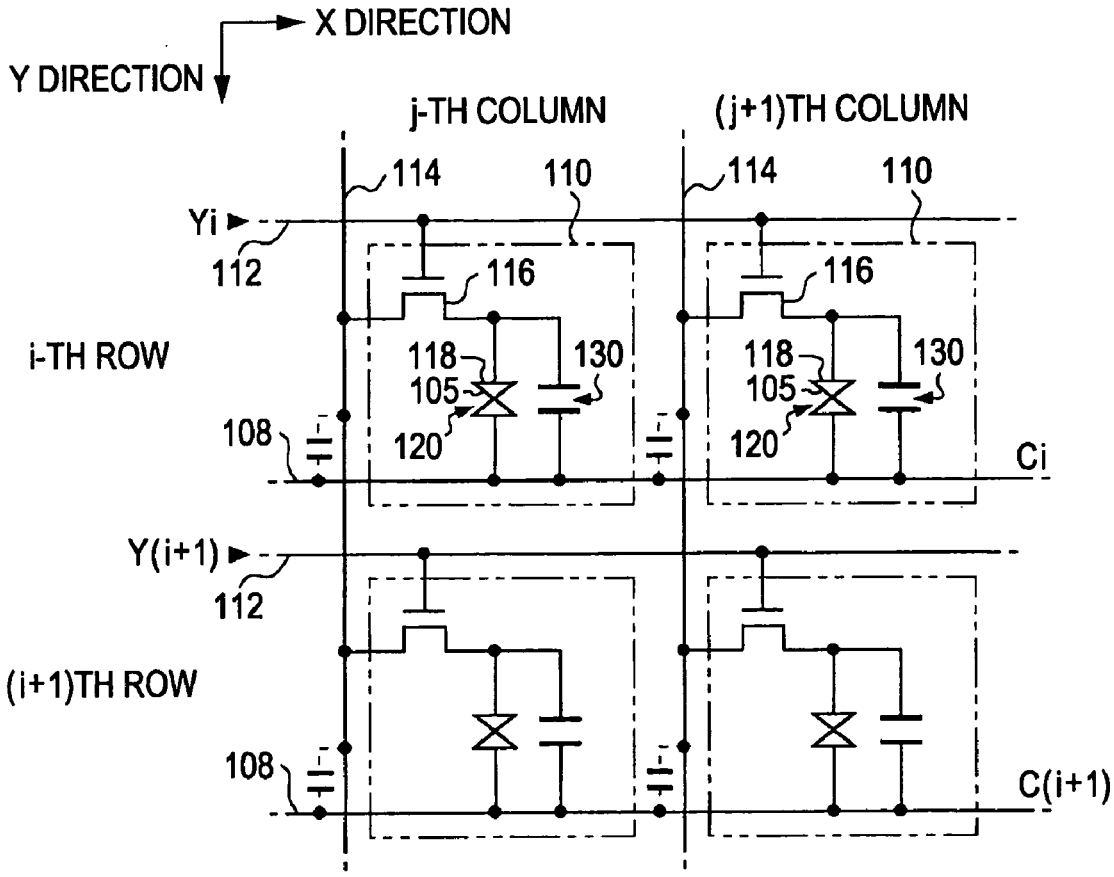
FIG. 2 is a diagram illustrating a configuration of pixels included in the electro-optical device.

A configuration of the pixels 110 will now be described in detail. FIG. 2 shows a configuration of the pixels 110, and shows extracted four pixels which are arranged in a matrix of two rows and two columns and which are arranged at intersections of an i-th row and a (i+1)th row of a j-th column and a (j+1)th column. The (i+1)th row is adjacent to the i-th row and arranged below the i-th row. The (j+1)th column is adjacent to the j-th column and arranged on the right side of the j-th column.

Note that "i" and "(i+1)" generally denote rows in which the pixels 110 are arranged and "i" represents an odd number selected from 1, 3, 5, to 319, and "(i+1)" represents an even number, which follows "i", selected from 2, 4, 6, to 320. Similarly, the "j" and the "(j+1)" generally denote columns in which the pixels 110 are arranged and "j" represents an odd number selected from 1, 3, 5, to 239, and "(j+1)" represents an even number, which follows "j", selected from 2, 4, 6, to 240.

As shown in FIG. 2, each of the pixels 110 includes an n-channel thin film transistor 116 (hereinafter simply referred to as a "TFT") serving as a pixel switching element, a liquid crystal capacitor (pixel capacitor) 120, and a storage capacitor 130. Since the pixels 110 according to this embodiment have identical configurations, a pixel 110 located in the i-th row of the j-th column is extracted and described as an example hereinafter. In the pixel 110 located in the i-th row of the j-th column, a gate electrode of the TFT 116 is connected to an i-th scanning line 112, a source electrode of the TFT 116 is connected to a j-th data line 114, and a drain electrode of the TFT 116 is connected to a first end of the liquid crystal capacitor 120 and a first end of the storage capacitor 130. A second end of the liquid crystal capacitor 120 and a second end of the storage capacitor 130 are connected to a corresponding one of the common electrodes 108.

Note that in FIG. 2, "Yi" and "Y(i+1)" denote scanning signals to be supplied to the i-th scanning line 112 and an (i+1)th scanning line 112, and "Ci" and "C(i+1)" denote voltages of an i-th common electrode 108 and an (i+1)th common electrode 108. Optical characteristics, for example, of the liquid crystal capacitor 120 will be described later.

Referring back to FIG. 1, the control circuit 20 outputs various control signals and controls units included in the electro-optical device 10. Note that the control signals will be described later as needed.

The electro-optical device 10 operates in two modes, that is, a full screen mode (first mode) and a partial mode (second mode). In the full screen mode, an image is displayed using all the pixels 110 arranged in a matrix of 320 rows and 240 columns. In the partial mode, an effective image is displayed using, among the pixels 110, a number of pixels 110 corresponding to a number of scanning lines 112 selected from among the scanning lines 112, and the other pixels are not used to display the image. Note that, hereinafter, the description is based on the full screen mode and the partial mode is described as an exceptional case.

As described above, the peripheral circuits such as the scanning line driving circuit 140, the common electrode driving circuit 170, and the data line driving circuit 190 are arranged near the display region 100.

Figure 4:
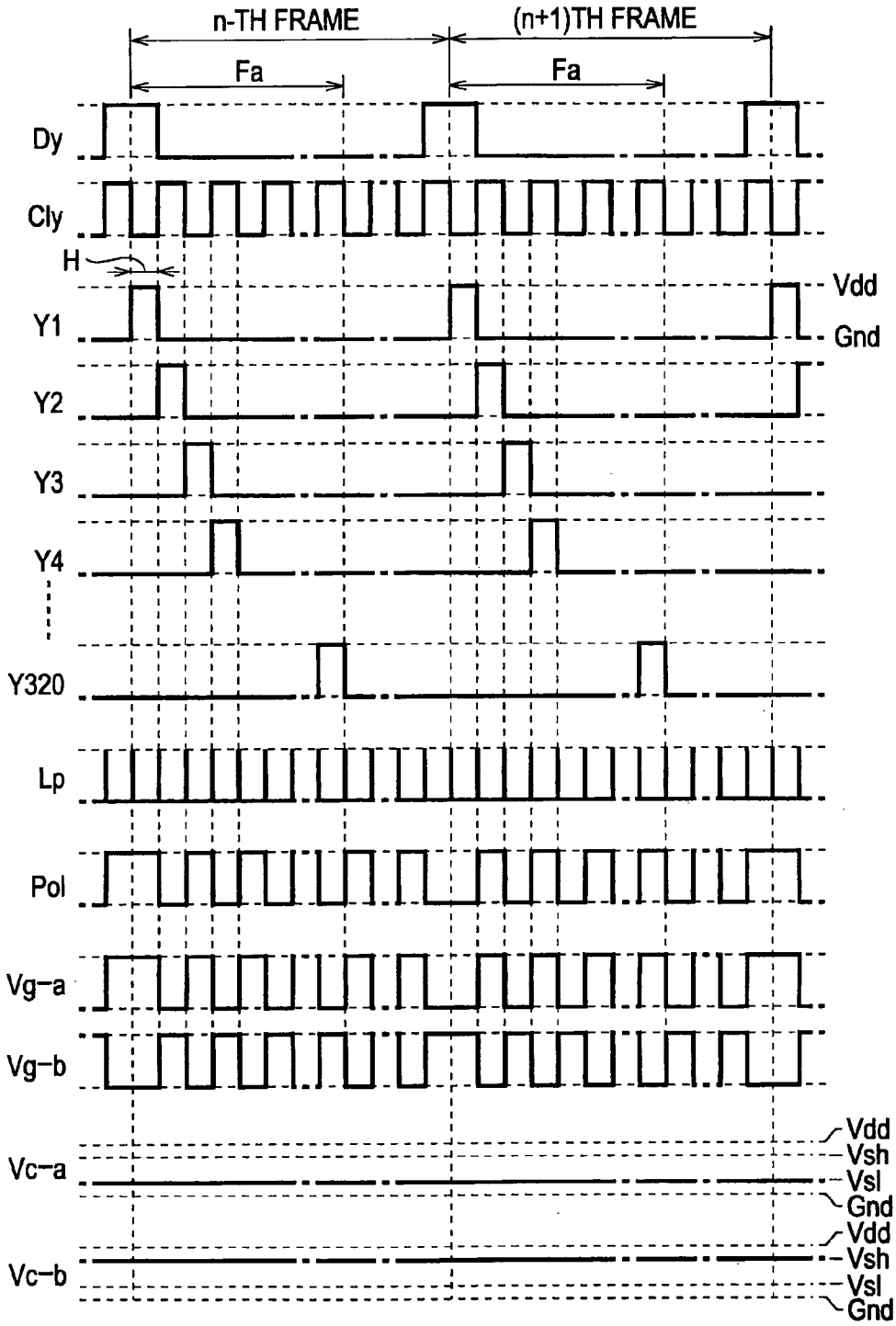
FIG. 4 is a diagram illustrating operations of a full screen mode of the electro-optical device.

Among these peripheral circuits, the scanning line driving circuit 140 supplies scanning signals Y1 to Y320 to the first to 320th scanning lines 112, respectively, in the full screen mode. Specifically, as shown in FIG. 4, the scanning line driving circuit 140 successively selects the first to 320th scanning lines 112 shown in FIG. 1 in ascending order in a period corresponding to one frame. A scanning signal to be supplied to a currently selected scanning line is represented by a selection voltage Vdd having a high level, and scanning signals other than the scanning signal to be supplied to the currently selected scanning line have non-selection voltages (ground potential Gnd) of low levels.

The scanning line driving circuit 140 receives a start pulse Dy from the control circuit 20, and successively shifts the start pulse Dy in accordance with a clock signal Cly so as to generate the scanning signals Y1 to Y320 of high levels in this order. In FIG. 4, a timing at which a level of one of the scanning signals supplied to a corresponding one of the scanning lines 112 is changed from a high level to a low level coincides with a timing at which a level of one of the scanning signals supplied to a subsequent corresponding one of the scanning lines 112 is changed from a low level to a high level. However, an interval may be interposed between the timings by controlling a period in which each of the scanning signals keeps a high level to be short, for example.

In this embodiment, one frame corresponds to a period in which an image is displayed in the full screen mode, that is, 16.7 milliseconds. As shown in FIG. 4, one frame includes an effective scanning period Fa from when a level of the scanning signal Y1 becomes a high level to when a level of the scanning signal Y320 becomes a low level, and also includes a flyback period. Note that, since, in one frame in the partial mode, an image may not be displayed as will be described later, one frame may correspond to 16.7 milliseconds for convenience sake.

Note that the flyback period may be eliminated, and a period in which one of the scanning lines 112 is selected corresponds to a horizontal scanning period (H).

Figure 7:
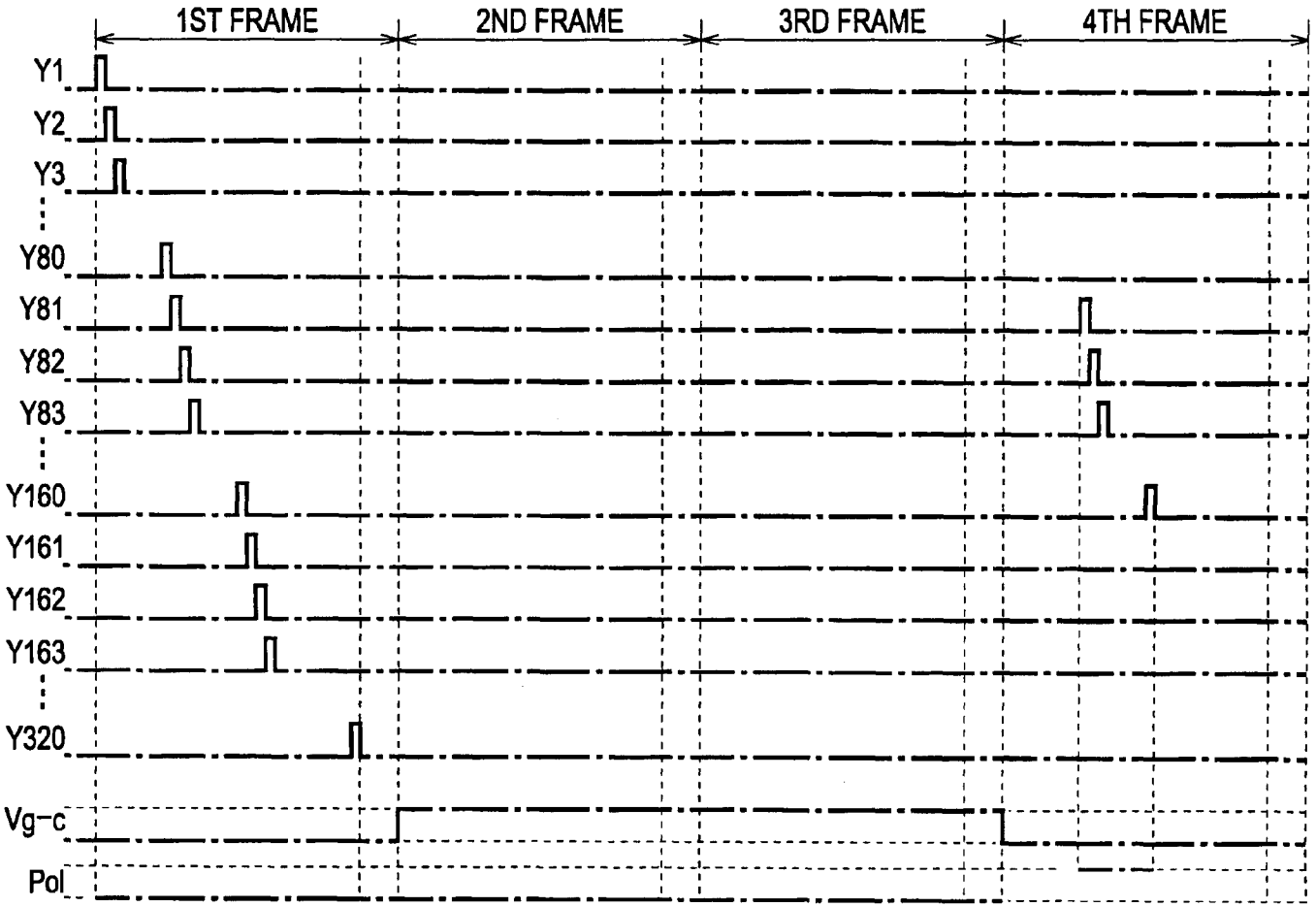
FIG. 7 is a diagram illustrating an operation of the electro-optical device in a partial mode.
Figure 8:
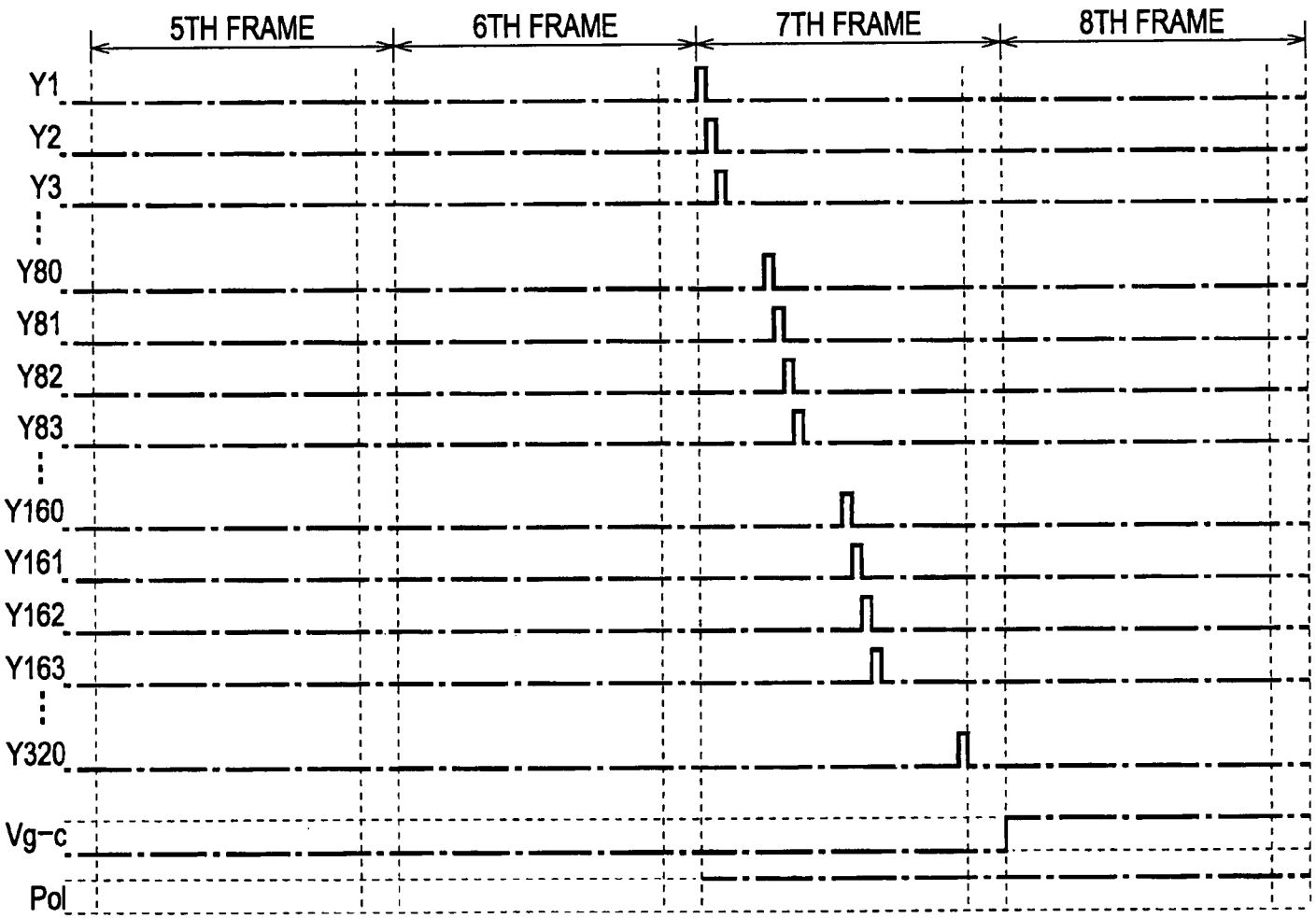
FIG. 8 is a diagram illustrating an operation of the electro-optical device in a partial mode.
Figure 9:
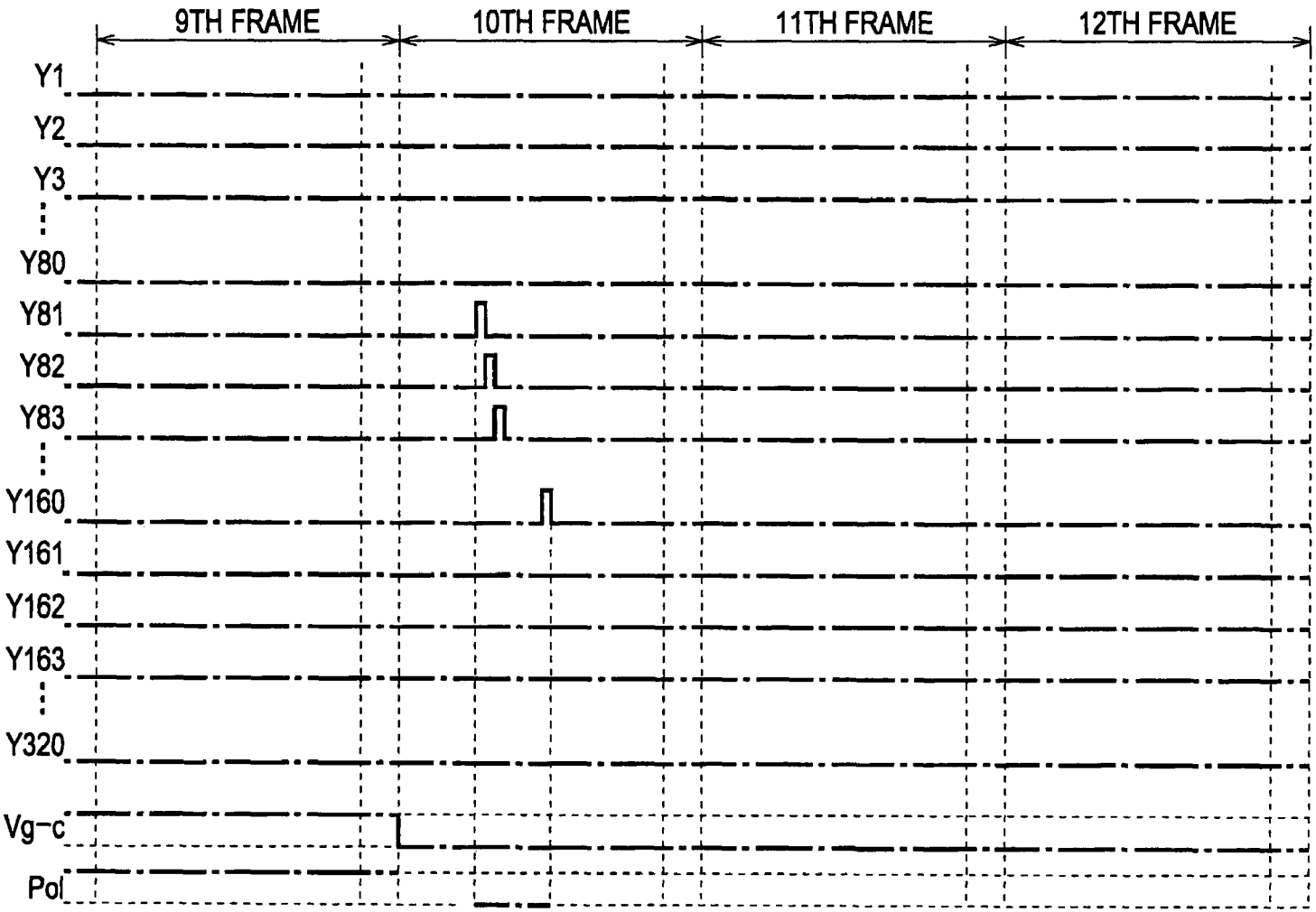
FIG. 9 is a diagram illustrating an operation of the electro-optical device in a partial mode.

In the partial mode, as shown in FIGS. 7 to 9, the scanning line driving circuit 140 outputs scanning signals, among the scanning signals Y1 to Y320 having waveforms in the full screen mode, which are brought to high levels in a number of frames, all the scanning signals or a number of scanning signals being brought to high levels in the number of frames.

In this embodiment, the common electrode driving circuit 170 includes TFT groups having n-channel TFTs 171 to TFTs 176 arranged so as to correspond to the first to 320th common electrodes 108.

Since connection manners of the TFTs 171 to 176 in the individual TFT groups are identical, a TFT group located in the i-th row will be described as an example. The TFT 171 (first transistor) in the i-th row has a gate electrode connected to the i-th scanning line 112, a source electrode connected to a first power supply line 161, and a drain electrode connected to a gate electrode of the TFT 173. The TFT 172 (second transistor) in the i-th row has a gate electrode connected to the i-th scanning line 112, a source electrode connected to a second power supply line 162, and a drain electrode connected to a gate electrode of the TFT 174.

The TFT 173 (third transistor) in the i-th row has a source electrode connected to a third power supply line 163, the TFT 174 (fourth transistor) in the i-th row has a source electrode connected to a fourth power supply line 164, and a drain electrode of the TFT 173 and a drain electrode of the TFT 174 are connected to the i-th common electrode 108.

Furthermore, the TFT 175 (fifth transistor) in the i-th row has a gate electrode connected to a fifth power supply line (control line) 165, a source electrode connected to the first power supply line 161, and a drain electrode connected to the gate electrode of the TFT 173 along with the drain electrode of the TFT 171. The TFT 176 (sixth transistor) in the i-th row has a gate electrode also connected to the fifth power supply line 165, source electrode connected to the second power supply line 162, and a drain electrode connected to the gate electrode of the TFT 174 along with the drain electrode of the TFT 172.

The data line driving circuit 190 supplies data signals having voltages based on writing polarities specified using a polarity specifying signal Pol, that is, voltages corresponding to levels of gradation of the pixels 110 through the data lines 114 to the pixels 110 connected to, among all the scanning lines 112, scanning lines 112 to which selection voltages are applied using the scanning line driving circuit 140.

The data line driving circuit 190 includes storage regions (not shown) corresponding to the pixels 110 arranged in a matrix of 320 rows and 240 columns. In the storage regions, pieces of display data Da which specify levels of gradation (brightness) of the corresponding pixels 110 are stored. Immediately before a selection voltage is applied to a selected one of the scanning lines 112, the data line driving circuit 190 reads pieces of display data Da corresponding to pixels 110 connected to the selected one of the scanning lines 112 from corresponding storage regions, obtains voltages corresponding to levels of gradation specified by the read pieces of display data Da and a writing polarity, and supplies data signals having the voltages to corresponding data lines 114 when the selection voltage is applied. The data line driving circuit 190 performs this supply operation on each of the first to 240th columns of the selected one of the scanning lines 112.

Note that each the pieces of display data Da is replaced by a new one supplied with its address from the control circuit 20 when display content is changed. Operation of the data line driving circuit 190 in the partial mode will be described later.

The control circuit 20 supplies a latch pulse Lp to the data line driving circuit 190 when a logic level of the clock signal Cly is changed. As described above, the scanning line driving circuit 140 successively shifts the start pulse Dy in accordance with the clock signal Cly so as to generate the scanning signals Y1 to Y320 of high levels in this order. Therefore, a timing at which selection of one of the scanning lines 112 is started coincides with a timing at which the logic level of the clock signal Cly is changed. Accordingly, the data line driving circuit 190 detects a currently selected scanning line by counting supplied latch pulses Lp from a starting point of a frame. Furthermore, the data line driving circuit 190 detects the timing at which selection of one of the scanning lines 112 is started on the basis of a timing at which the latch pulse Lp is supplied.

Note that the scanning line driving circuit 140 performs the shifting operation of the start pulse Dy as described above also in the partial mode, but a limited number of scanning signals are brought to high levels.

In the full screen mode of this embodiment, when a level of the polarity specifying signal Pol is high, positive-polarity writing operations are performed on the pixels 110 corresponding to the scanning lines to which the selection voltages are applied. On the other hand, when the level of the polarity specifying signal Pol is low, negative-polarity writing operations are performed on the same pixels 110. A waveform of the polarity specifying signal Pol is shown in FIG. 4. Specifically, as shown in FIG. 4, in a period of a frame (hereinafter referred to as an "n-th frame"), the level of the polarity specifying signal Pol becomes a high level when the selection voltages are applied to the scanning signals to be supplied to the odd-numbered scanning lines (first, third, fifth, to 319th scanning lines), whereas the level of the polarity specifying signal Pol becomes a low level when the selection voltages are applied to the scanning signals to be supplied to the even-numbered scanning lines (second, fourth, sixth, to 320th scanning lines). Accordingly, in this embodiment, the writing polarities are alternately inverted on a row-by-row basis, that is, a row inversion method (or line inversion method or scanning-line inversion method) is employed in the full screen mode.

Note that in the full screen mode, in a subsequent frame (hereinafter referred to as an "(n+1)th frame"), the level of the polarity specifying signal Pol is logically inverted from that of the n-frame in the same rows. By this, degradation of the liquid crystal due to applied direct current components is prevented.

On the other hand, in the partial mode, as shown in FIGS. 7 to 9, which will be described later, the polarity specifying signal Pol keeps a low level from the first frame to the third frame. Then, in the fourth frame, while the scanning signals are successively brought to high levels, the polarity specifying signal Pol keeps a high level, and in the seventh to ninth frames, the polarity specifying signal Pol keeps a high level. Then, in the tenth frame, while the scanning signals are successively brought to high levels, the polarity specifying signal Pol keeps a low level.

As for the writing polarities in this embodiment, in each of the pixels 110, when the positive polarities are specified, potentials of pixel electrodes 118 are higher than potentials of the corresponding common electrodes 108 when voltages in accordance with levels of gradation for the corresponding pixels 110 are applied to corresponding liquid crystal capacitors 120. On the other hand, when the negative polarities are specified, the potentials of the pixel electrodes 118 are lower than the potentials of the corresponding common electrodes 108 when the voltages in accordance with the levels of gradation for the corresponding pixels 110 are applied to the corresponding liquid crystal capacitors 120. As for the voltage, the ground potential Gnd corresponds to a low-level voltage based on a logic level, and is a reference of a zero voltage.

The control circuit 20 supplies signals Vg-a and Vg-b to the first power supply line 161 and the second power supply line 162, respectively. In this embodiment, in each of the full screen mode and the partial mode, the signal Vg-a has a waveform similar to that of the polarity specifying signal Pol whereas the signal Vg-b has a waveform obtained by logically inverting the waveform of the polarity specifying signal Pol.

When the voltages Vdd, which is a voltage of a high level based on a logic level, is applied to a gate electrode of one of TFTs 173 and a gate electrode of a corresponding one of TFTs 174, the source and drain electrodes of the one of the TFTs 173 are brought into conduction states and the source and drain electrodes of the corresponding one of the TFTs 174 are brought into conduction states. That is, the voltage Vdd is an on-voltage. On the other hand, when the ground potential Gnd, which is a voltage of a low level based on the logic level, is applied to a gate electrode of one of the TFTs 173 and a gate electrode of the corresponding one of the TFTs 174, the source and drain electrodes of the one of the TFTs 173 are brought into non-conduction states and the source and drain electrode of the corresponding one of the TFTs 174 are brought into non-conduction states. That is, the ground potential Gnd is an off-voltage.

The control circuit 20 supplies common signals Vc-a and Vc-b to the third power supply line 163 and the fourth power supply line 164, respectively. In this embodiment, in each of the full screen mode and the partial mode, the common signal Vc-a has a fixed voltage Vsl, and the common signal Vc-b has a fixed voltage Vsh. The voltage Vsl and the voltage Vsh has the following relationship: (Gnd≦) Vsl<Vsh (≦Vdd). Accordingly, the voltage Vsl is relatively lower than the voltage Vsh (that is, the voltage Vsh is relatively higher than the voltage Vsl).

The control circuit 20 supplies a control signal Vg-c to the fifth power supply line 165. In the full screen mode, a level of the control signal Vg-c is low. However, in the partial mode, the control signal Vg-c is brought to a high level only in the second, third, eighth, and ninth frames as shown in FIGS. 7 to 9.

Figure 3:
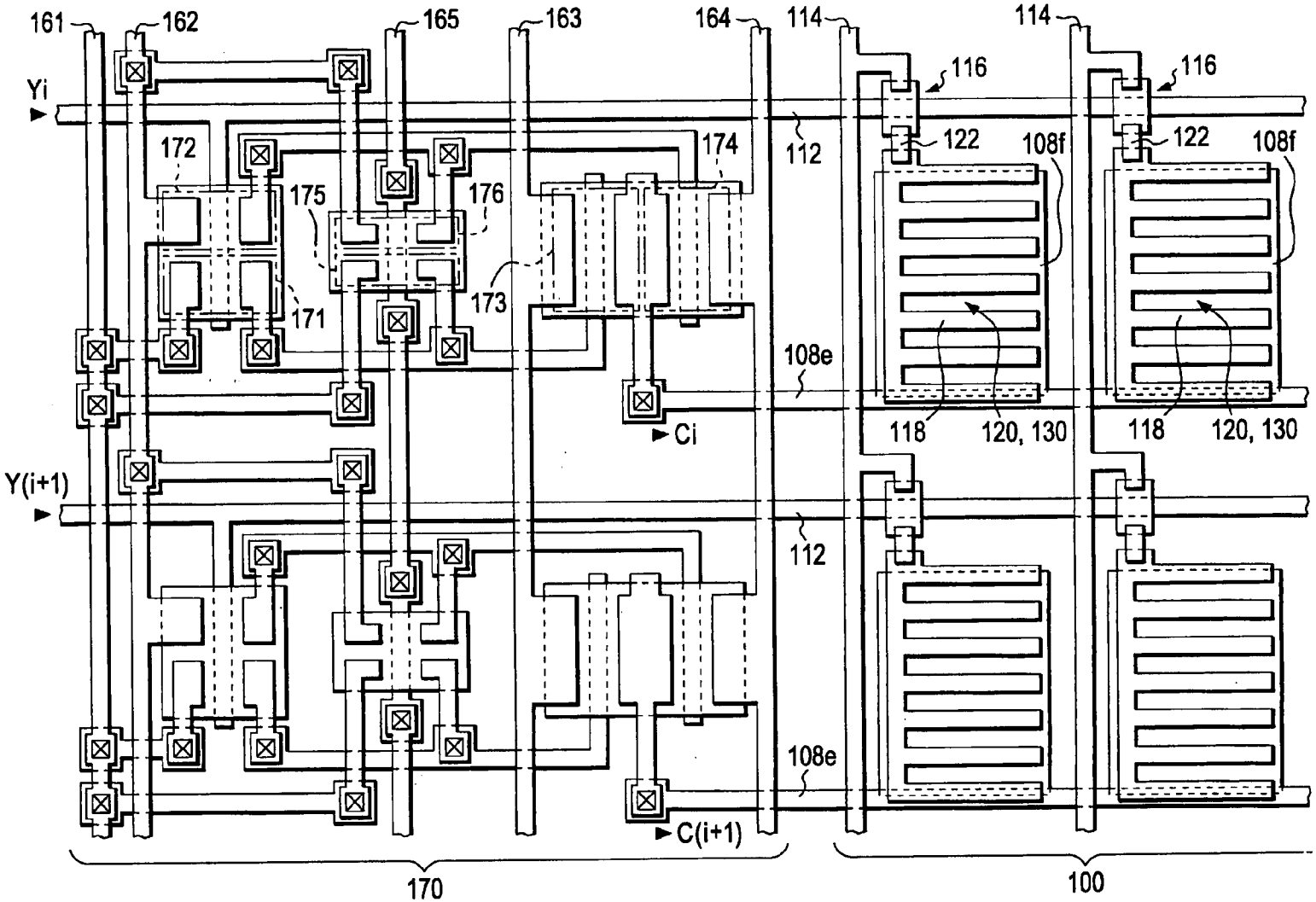
FIG. 3 is a plan view illustrating a configuration of an essential portion of an element substrate of the electro-optical device.

A panel of an electro-optical device is configured such that an element substrate and a counter substrate are attached to each other as a pair with a predetermined gap therebetween, and the gap is filled with liquid crystal. The element substrate includes the scanning lines 112, the data lines 114, the common electrodes 108, pixel electrodes 118, TFTs 116, and TFTs 171 to 176, and is attached to the counter substrate so that a surface in which the electrodes are formed faces the counter substrate. FIG. 3 is a plan view illustrating a portion in the vicinity of a boundary between the display region 100 and the common electrode driving circuit 170 according to the configuration of the panel of the electro-optical device.

As is apparent from FIG. 3, the display region 100 employs an FFS (fringe field switching) mode which is a modification of an IPS (in-plane switching) mode in which an electric field of the liquid crystal is applied toward a surface of a substrate.

In this embodiment, the TFTs 116 and the TFTs 171 to 176 are amorphous silicon TFTs, and furthermore, each of the TFTs 116 and the TFTs 171 to 176 is a bottom gate TFT in which the gate electrode thereof is positioned lower than a semiconductor layer (a depth side of the figure).

Specifically, rectangular electrodes 108*f* are formed by patterning a (first) ITO (indium tin oxide) layer serving as a first conductive layer, gate lines such as the scanning lines 112 and common lines 108*e* are formed by patterning a gate electrode layer serving as a second conductive layer, and a gate insulating layer (not shown) is formed on the gate lines, and furthermore, TFT semiconductor layers are formed on the gate insulating layer in an isolated manner. Thereafter, a protection insulating layer (not shown) is formed on the semiconductor layers, before pixel electrodes 118 having comb shapes are formed by patterning a (second) ITO layer serving as a third conductive layer. Furthermore, the source electrodes and the drain electrodes of the TFTs, the data lines 114, the first power supply line 161, the second power supply line 162, the third power supply line 163, the fourth power supply line 164, the fifth power supply line 165, and various connection electrodes are formed by patterning a metal layer serving as a fourth conductive layer.

As shown in FIG. 3, the common electrodes 108 shown in FIGS. 1 and 2 include the common lines 108*e* extending parallel to the scanning lines 112 and the rectangular electrodes 108*f* on which the pixel electrodes 118 are arranged through the protection insulating layer. Each of the common lines 108*e* and a corresponding one of the rectangular electrodes 108*f* arranged in an identical row are partly superposed with each other and are electrically connected to each other. Accordingly, each of the common lines 108*e* and a corresponding one of the rectangular electrodes 108*f* arranged in an identical row are electrically identical, and are not required to be distinguished from each other. Therefore, the common lines 108*e* and the corresponding rectangular electrodes 108*f* are referred to as the common electrodes 108 unless a description about a configuration is made.

In this embodiment, storage capacitors 130 are capacitance components generated due to a layer structure of the rectangular electrodes 108*f* and the pixel electrodes 118 with the protection insulating layer interposed therebetween. In addition, since the gap interposed between the element substrate and the counter substrate is filled with the liquid crystal, capacitance components are generated due to the configuration in which the gap is filled with the liquid crystal functioning as a dielectric body. The capacitance components generated due to the gap filled with the liquid crystal are represented by the liquid crystal capacitors 120, in this embodiment.

With this configuration, an electric field is generated along a surface of the element substrate and perpendicular to projecting portions of the pixel electrodes 118 in accordance with holding voltages of parallel capacitors, each of which includes a liquid crystal capacitor 120 and a storage capacitor 130, so as to change the orientation of the liquid crystal. Accordingly, an amount of light transmitting through a polarizing element (not shown) corresponds to actual values of the holding voltages.

Note that although the FFS mode is employed in this embodiment, the IPS mode may be used, and alternatively, another mode may be used as long as an electric equivalent circuit corresponding to the circuit shown in FIG. 2 is employed.

The holding voltages of the parallel capacitors correspond to differential voltages between the pixel electrodes 118 and the common electrodes 108 (rectangular electrodes 108*f*). Accordingly, to obtain a target level of gradation for a pixel arranged in the i-th row of the j-th column, a selection voltage Vdd is applied to the i-th scanning lines 112 so that a corresponding one of the TFTs 116 of the pixel of interest is brought into a conduction state (turned on), and a data signal Xj having a voltage which corresponds to a differential voltage corresponding to the target level of gradation for the pixel is supplied to a corresponding one of the pixel electrodes 118 through the j-th data line and through the TFT 116 which is arranged in the i-th row of the j-th column and which is in a on-state.

Note that in this embodiment, for simplicity, when the actual values of the holding voltages are almost zero, light transmissivity is minimized so that black display is attained, and as the actual values of the holding voltages increase, an amount of transmitting light increases so that white display having the maximum light transmissivity is attained. That is, a normally black mode is employed in this embodiment.

The common electrodes 108 in individual rows intersect with the first to 240th data lines 114 through the gate insulating layer and the other layers. Accordingly, as indicated by dashed lines shown in FIG. 2, the common electrodes 108 are capacitively coupled to the data lines 114 through parasitic capacitors.

The configuration shown in FIG. 3 is merely an example, and other configurations of TFTs may be applicable. For example, in terms of arrangements of the gate electrodes, top gate TFTs may be employed, and in terms of processes, polysilicon TFTs may be employed. Furthermore, instead of a configuration in which elements of the common electrode driving circuit 170 are arranged on the substrate by a process used for the arrangement of the display region 100, a configuration in which an IC chip is implemented in the element substrate may be employed.

In a case where the IC chip is implemented on the element substrate, the scanning line driving circuit 140, the common electrode driving circuit 170, and the data line driving circuit 190 may be integrated as a semiconductor chip or may be configured as individual chips. The control circuit 20 may be included in the element substrate.

In this embodiment, a transmission type panel, a reflection type panel, and a so-called semi-transmissive and semi-reflective panel which is a combination of the transmission type panel and the reflection type panel may be employed. Therefore, a reflection layer, for example, is not particularly referred to.

Operation of the electro-optical device 10 in the full screen mode according to this embodiment will now be described.

As described above, in this embodiment, when the full screen mode is used, the control circuit 20 outputs the polarity specifying signal Pol, the signal Vg-a, and the signal Vg-b in the n-th frame, and the common signal Vc-a has the fixed voltage Vsl and the common signal Vc-b has the fixed voltage Vsh as shown in FIG. 4.

In the n-th frame, the scanning signal Y1 supplied from the scanning line driving circuit 140 to the first scanning line 112 is brought to a high level. Since, in the n-th frame, positive-polarity writing operations are performed on odd-numbered rows, when the scanning signal Y1 is brought to a high level and simultaneously the latch pulse Lp is output, the data line driving circuit 190 supplies data signals X1 to X240 having voltages higher than the voltage Vsl serving as a reference voltage by voltages specified using the pieces of display data Da for pixels arranged in the first to the 240th columns of the first row to the first to the 240th data lines 114, respectively. Accordingly, for example, a data signal Xj to be supplied to the j-th data line 114 has a voltage higher than the voltage Vsl by a voltage specified using display data Da for a pixel arranged in the j-th column of the first row.

When the scanning signal Y1 is brought to a high level, TFTs 116 included in pixels 110 arranged in the first to 240th columns of the first row are turned on. Therefore, the data signals X1 to X240 are supplied to pixel electrodes 118 corresponding to the TFTs 116.

When the level of the scanning signal Y1 is high, in the common electrode driving circuit 170, TFTs 171 and TFTs 172 corresponding to the first row are turned on. Here, when the level of the scanning signal Y1 is high, a level of the signal Vg-a supplied to the first power supply line 161 is high whereas a level of the signal Vg-b supplied to the second power supply line 162 is low. Therefore, when the TFTs 171 and the TFTs 172 corresponding to the first row are turned on, on-voltages of high levels are applied to gate electrodes of TFTs 173 corresponding to the first row, and off-voltages of low levels are applied to gate electrodes of TFTs 174 corresponding to the first row. Accordingly, since the TFTs 173 corresponding to the first row are turned on and the TFTs 174 corresponding to the first row are turned off, the first common electrode 108 corresponding to the first row is connected to the third power supply line 163 so that the voltage Vsl is applied thereto.

Accordingly, voltages having positive polarities obtained so as to correspond to levels of gradation for corresponding pixels are written to parallel capacitors, each of which includes a liquid crystal capacitor 120 and a storage capacitor 130, corresponding to the first to 240th columns of the first row. Note that, in the full screen mode, since TFTs 175 and TFTs 176 corresponding to all the rows are in off states, on or off states of the TFTs 173 and the TFTs 174 are not determined by the TFTs 175 and the TFTs 176.

Next, the scanning signal Y1 is brought to a low level and the scanning signal Y2 is brought to a high level.

When the scanning signal Y1 is brought to a low level, the TFTs 116 included in the pixels 110 arranged in the first to 240th columns of the first row are turned off. Therefore, in the pixels 110 arranged in the first to 240th columns of the first row, the corresponding pixel electrodes 118 are brought into high-impedance states.

In the common electrode driving circuit 170*a*, the TFTs 172 and the TFTs 172 corresponding to the first row are turned off, and accordingly, the gate electrodes of the TFTs 173 and the gate electrodes of the TFTs 174 are brought into high-impedance states. However, since levels of the gate electrodes of the TFTs 173 and levels of the gate electrodes of the TFTs 174 are maintained in certain states immediately before entering high-impedance states due to parasitic capacitors thereof, that is, levels of the TFTs 173 are high and levels of the TFTs 174 are low, the TFTs 173 and the TFTs 174 are maintained in the on-states and the off-states, respectively. Accordingly, even when the scanning signal Y1 is brought to a low level, one of the common electrodes 108 corresponding to the first row maintains the connection to the third power supply line 163, and therefore, maintains the voltage Vsl. Since one end of each of the parallel capacitors, each of which includes a liquid crystal capacitor 120 and a storage capacitor 130, corresponding to the first to 240th columns of the first row maintains the voltage Vsl, states of voltages which have been written to the parallel capacitors are not changed but maintained.

On the other hand, since, in the n-th frame, negative-polarity writing operations are performed on even-numbered rows, when the scanning signal Y2 is brought to a high level and simultaneously the latch pulse Lp is output, the data line driving circuit 190 supplies the data signals X1 to X240 having voltages lower than the voltage Vsh serving as a reference voltage by voltages specified using the pieces of display data Da for pixels arranged in the first to the 240th columns of the second row to the first to the 240th data lines 114, respectively. Accordingly, for example, a data signal Xj supplied to the j-th data line 114 has a voltage lower than the voltage Vsh by a voltage specified using display data Da for a pixel arranged in the j-th column of the second row.

When the scanning signal Y2 is brought to a high level, the TFTs 116 included in pixels 110 arranged in the first to 240th columns in the second row are turned on. Therefore, the data signals X1 to X240 are supplied to pixel electrodes 118 corresponding to the TFTs 116.

When the level of the scanning signal Y2 is high, in the common electrode driving circuit 170, TFTs 171 and TFTs 172 corresponding to the second row are turned on. Here, when the level of the scanning signal Y2 is high, the signal Vg-a supplied to the first power supply line 161 is brought to a low level whereas the signal Vg-b supplied to the second power supply line 162 is brought to a high level. Therefore, unlike the TFTs 173 and the TFTs 174 corresponding to the first row, the TFTs 173 corresponding to the second row are turned off and the TFTs 174 corresponding to the second row are turned on. Accordingly, the second common electrode 108 is connected to the fourth power supply line 164 so that the voltage Vsh is applied thereto.

Accordingly, voltages having negative polarities obtained so as to correspond to levels of gradation for corresponding pixels are written to parallel capacitors, each of which includes a liquid crystal capacitor 120 and a storage capacitor 130, corresponding to the first to 240th columns of the second row.

Subsequently, the scanning signal Y2 is brought to a low level while the scanning signal Y3 is brought to a high level. When the scanning signal Y2 is brought to a low level, TFTs 116 included in pixels 110 arranged in the first to 240th columns of the second row are turned off. Therefore, in the pixels 110 arranged in the first to 240th columns of the second row, the corresponding pixel electrodes 118 are brought into high-impedance states.

In the common electrode driving circuit 170, since the TFTs 171 and the TFTs 172 corresponding to the second row are turned off, the gate electrodes of the TFTs 173 and the gate electrodes of the TFTs 174 are brought into high-impedance states. However, levels of the gate electrodes of the TFTs 173 are maintained in low levels and levels of the gate electrodes of the TFTs 174 are maintained in high levels due to parasitic capacitors thereof. Therefore, the TFTs 173 and the TFTs 174 are maintained in the off-states and the on-states, respectively. Accordingly, even when the scanning signal Y2 is brought to a low level after selection of the second scanning line is terminated, the second common electrodes 108 maintains the connection to the fourth power supply line 164, and therefore, maintains the voltage Vsh.

Accordingly, since one end of each of the parallel capacitors, each of which includes a liquid crystal capacitor 120 and a storage capacitor 130, corresponding to the first to 240th columns of the second row maintains the voltage Vsh, states of voltages which have been written to the parallel capacitors are not changed but maintained.

When the scanning signal Y3 is brought to a high level, voltages having the positive polarities corresponding to levels of gradation for corresponding pixels are written to parallel capacitors, each of which includes a liquid crystal capacitor 120 and a storage capacitor 130, corresponding to the third row. Then, when the scanning signal Y4 is brought to a high level, voltages having the negative polarities corresponding to levels of gradation for corresponding pixels are written to parallel capacitors, each of which includes a liquid crystal capacitor 120 and a storage capacitor 130, corresponding to the fourth row.

Operations similar to those described above are repeatedly performed until the 320th row is reached. Accordingly, in the n-th frame, voltages having the positive polarities corresponding to levels of gradation for corresponding pixels are written to parallel capacitors, each of which includes a liquid crystal capacitor 120 and a storage capacitor 130, corresponding to the odd-numbered rows. On the other hand, in the n-th frame, voltages having the negative polarities corresponding to levels of gradation for corresponding pixels are written to parallel capacitors, each of which includes a liquid crystal capacitor 120 and a storage capacitor 130, corresponding to the even-numbered rows. In this way, voltages corresponding to levels of gradation for corresponding pixels are written to the parallel capacitors in all the pixels 110, and a single (frame) image is displayed using the display region 100.

The polarity specifying signal Pol, the signal Vg-a, and the signal Vg-b of the subsequent (n+1)th frame have logic levels opposite to those of the preceding n-th frame. When one of the scanning lines 112 of the odd-numbered rows is selected, one of the common electrodes 108 corresponding to the selected one of the scanning lines 112 of the odd-numbered rows is connected to the fourth power supply line 164 so that the voltage Vsh is applied thereto. Even when the selected one of the scanning lines 112 becomes a non-selection state (that is, a level of a scanning signal is low), the connection between the one of the common electrodes 108 and the fourth power supply line 164 is maintained. On the other hand, when one of the scanning lines 112 of the even-numbered rows are selected, one of the common electrodes 108 corresponding to the selected one of the scanning lines 112 of the odd-numbered rows is connected to the third power supply line 163 so that the voltage Vsl is applied thereto. Even when the selected one of the scanning lines 112 becomes a non-selection state, the connection between the one of the common electrodes 108 and the third power supply line 163 is maintained.

Accordingly, in the (n+1)th frame, voltages having negative polarities corresponding to levels of gradation for corresponding pixels are written to the parallel capacitors, each of which includes a liquid crystal capacitor 120 and a storage capacitor 130, in the odd-numbered rows. Similarly, voltages having positive polarities corresponding to levels of gradation for corresponding pixels are written to the parallel capacitors, each of which includes a liquid crystal capacitor 120 and a storage capacitor 130, in the even-numbered rows. The parallel capacitors in all the rows maintain the written voltages.

Figure 5:
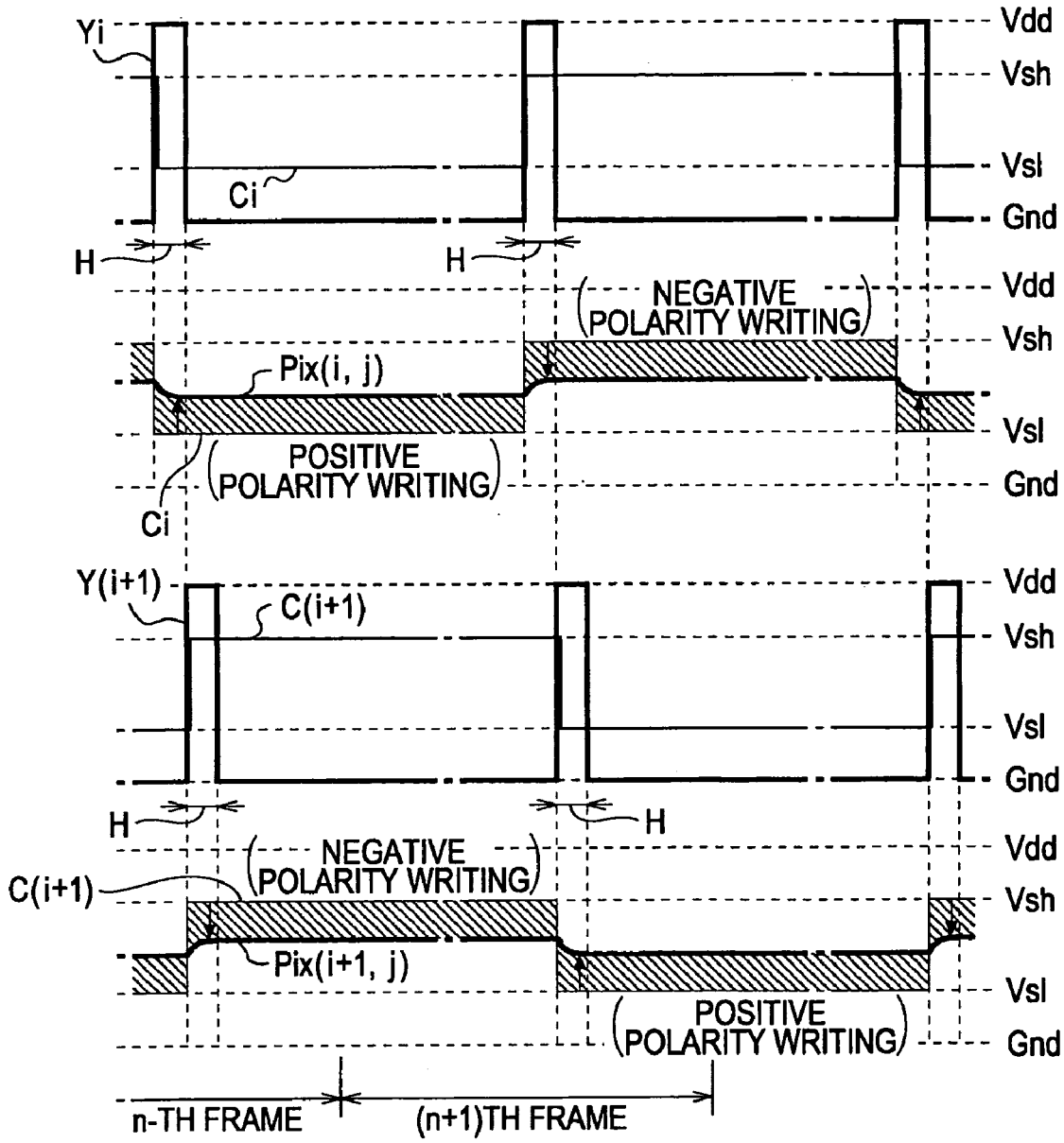
FIG. 5 is a diagram illustrating voltage waveforms of pixel electrodes of the electro-optical device.

Referring to FIG. 5, a voltage writing operation performed in this embodiment will be described. FIG. 5 shows the relationship between a scanning signal Yi and a voltage Pix(i, j) of a pixel electrode 118 arranged in the i-th row of the j-th column and the relationship between a scanning signal Y(i+1) and a voltage Pix(i+1, j) of a pixel electrode 118 arranged in the (i+1)th row of the j-th column. Note that in FIG. 5, the vertical scale indicating voltages is larger than that of FIG. 4 for convenience.

In the n-th frame, since positive-polarity writing operation is performed on an odd-numbered i-th row, while a level of the scanning signal Yi is high, a data signal Xj having a voltage higher than the voltage Vsl (indicated by an upward arrow mark in FIG. 5) by a voltage corresponding to a level of gradation for a pixel arranged in the i-th row of the j-th column is supplied to the j-th data line 114. Therefore, a differential voltage generated using the voltage of the data signal Xj and the voltage Vsl of a corresponding one of the common electrodes 108, that is, a positive polarity voltage corresponding to the level of gradation for the pixel arranged in the i-th row of the j-th column is written to a parallel capacitor, which includes a liquid crystal capacitor 120 and a storage capacitor 130, corresponding to the i-th row of the j-th column.

When the scanning signal Yi is brought to a low level, a pixel electrode 118 of the i-th row of the j-th column is brought into a high-impedance state. Meanwhile, since the common electrode 108 corresponding to the odd-numbered i-th row is connected to the third power supply line 163 when the scanning signal Yi is brought to a high level in the n-th frame, the voltage Vsl is applied thereto. This connection state is maintained until the scanning signal Yi is brought to a high level again in the subsequent (n+1)th frame. Therefore, the voltage Pix(i, j) of the pixel electrode 118 of the i-th row of the j-th column is not changed, that is, a voltage (corresponding to the voltage of the data signal Xj) obtained when the scanning signal Yi is brought to a high level is maintained. Accordingly, a voltage actual value (a hatched portion) held by the parallel capacitor including the liquid crystal capacitor 120 and the storage capacitor 130 is not influenced by the voltage Pix(i, j).

Note that, in the n-th frame, since a negative-polarity writing operation is performed on pixels arranged in an even-numbered (i+1) row, while a level of the scanning signal Y(i+1) is high, a data signal Xj having a voltage lower than the voltage Vsh (indicated by an downward arrow mark in FIG. 5) by a voltage corresponding to a level of gradation for a pixel arranged in the (i+1)th row of the j-th column is supplied to a data line 114 of the j-th column. Therefore, a negative polarity voltage corresponding to a level of gradation for the pixel arranged in the (i+1)th row of the j-th column is written to a parallel capacitor including a liquid crystal capacitor 120 and a storage capacitor 130 corresponding to the (i+1)th row of the j-th column. Since a common electrode 108 corresponding to the even-numbered (i+1)th row is connected to the fourth power supply line 164 when the scanning signal Y(i+1) is brought to a high level in the n-th frame, the voltage Vsh is applied thereto. This connection state is maintained until the scanning signal Y(i+1) is brought to a high level again in the subsequent (n+1)th frame. Therefore, the voltage Pix(i+1, j) is not changed, that is, a voltage (corresponding to the voltage of the data signal Xj) obtained when the scanning signal Yi is brought to a high level is maintained. Accordingly, a voltage actual value (a hatched portion) held by the parallel capacitor, which includes the liquid crystal capacitor 120 and the storage capacitor 130, corresponding to the (i+1)th row of the j-th column is not influenced by the voltage Pix(i+1, j).

Furthermore, in the (n+1)th frame, the writing polarity opposite to that in the n-th frame is employed, that is, the negative-polarity writing operation is performed on the pixels arranged in the odd-numbered i-th rows and the positive-polarity writing operation is performed on the pixels arranged in the even-numbered (i+1)th rows.

As described above, in this embodiment, the writing polarities are inverted for individual scanning lines in the full screen mode.

According to this embodiment, common electrodes 108 corresponding to rows subjected to the positive-polarity writing operations have relatively lower voltages Vsl when scanning lines 112 corresponding to the rows are selected, and voltages higher than the voltages Vsl by voltages corresponding to levels of gradation for the corresponding pixels are supplied as data signals. On the other hand, common electrodes 108 corresponding to rows subjected to the negative-polarity writing operations have relatively higher voltages Vsh when scanning lines 112 corresponding to the rows are selected, and voltages high than the voltages Vsh by voltages corresponding to levels of gradation for the corresponding pixels are supplied as data signals.

Accordingly, since voltage amplitudes of the data signals are small when compared with a case when the common electrodes 108 have fixed voltages, components of the data line driving circuit 190 may have merely comparatively smaller pressure resistance, and therefore, configurations thereof may be simplified. In addition, unnecessary power consumption due to voltage changes can be suppressed.

As described above, since the common electrodes 108 (common lines 108*e*) intersect with the first to 240th data lines 114 through the gate insulting layer and other layers, voltage changes of the data lines 114, that is, changes of the data signals X1 to X240 are transmitted to the common electrodes 108 through the parasitic capacitors.

Therefore, when the common electrodes 108 are not electrically connected to any components, the common electrodes 108 are influenced by the voltage changes of the data lines 114 (voltage changes of the data signals X1 to X240), and potentials of the common electrodes 108 are changed. In this embodiment, since the common electrodes 108 are provided for individual rows, amounts of changes of the potentials of the common electrodes 108 for individual rows are different from one another. This may lead to deterioration of display quality.

To address this disadvantage, in this embodiment, in the odd-numbered i-th row, for example, when the scanning signal Yi is brought to a high level, the TFTs 171 and the TFTs 172 in the i-th row are turned on, and accordingly, the TFTs 173 are turned on and the TFTs 174 are turned off, and signals of high levels are written to the parasitic capacitor of the TFTs 173 and signals of low levels are written to the parasitic capacitor of the TFTs 174. Even when the scanning signal Yi is brought to a low level, on-states of the TFTs 173 of the i-th row and off-states of the TFTs 174 of the i-th row are maintained. Consequently, the connection between one of the common electrodes 108 which corresponds to the odd-numbered i-th row and the third power supply line 163 is maintained. Similarly, in the n-th frame, connection between one of the common electrodes 108 which corresponds to the even-numbered (i+1)th row and the fourth power supply line 164 is maintained. Accordingly, in this embodiment, the voltages Vsl or the voltages Vsh are normally applied to the common electrodes 108 for individual rows, and accordingly, the common electrodes 108 are not brought into high-impedance states. Consequently, the deterioration of display quality caused by the voltage changes of the common electrodes 108 can be prevented.

Operation of the electro-optical device 10 in the partial mode will now be described. FIG. 6 is a diagram illustrating operations in frames in the partial mode. In the partial mode of this embodiment, 12 frames, that is, the first to twelfth frames are used as a unit for the operation.

In this example, the first to 80th rows and the 161st to 320th rows are non-display rows in which display is not performed, that is, pixels corresponding to the non-display rows are not available. On the other hand, the 81st to 160th rows are display rows in which display is performed. FIG. 6 shows writing polarities used in voltage writing operations performed on the pixels corresponding to the first to 320th scanning lines 112, when effective display is to be performed using pixels corresponding to the display rows.

Note that, in the partial mode, the pixels corresponding to the display rows may be simply displayed in binary display, that is, displayed in white which is an on-state and black which is an off-state. In this embodiment, gradation display may be used.

In FIG. 6, "+" denotes a positive polarity and "−" denotes a negative polarity used in the voltage writing operations. In addition, "×" denotes a state in which a voltage writing operation is not performed.

In the partial mode, negative-polarity voltage writing operations are performed on the first to 80th rows and the 161st to 320th rows of the first frame, and positive-polarity voltage writing operations are performed on the first to 80th rows and the 161st to 320th rows of the seventh frame. These voltage writing operations are performed so that voltages corresponding to black (off-states) are forcedly written to the pixels corresponding to the non-display rows in order to attain ineffective display. Meanwhile, the negative-polarity voltage writing operation, the positive-polarity voltage writing operation, the positive-polarity voltage writing operation, and the negative-polarity voltage writing operation are performed in this order on the 81st to 160th rows of the first, fourth, seventh, and tenth frames. Accordingly, in this embodiment, rows adjacent to each other have identical writing polarities in the partial mode.

Referring to FIGS. 7 to 9, waveforms of the scanning signals and other signals in the partial mode described in FIG. 6 will be described. FIG. 7 shows waveforms of the scanning signals Y1 to Y320 and the other signals in the first to fourth frames, FIG. 8 shows waveforms of the scanning signals Y1 to Y320 and the other signals in the fifth to eighth frames, and FIG. 9 shows waveforms of the scanning signals Y1 to Y320 and the other signals in the ninth to 12th frames.

As shown in FIG. 7, in the partial mode, the waveforms of the scanning signals Y1 to Y320 in the first frame are the same as those in the full screen mode. Note that, in this embodiment, since the polarity specifying signal Pol is fixed in a low level in the first frame, voltages having negative polarities corresponding to black (off-states) are written to the non-display rows, that is, the first to 80th rows and the 161st to 320th rows, and voltages having negative polarities corresponding to levels of gradation for corresponding pixels are written in the display rows, that is, the 81st to 160th rows.

In the partial mode, the scanning signals Y1 to Y320 are not brought to high levels in the second and third frames, and accordingly, writing operations are not performed.

In the fourth frame in the partial mode, the scanning signals Y81 to Y160 are successively brought to high levels. Note that, in the fourth frame, while the scanning signals are successively brought to high levels, a level of the polarity specifying signal Pol is high. Accordingly, voltages having positive polarities corresponding to levels of gradation for corresponding pixels are written in the display rows, that is, the 81st to 160th rows.

Then, as shown in FIG. 8, in the fifth and sixth frames in the partial mode, as with the second and third frames, the scanning signals Y1 to Y320 are not brought to high levels, and accordingly, writing operations are not performed.

In the seventh frame, the waveforms of the scanning signals Y1 to Y320 are the same as those in the full screen mode. Note that, in this embodiment, since the polarity specifying signal Pol is fixed in a high level in the seventh frame, voltages having positive polarities corresponding to black (off-states) are written in the non-display rows, that is, the first to 80th rows and the 161st to 320th rows, and voltages having positive polarities corresponding to levels of gradation for corresponding pixels are written to the display rows, that is, the 81st to 160th rows.

In the eighth frame shown in FIG. 8 and the ninth frame shown in FIG. 9, the scanning signals Y1 to Y320 are not brought to high levels, and accordingly, writing operations are not performed. In the tenth frame in the partial mode, the scanning signals Y81 to Y160, that is, the display rows are successively brought to high levels. Since the polarity specifying signal Pol is fixed in a low level while the scanning signals are successively brought to high levels in the tenth frame, voltages having negative polarities corresponding to levels of gradation for corresponding pixels are written in the 81st to 160th rows, that is, the display rows. In the 11th and 12th frames, the scanning signals Y1 to Y320 are not brought to high levels, and accordingly, writing operations are not performed.

In the full screen mode, voltage writing operations are performed for individual frames. However, in the partial mode, off-voltage writing operations are performed every six frames on the pixels corresponding to the non-display rows, whereas voltage wiring operations are performed every three frames on the pixels corresponding to the display rows. Accordingly, power consumption necessary for the voltage writing operations is reduced.

In the full screen mode, in the common electrode driving circuit 170, for example, the TFTs 173 and TFTs 174 corresponding to the i-th row hold, in the parasitic capacitors thereof, on-voltages or off-voltages which were applied to the gate electrodes of the TFTs 173 and the gate electrodes of the TFTs 174 when the level of the scanning signal Yi is high so that the potential of the i-th common electrode 108 is fixed even when the scanning signal Yi becomes a low level.

However, in the partial mode, the number of times the voltage writing operations are performed when the scanning signals are brought to high levels is reduced when compared with the full screen mode. Accordingly, the on-voltages held in the gate electrodes of the TFTs 173 or the gate electrodes of the TFTs 174 are gradually reduced to equal to or smaller than a threshold value due to leakage, for example. Consequently, on-states may not be maintained.

To avoid this problem, a configuration in which capacitance elements are added to the gate electrodes of the TFTs 173 and the gate electrodes of the TFTs 174 so that the voltages are prevented from leaking may be proposed. However, in this configuration, regions for the capacitance elements should be additionally provided, and therefore, a region surrounding the display region 100, that is, a frame region, becomes larger.

Accordingly, in the partial mode in this embodiment, the control circuit 20 supplies the control signal Vg-c as described hereinafter. As shown in FIG. 6 and FIGS. 7 to 9, in the partial mode, a level of the control signal Vg-c is high in the second, third, eighth, and ninth frames and is low in the other frames.

Since the voltage writing operations are not performed in the second, third, eighth, and ninth frames as described above, the polarity specifying signal Pol is not required to be used to specify a writing polarity. However, in this embodiment, the polarity specifying signal Pol is used to specify the signal Vg-a and the signal Vg-b. That is, in the partial mode, the level of the polarity specifying signal Pol is low in the second and third frames as shown in FIG. 7 and is high in the eighth and ninth frames as shown in FIGS. 8 and 9. As described above, the waveform of the signal Vg-a is the same as that of the polarity specifying signal Pol, and the waveform of the signal Vg-b is obtained by logically inverting the waveform of the polarity specifying signal Pol.

In the first frame, since the level of the polarity specifying signal Pol is low, the level of the signal Vg-a is low, and the level of the signal Vg-b is inversely high. Therefore, in the common electrode driving circuit 170, in an odd-numbered i-th row, when the scanning signal Yi is brought to a high level and therefore the TFTs 171 and the TFTs 172 are turned on, off-voltages are applied to the gate electrodes of the TFTs 173 and on-voltages are applied to the gate electrodes of the TFTs 174. By this, the TFTs 173 are turned off and the TFTs 174 are turned on, and accordingly, the voltages Vsh of a high-level side are applied to the i-th common electrode 108 in accordance with negative-polarity writing operations. Similarly, in an even-numbered (i+1)th row, since off-voltages and on-voltages are applied to the gate electrodes of the TFTs 173 and the gate electrodes of the TFTs 174, respectively, the voltages Vsh are applied to the (i+1)th common electrode 108.

In the second and third frames in the partial mode, when the control signal Vg-c is brought to a high level, all the TFTs 175 and the TFTs 176 corresponding to the first to 320th rows are turned on in the common electrode driving circuit 170. In the second and third frames, the level of the signal Vg-a is low which is the same as that of the polarity specifying signal Pol whereas the level of the signal Vg-b is high which is opposite to that of the polarity specifying signal Pol.

Accordingly, in the second and third frames, since the off-voltages and the on-voltages are applied to the gate electrodes of the TFTs 173 and the gate electrodes of the TFTs 174, respectively, all the TFTs 173 are turned off and all the TFTs 174 are turned on. Consequently, as with the first frame, the voltage Vsh is applied to the common electrode 108.

In the fourth frame, while the scanning signals Y80 to Y161 are successively brought to high levels, the level of the polarity specifying signal Pol is high. Accordingly, the level of the signal Vg-a is high and the level of the signal Vg-b is inversely low.

In the common electrode driving circuit 170, when the scanning signals supplied to the display rows are brought to high levels and therefore the TFTs 171 and the TFTs 172 are turned on, on-voltages and off-voltages are applied to the gate electrodes of the TFTs 173 and the gate electrodes of the TFTs 174, respectively. Therefore, the TFTs 173 are turned on and the TFTs 174 are turned off. Accordingly, the voltages Vsl of the low-level side is applied to the common electrodes 108 corresponding to the display rows in accordance with the positive-polarity writing operations.

In the seventh to tenth frames, voltage writing operations having writing polarities opposite to those of the voltage writing operations performed in the first to fourth frames are performed.

As described above, according to this embodiment, in the partial mode, in addition to the first and seventh frames in which the voltage writing operations are performed on all the rows, the potentials of the common electrodes 108 are fixed in the second, third, eighth, and ninth frames. Accordingly, deterioration of display quality may be suppressed.

Note that, in this embodiment, the level of the control signal Vg-c is set to a high level so that the fixed potential of the common electrode 108 is obtained in each of the second, third, eighth, and ninth frames. However, the control signal Vg-c should keep a high level at least all or part of a frame selected from among frames positioned after the first (seventh) frame in which the voltage writing operations are performed on all the rows and before the fourth (tenth) frame in which the voltage writing operations are performed only on the display rows. Accordingly, for example, the control signal Vg-c may be brought to a high level only in the third and ninth frames.

Second Embodiment

In the first embodiment described above, in the full screen mode, polarities of the writing operations performed on the pixels are alternately inverted for each row, and in the partial mode, the display rows adjacent to one another have identical writing polarities. Therefore, there arises a problem in that quality of an image displayed using the pixels arranged in the display rows are deteriorated when compared with a case of the full screen mode.

A second embodiment in which writing polarities are alternately inverted for each scanning line in the display rows even in the partial mode will be described.

Figure 10:
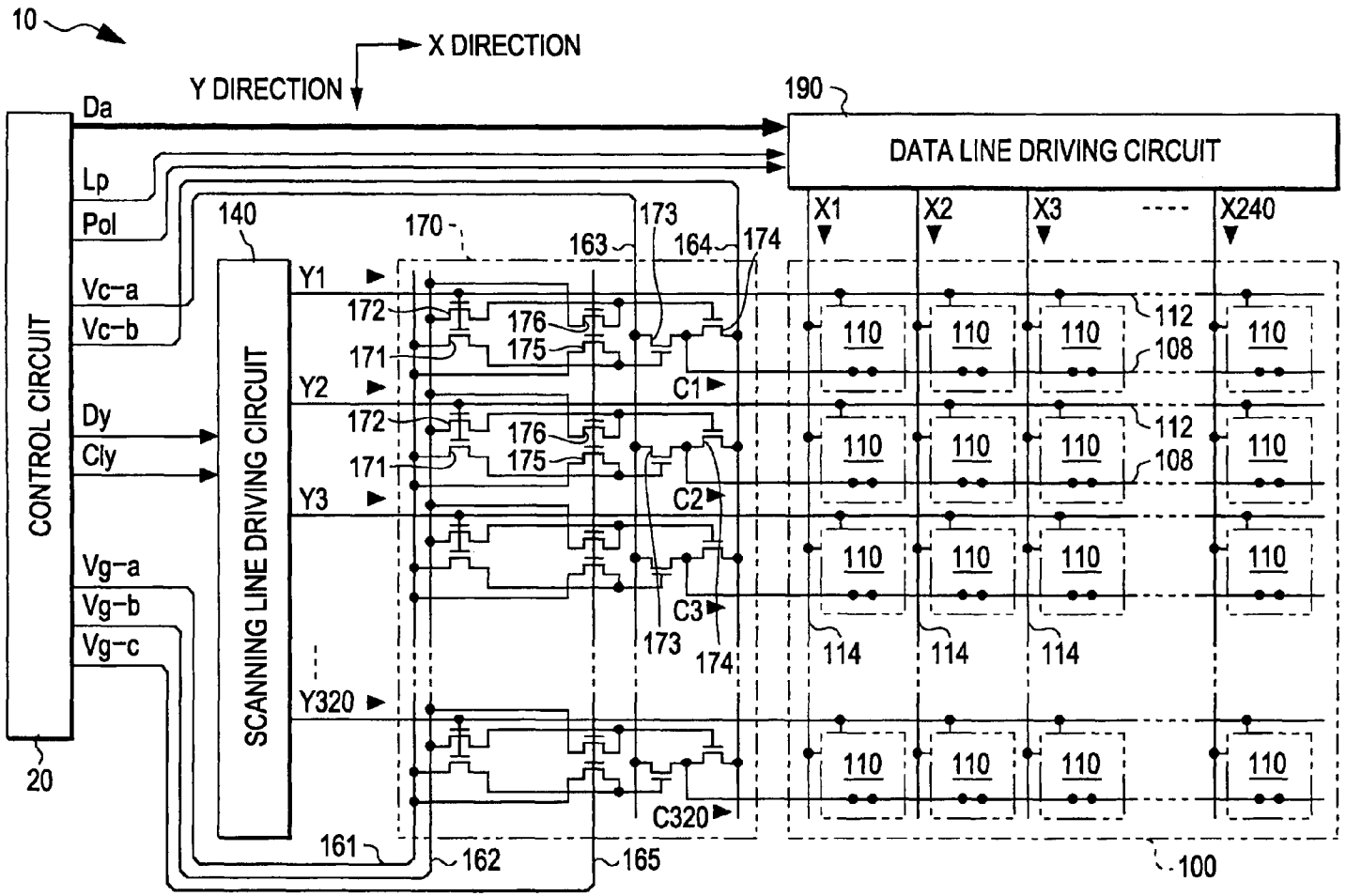
FIG. 10 is a diagram illustrating a configuration of an electro-optical device according to a second embodiment of the invention.

FIG. 10 is a block diagram illustrating a configuration of an electro-optical device according to the second embodiment.

The configuration shown in FIG. 10 is different from the configuration shown in FIG. 1 in that, in odd-numbered rows of a common electrode driving circuit 170, source electrodes of TFTs 175 are connected to a second power supply line 162 and source electrodes of TFTs 176 are connected to a first power supply line 161. Note that as with the first embodiment, in even-numbered rows, source electrodes of TFTs 175 are connected to the first power supply line 161 and source electrodes of TFTs 176 are connected to the second power supply line 162.

Figure 11:
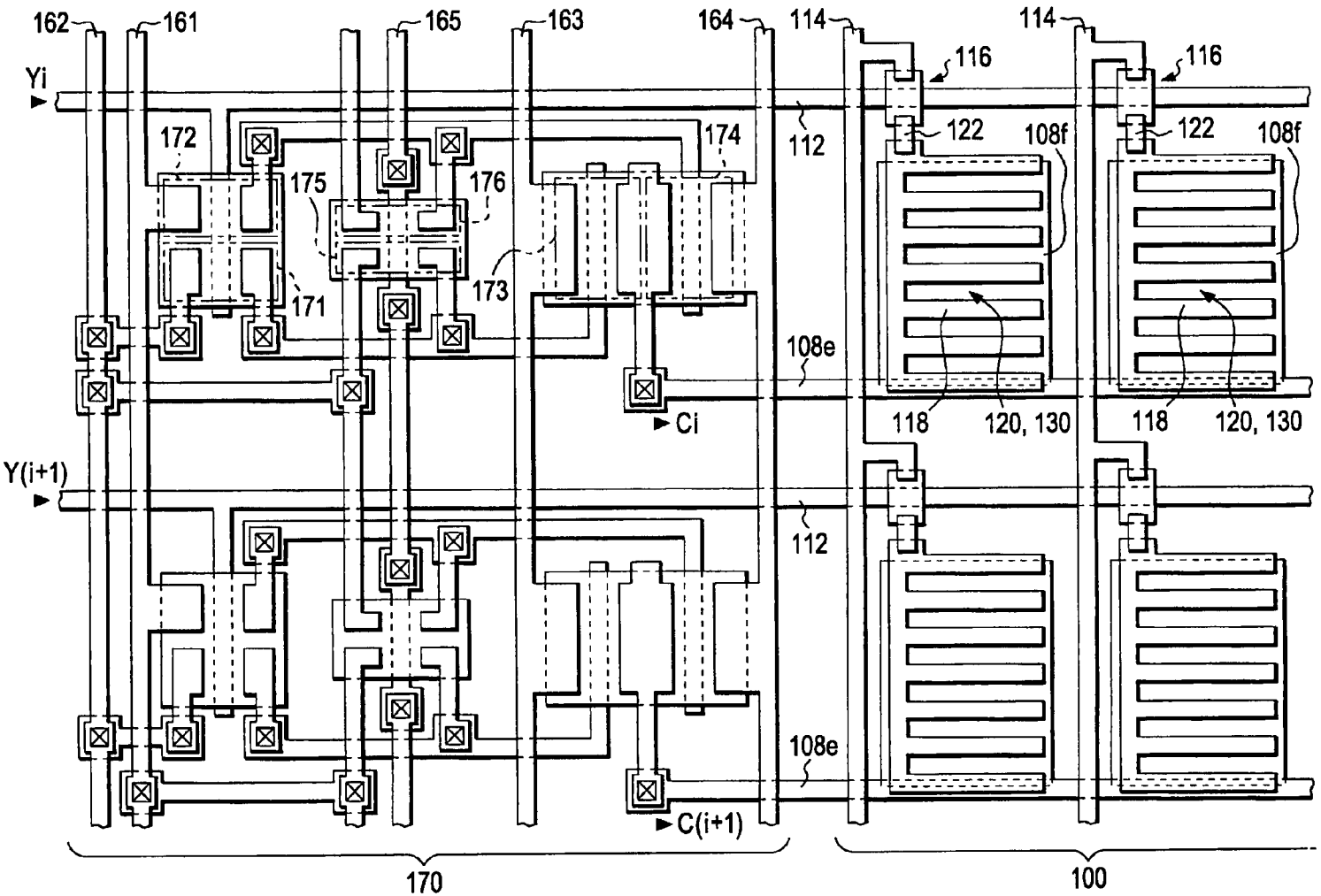
FIG. 11 is a plan view illustrating a configuration of an essential portion of an element substrate of the electro-optical device.

FIG. 11 is a plan view illustrating a portion in the vicinity of a boundary between a display region 100 and a common electrode driving circuit 170 in an element substrate of the second embodiment.

As shown in FIGS. 10 and 11, each of the source drains of the TFTs 175 and a corresponding one of the source drains of the TFTs 176 which are adjacent to the source drains of the TFTs 175 are connected to the first power supply line 161 or the second power supply line 162 through a corresponding one of common electrodes 108. For example, a source electrode of a TFT 175 corresponding to an odd-numbered i-th row and a source electrode of a TFT 176 corresponding to an even-numbered (i+1)th row are connected to the second power supply line 162 through a corresponding one of the common electrodes 108, whereas a source electrode of the TFT 176 corresponding to the odd-numbered i-th row and a source electrode of a TFT 175 corresponding to an (i−1)th row adjacent to the i-th row are connected to the first power supply line 161 through a corresponding one of the common electrodes 108.

Accordingly, in this way, a configuration of the common electrode driving circuit 170 is simplified and narrow intervals between the rows are attained.

Note that operation in a full screen mode of the second embodiment is the same as the operation in the full screen mode of the first embodiment. Therefore, points of operation in a partial mode of the second embodiment which are different from the operation in the partial mode of the first embodiment are mainly described. FIG. 12 is a diagram illustrating the operation in individual frames in the partial mode.

As with the first embodiment (refer to FIG. 6), in the partial mode of the second embodiment, 12 frames, that is, the first to twelfth frames, are used as a unit for the operation. The first to 80th rows and the 161st to 320th rows are non-display rows and the 81st to 160th rows are display rows, for example.

As shown in FIG. 12, in the partial mode, writing polarities in the first frame of both of the display rows and the non-display rows are obtained by inverting writing polarities employed in an operation of a full screen mode performed immediately before the operation in the partial mode is performed. Furthermore, writing polarities in the seventh frame are obtained by inverting the writing polarities of the first frame. The row inversion method is employed in the first and seventh frames. Writing polarities in the fourth frame of the display rows are obtained by inverting the writing polarities of the first frame, and writing polarities in the tenth frame of the display rows are obtained by inverting the writing polarities of the seventh frame. The row inversion method is employed in the fourth and tenth frames.

Figure 13:
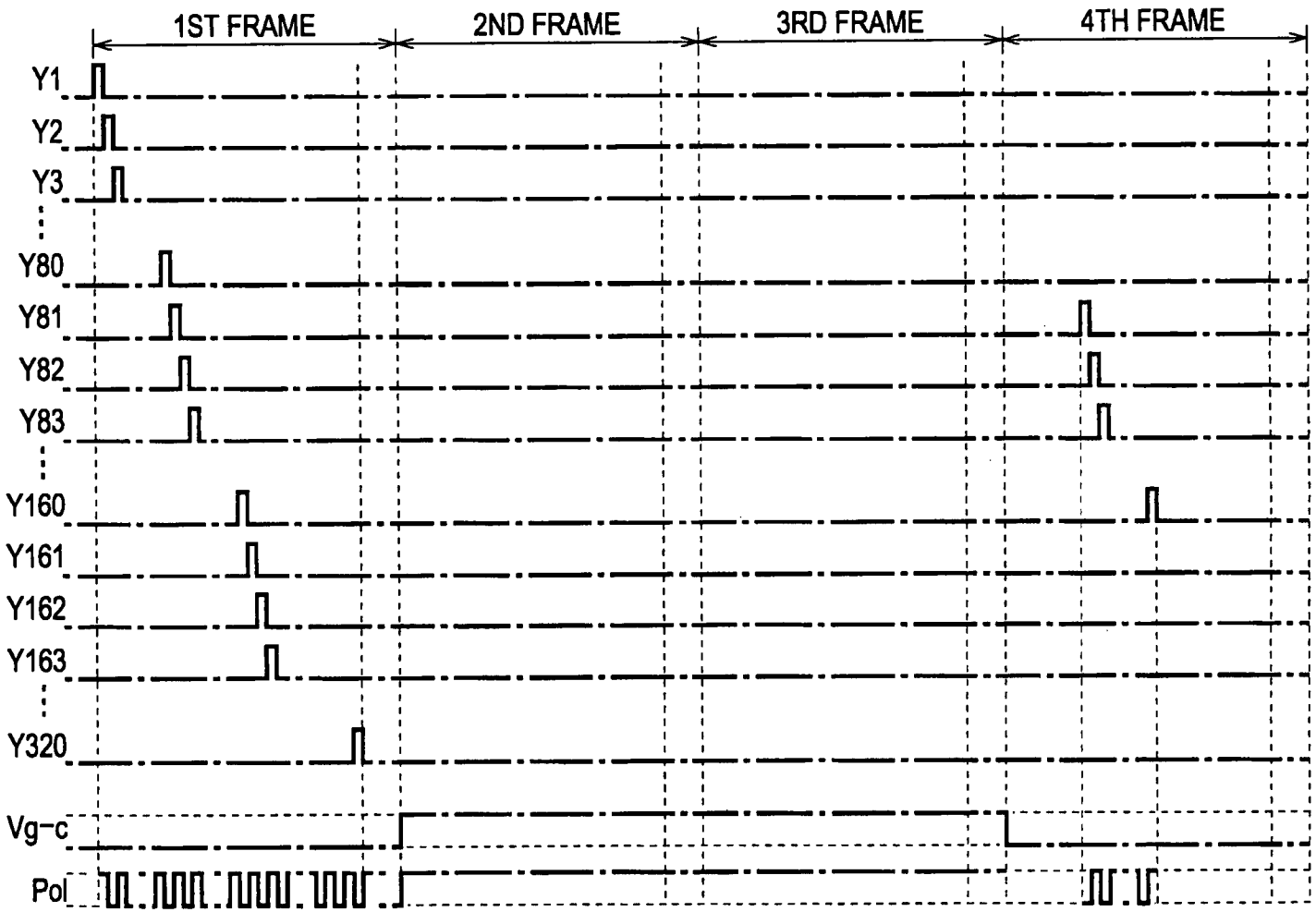
FIG. 13 is a diagram illustrating an operation of the electro-optical device in a partial mode.
Figure 14:
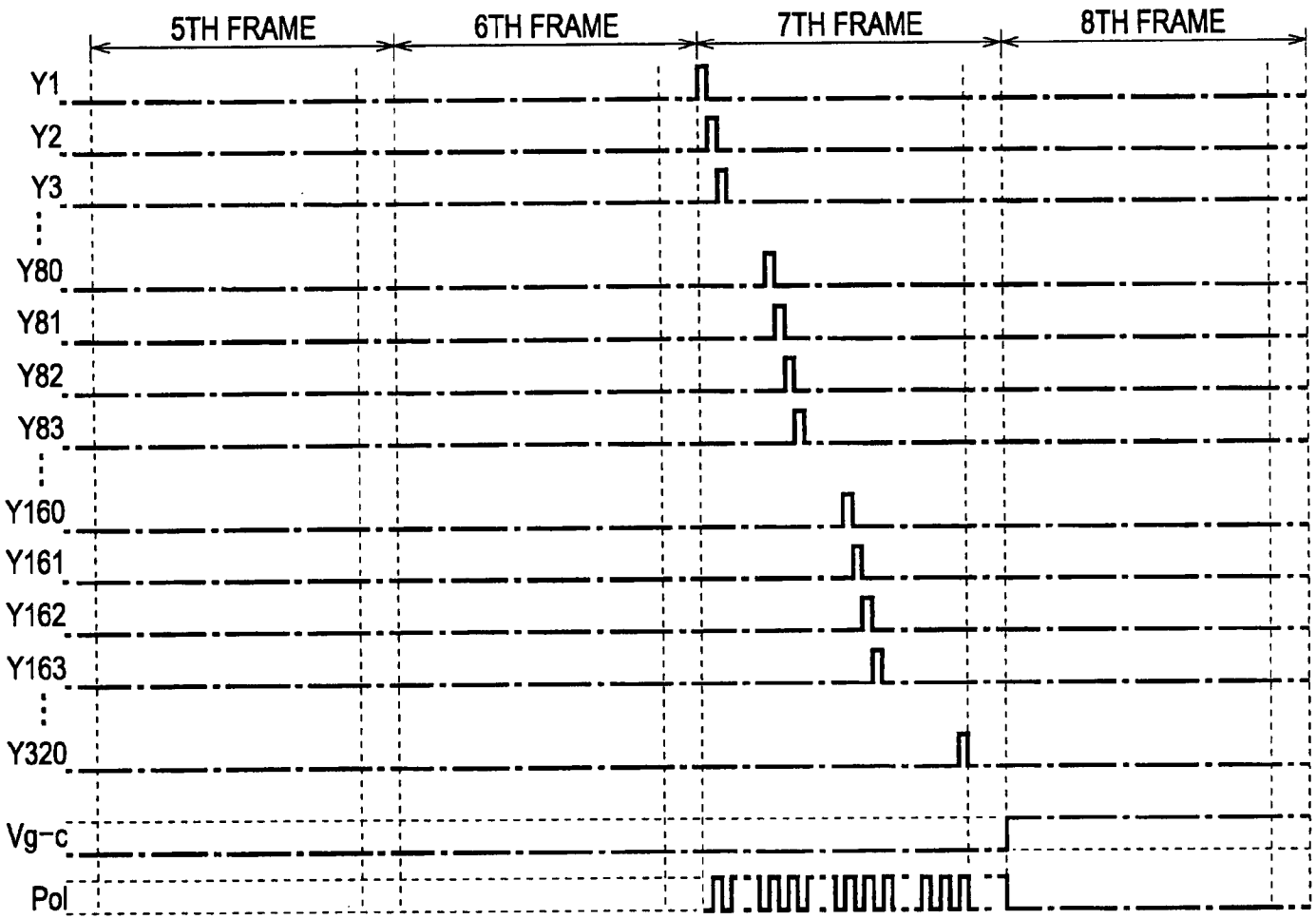
FIG. 14 is a diagram illustrating an operation of the electro-optical device in a partial mode.
Figure 15:
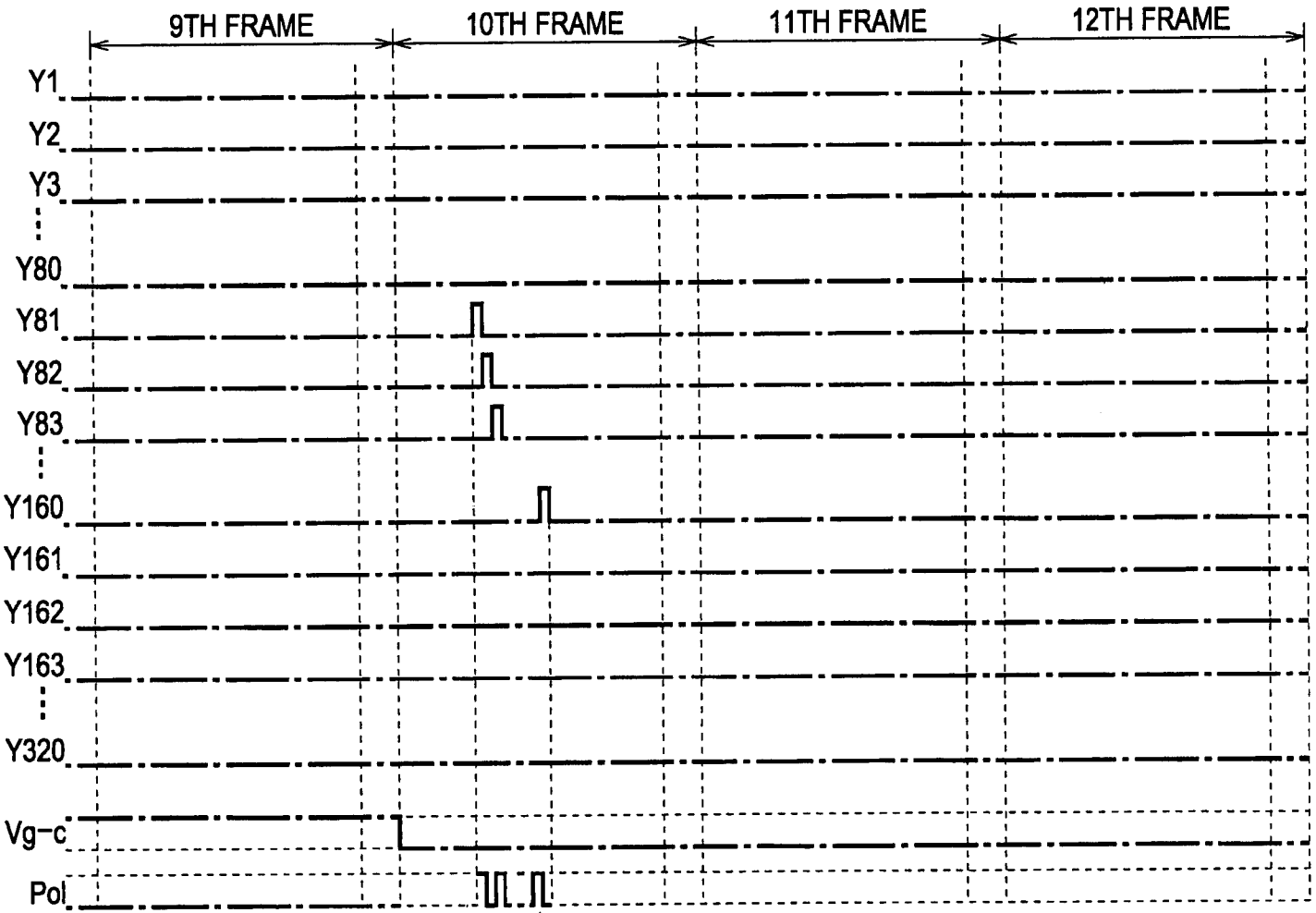
FIG. 15 is a diagram illustrating an operation of the electro-optical device in a partial mode.

Referring to FIGS. 13 to 15, waveforms of scanning signals and other signals in the partial mode described in FIG. 12 will be described. FIG. 13 shows waveforms of scanning signals Y1 to Y320 and the other signals in the first to fourth frames, FIG. 14 shows waveforms of the scanning signals Y1 to Y320 and the other signals in the fifth to eighth frames, and FIG. 15 shows waveforms of the scanning signals Y1 to Y320 and the other signals in the ninth to 12th frames.

As shown in FIGS. 13 to 15, the scanning signals Y1 to Y320 in the partial mode are the same as those in the partial mode of the first embodiment.

However, in this embodiment, in the first frame, a level of a polarity specifying signal Pol is high when levels of scanning signals corresponding to the odd-numbered rows are high and is low when levels of scanning signals corresponding to the even-numbered rows are high. Furthermore, a waveform of the polarity specifying signal Pol in the seventh frame is obtained by logically inverting a waveform of the polarity specifying signal Pol in the first frame.

Furthermore, in the fourth frame, in a period in which the scanning signals Y81 to Y160 corresponding to the display rows are successively brought to high levels, the level of the polarity specifying signal Pol is low when levels of scanning signals of odd-numbered rows among rows corresponding to the scanning signals Y81 to Y160 are high, and the level of the polarity specifying signal Pol is high when levels of scanning signals of even-numbered rows among the rows corresponding to the scanning signals Y81 to Y160 are high. The waveform of the polarity specifying signal Pol in the tenth frame is obtained by logically inverting the waveform of the polarity specifying signal Pol in the fourth frame. In the tenth frame, in a period in which the scanning signals Y81 to Y160 corresponding to the display rows are successively brought to high levels, the level of the polarity specifying signal Pol is high when the levels of the scanning signals of the odd-numbered rows among the rows corresponding to the scanning signals Y81 to Y160 are high, and the level of the polarity specifying signal Pol is low when the levels of the scanning signals of the even-numbered rows among the rows corresponding to the scanning signals Y81 to Y160 are high.

Note that in this embodiment, since voltage writing operations are not performed in the second, third, eighth, and ninth frames as described above, the polarity specifying signal Pol is not required to be used to specify a writing polarity. However, as with the case of the first embodiment, the polarity specifying signal Pol is used to specify the signal Vg-a and the signal Vg-b in this embodiment. That is, the level of the polarity specifying signal Pol is high in the second and third frames as shown in FIG. 13 and is low in the eighth and ninth frames as shown in FIGS. 14 and 15.

In the second embodiment, an operation in the first frame in the partial mode is the same as an operation in the full screen mode except that voltages corresponding to black (off-states) are forcedly written to the non-display rows in the partial mode. Accordingly, common electrodes 108 corresponding to the odd-numbered i-th rows have voltages Vsl of a low-level side in accordance with positive-polarity writing operations, and common electrodes 108 corresponding to the even-numbered (i+1)th rows have voltages Vsh of a high-level side in accordance with negative-polarity writing operations.

In the second and third frame of the partial mode, a level of a signal Vg-a is high which is the same as the level of the polarity specifying signal Pol, whereas a level of the signal Vg-b is low which is opposite to the level of the polarity specifying signal Pol. When the control signal Vg-c is brought to a high level, since TFTs 175 and TFTs 176 in the first to 320th rows in the common electrode driving circuit 170 are turned on, off-voltages and on-voltages are applied to gate electrodes of TFTs 173 and gate electrodes of TFTs 174 in the odd-numbered rows, respectively, and on the other hand, on-voltages and off-voltages are applied to gate electrodes of TFTs 173 and gate electrodes of TFTs 174 in the even-numbered rows, respectively. Accordingly, since the TFTs 174 in the odd-numbered rows are turned on, the voltages Vsl of a low-level side are applied to the common electrodes 108 in the odd-numbered rows in accordance with positive-polarity writing operations. Furthermore, since the TFTs 173 in the even-numbered rows are turned on, the voltages Vsh of a high-level side are applied to the common electrodes 108 in the even-numbered rows in accordance with negative-polarity writing operations. Accordingly, the common electrodes 108 in the odd-numbered rows and the common electrodes 108 in the even-numbered rows maintain voltages applied in the first frame.

In the fourth frame, in a period in which the scanning signals Y80 to Y161 are successively brought to high levels, the level of the polarity specifying signal Pol is low when the levels of scanning signals of the odd-numbered rows among rows corresponding to the scanning signals Y81 to Y160 are high, the level of the signal Vg-a is low and the level of the signal Vg-b is high. In the common electrode driving circuit 170, when the scanning signals corresponding to the odd-numbered rows among the display rows are brought to high levels and therefore TFTs 171 and TFTs 172 corresponding to the odd-numbered rows are turned on, on-voltages and off-voltages are applied to the gate electrodes of the TFTs 173 and the gate electrodes of the TFTs 174, respectively. On the other hand, when the scanning signals corresponding to the even-numbered rows among the display rows are brought to high levels and therefore TFTs 171 and TFTs 172 corresponding to the even-numbered rows are turned on, off-voltages and on-voltages are applied to the gate electrodes of the TFTs 173 and the gate electrodes of the TFTs 174, respectively.

Therefore, in the odd-numbered rows among the display rows, since the TFTs 173 are turned on, the voltages Vsh of a high-level side are applied to the common electrodes 108 corresponding to the odd-numbered rows in accordance with negative-polarity writing operations, whereas in the even-numbered rows among the display rows, since the TFTs 174 are turned on, the voltages Vsl of a low-level side are applied to the common electrodes 108 corresponding to the even-numbered rows.

Note that individual rows in the seventh to tenth frames are subjected to voltage writing operations employing writing polarities opposite to those employed in the individual rows in the first to fourth frames, respectively.

As described above, according to the second embodiment, in the partial mode, in addition to the first and seventh frames in which the voltage writing operations are performed on all the rows, the potentials of the common electrodes 108 are fixed in the second, third, eighth, and ninth frames. Accordingly, deterioration of display quality may be suppressed. Furthermore, according to the second embodiment, since, as with a case of the full screen mode, the writing polarities for the display rows in the partial mode are alternately inverted for each scanning line, that is, a row inversion method is employed in the partial mode, display quality the same as that in the full screen mode can be obtained in the partial mode.

Applications and Modifications

In the first and second embodiments described above, a row inversion method in which writing polarities for pixels are alternately inverted for each row is employed in the full screen mode. However, a column inversion method in which the writing polarities are alternately inverted for each column, or a dot inversion method in which the writing polarities are alternately inverted for each pixel, that is, for each column and each row may be employed.

Figure 16:
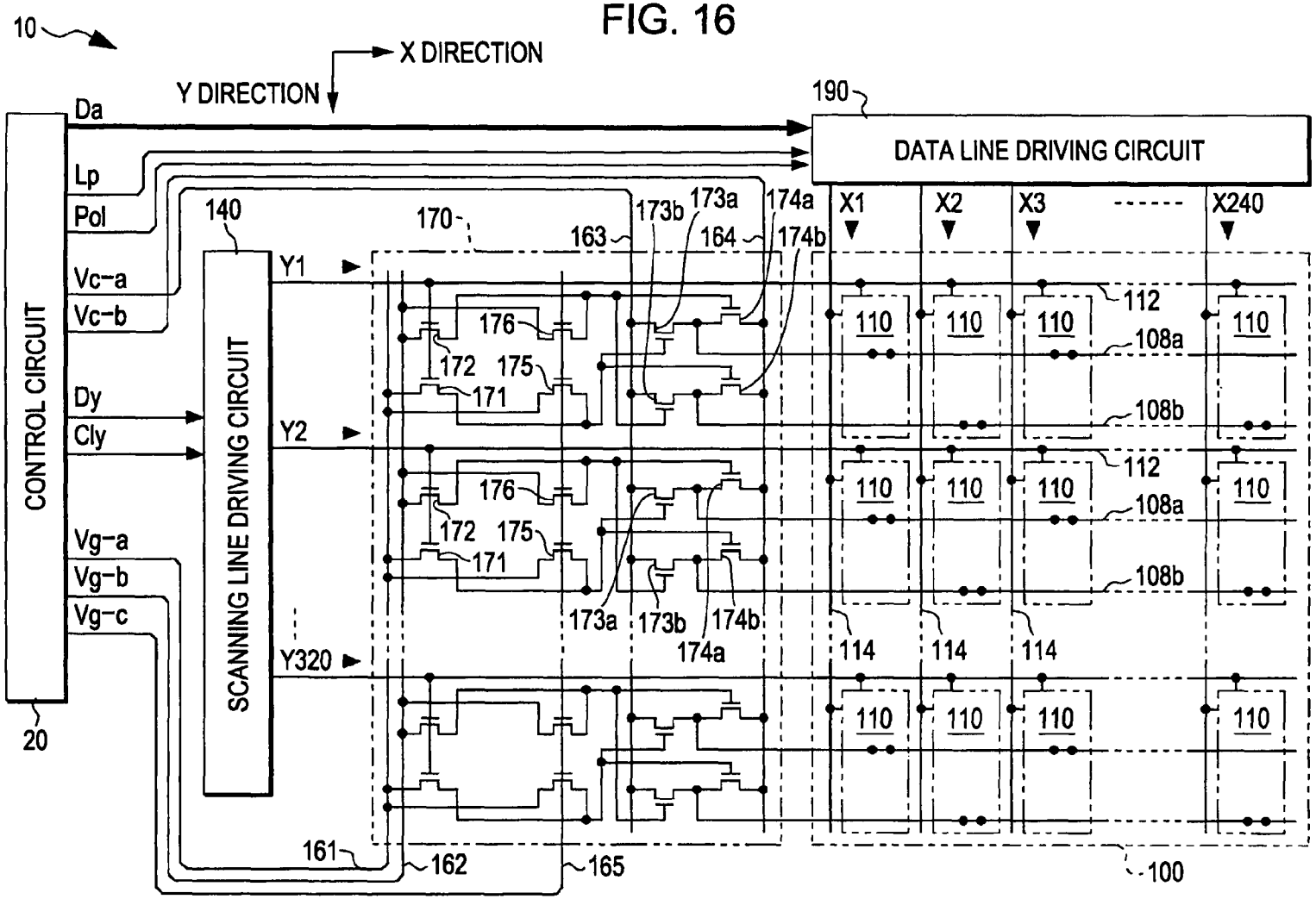
FIG. 16 is a diagram illustrating a configuration of an electro-optical device according to a modification.
Figure 17:
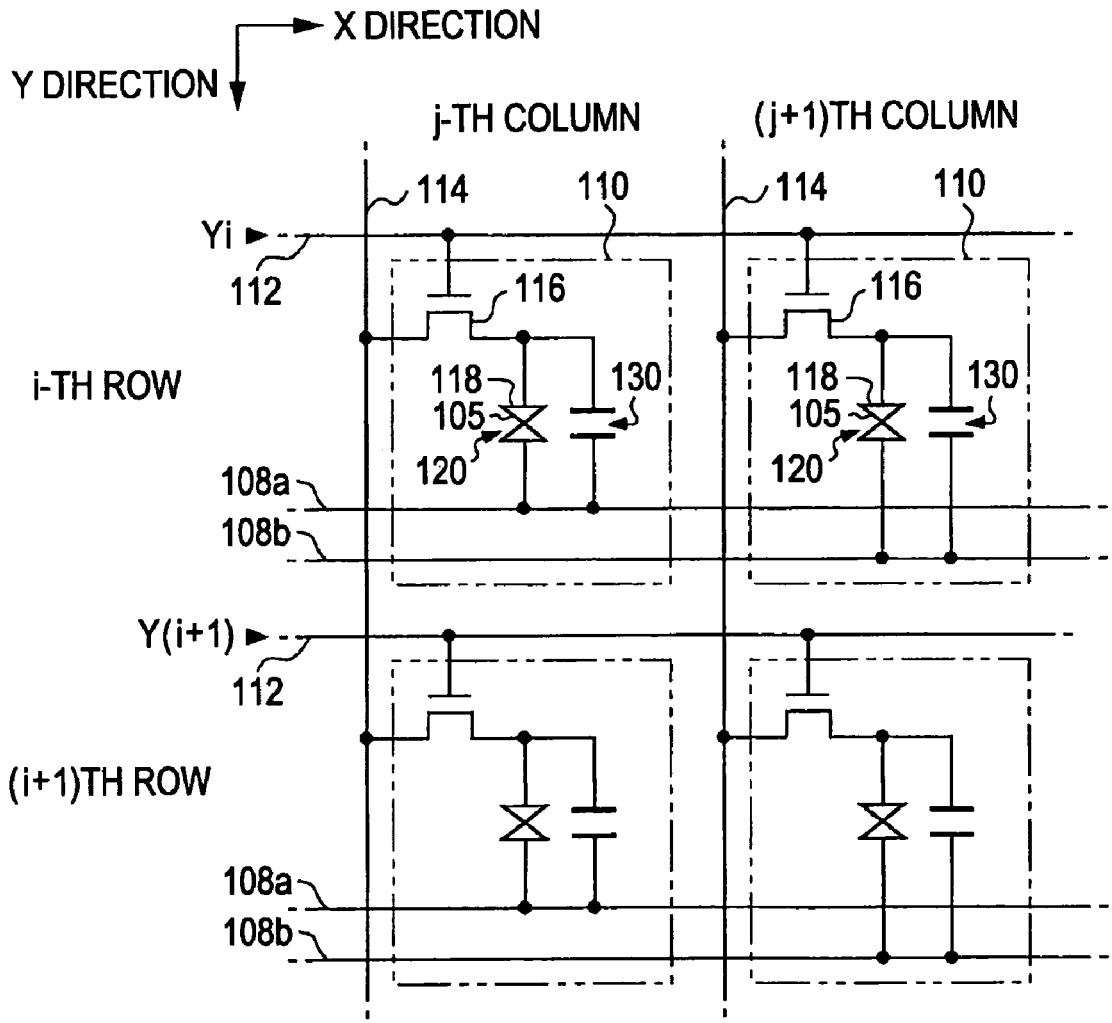
FIG. 17 is a diagram illustrating a configuration of pixels included in the electro-optical device according to the modification.

In a case where the column inversion method or the dot inversion method is employed, for example, pairs of common electrodes 108*a* and 108*b* are arranged in individual rows as shown in FIG. 16. In this case, the common electrodes 108*a* correspond to pixels 110 arranged in odd-numbered j-th columns, and the common electrodes 108*b* correspond to pixels 110 in even-numbered (j+1)th columns as shown in FIG. 17.

Furthermore, in the common electrode driving circuit 170, TFTs 173 corresponding to the individual rows are divided into two systems, that is, TFTs 173*a* and TFTs 173*b*, and TFTs 174 corresponding to the individual rows are divided into the two systems, that is, TFTs 174*a* and TFTs 174*b*. When one of the two systems is used so that common electrodes 108*a* are determined to have ones of voltages Vsl and voltages Vsh, the other system is used so that common electrodes 108*b* are determined to have the others of the voltages Vsl and voltages Vsh.

Here, when the column inversion method is employed, for example, positive-polarity writing operations are performed on odd-numbered columns whereas negative-polarity writing operations are performed on even-numbered columns. Accordingly, when scanning signals supplied to the individual rows are brought to high levels, the voltages Vsl of a low-level side are applied to the common electrodes 108*a* corresponding to the odd-numbered columns in accordance with the positive-polarity writing operations and the voltages Vsh of a high-level side are applied to the common electrodes 108*b* corresponding to the even-numbered columns in accordance with the negative-polarity writing operations.

Furthermore, the dot inversion method is attained using a combination of the column inversion method and the row inversion method. For example, positive-polarity writing operations are performed on odd-numbered rows of odd-numbered columns, and negative-polarity writing operations are performed on odd-numbered rows of even-numbered columns. Thereafter, negative-polarity writing operations are performed on even-numbered rows of odd-numbered columns, and positive-polarity writing operations are performed on even-numbered rows of even-numbered columns. Therefore, when scanning signals supplied to the odd-numbered rows are brought to high levels, the voltages Vsl of a low-level side are applied to the common electrodes 108*a* corresponding to the odd-numbered columns in accordance with the positive-polarity writing operations, and the voltages Vsh of a high-level side are applied to the common electrodes 108*b* corresponding to the even-numbered columns in accordance with the negative-polarity writing operations. Furthermore, when scanning signals subsequently supplied to the even-numbered rows are brought to high levels, the voltages Vsh of a high-level side are applied to the common electrodes 108*a* corresponding to the odd-numbered columns in accordance with the negative-polarity writing operations, and the voltages Vsl of a low-level side are applied to the common electrodes 108*b* corresponding to the even-numbered columns in accordance with the positive-polarity writing operations.

Note that in the column inversion method and the dot inversion method, when a selection voltage is applied to one of scanning lines, waveforms of data signals supplied to the odd-numbered columns and waveforms of data signals supplied to the even-numbered columns are opposite to each other. In addition, polarities of the data signals are alternately changed for each predetermined frame period so that direct currents are not applied to liquid crystal capacitors 120.

In the forgoing embodiments, the common signals Vc-a and Vc-b, and the signals Vg-a and Vg-b have the waveforms shown in FIG. 4. However, the waveforms of the common signals Vc-a and Vc-b may be inverted (replaced by each other) for each frame period or each horizontal scanning period (H), and logic levels of the signals Vg-a and Vg-b may be determined in accordance with the inversion.

Specifically, for example, when a scanning signal supplied to one of scanning lines is brought to a high level, a voltage corresponding to a writing polarity for a corresponding one of rows is applied to a corresponding one of common electrodes, and even when the scanning signal is brought to a low level, the same voltage of the corresponding one of the common electrodes is maintained.

In the forgoing embodiments, the TFTs 171 and the TFTs 172 of the i-th row are turned on when the i-th scanning line is selected and the scanning signal Yi is brought to a high level. Here, it is important that when the TFTs 171 and the TFTs 172 of the i-th row are turned on, the gate electrodes of the TFTs 173 and the gate electrodes of the TFTs 174 are connected to the first power supply line 161 and the second power supply line 162 so that ones of the TFTs 173 and the TFTs 174 are turned on and the others are turned off. Accordingly, as long as the common electrode 108 corresponding to the i-th row has a potential obtained in accordance with a writing polarity, a timing at which the TFTs 171 and the TFTs 172 are turned on is not so important.

In a vertical flyback period, since it is not necessary to specify a writing polarity, logic signals such as the polarity specifying signal Pol and the common signals Vc-a and Vc-b may be fixed in predetermined levels.

Furthermore, in the forgoing embodiments, the normally-black mode is employed for the liquid crystal capacitors 120. However, a normally-white mode in which white display is attained when voltages are not applied may be employed. Moreover, dots each of which includes three pixels corresponding to three colors R(red), G(green), and B(blue) may be used to perform color display. In addition, another color (cyan (C), for example) may be added to the three colors so that the single dot includes the four colors. By this, color reproducibility is improved.

Third Embodiment

Figure 18:
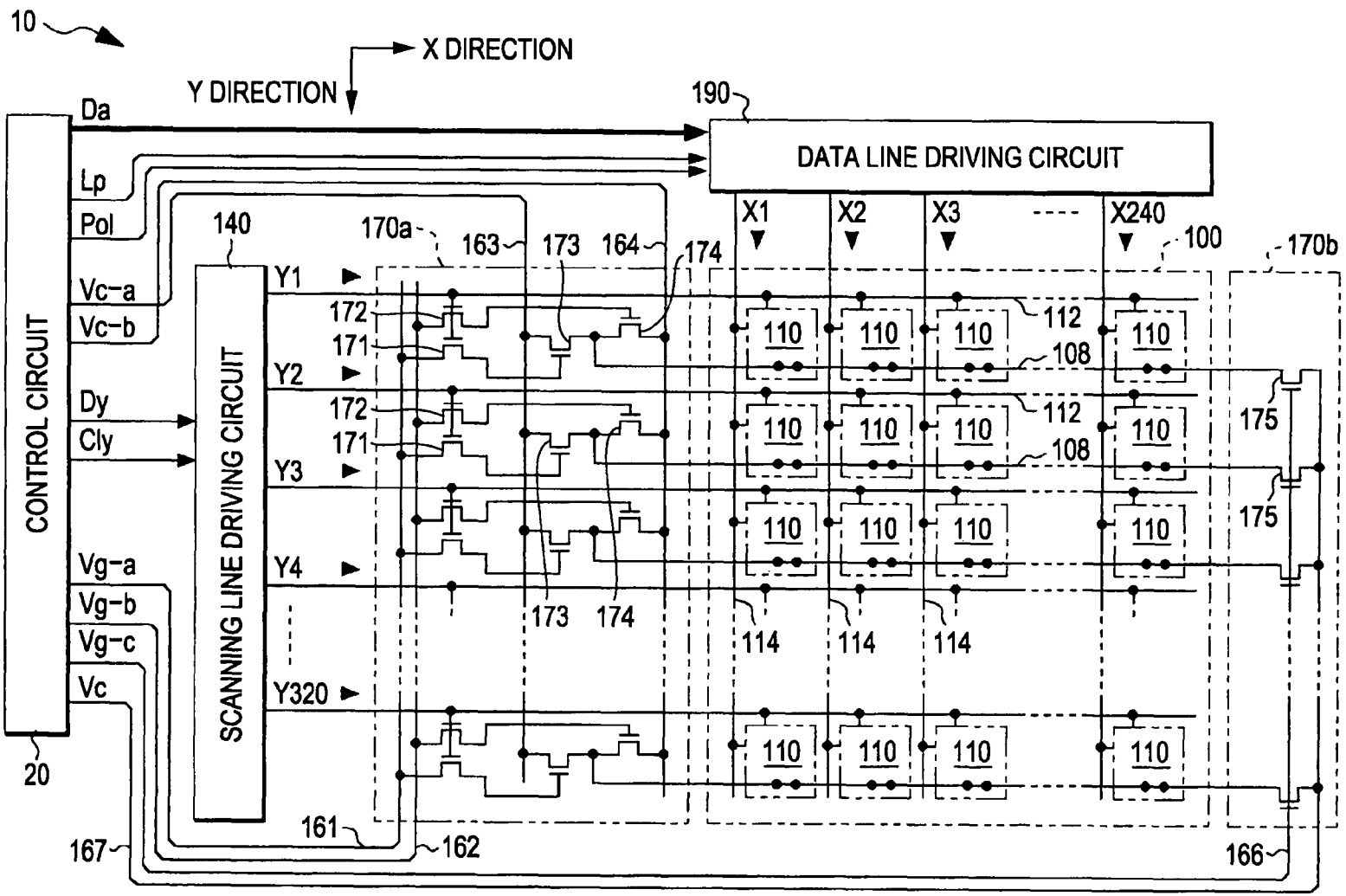
FIG. 18 is a diagram illustrating a configuration of an electro-optical device according to a third embodiment of the invention.

A third embodiment of the invention will now be described. FIG. 18 is a diagram illustrating a configuration of an electro-optical device according to the third embodiment of the invention.

As shown in FIG. 18, an electro-optical device 10 includes a display region 100, and further includes a scanning line driving circuit 140, common electrode driving circuits 170*a* and 170*b*, and a data line driving circuit 190 which are arranged near the display region 100. That is, the electro-optical device 10 is configured as a peripheral-circuit incorporating panel. The electro-optical device 10 further includes a control circuit 20 connected to the peripheral-circuit incorporating panel through an FPC (flexible printed circuit) board, for example.

The display region 100 includes pixels 110. In this embodiment, first to 320th scanning lines 112 are arranged so as to extend in a row direction (X direction), and first to 240th data lines 114 are arranged so as to extend in a column direction (Y direction). The first to 320th scanning lines 112 intersect with the first to 240th data lines 114 and the pixels 110 are arranged at intersections. Although, in the display region 100 of this embodiment, the pixels 110 are arranged in a matrix of 320 rows and 240 columns, the invention is not limited to this arrangement.

In this embodiment, common electrodes 108 extending in the X direction are provided for individual first to 320th scanning lines 112. That is, the common electrodes 108 correspond to the first to 320th scanning lines 112.

Figure 19:
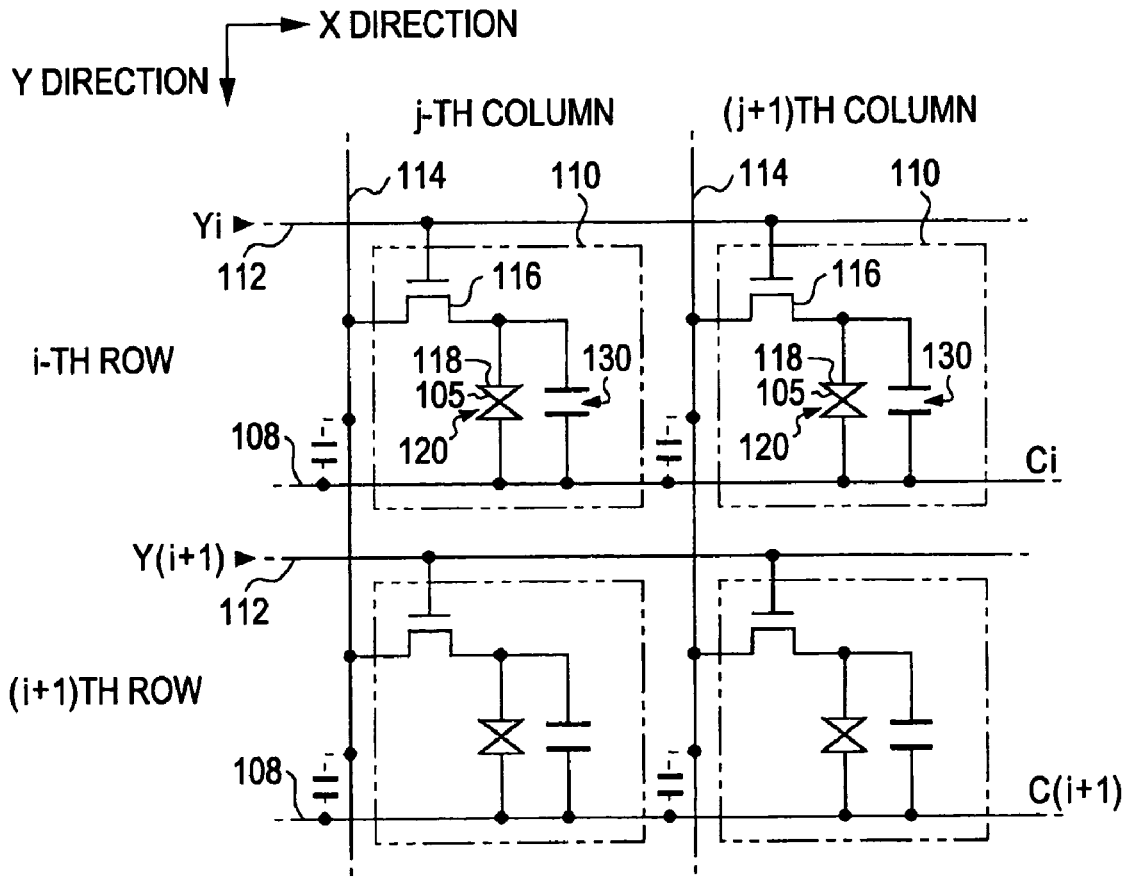
FIG. 19 is a diagram illustrating a configuration of pixels included in the electro-optical device.

A configuration of the pixels 110 will now be described in detail. FIG. 19 shows a configuration of the pixels 110, and shows extracted four pixels which are arranged in a matrix of two rows and two columns and which are arranged at intersections of an i-th row and a (i+1)th row of a j-th column and a (j+1)th column. The (i+1)th row is adjacent to the i-th row and arranged below the i-th row. The (j+1)th column is adjacent to the j-th column and arranged on the right side of the j-th column.

Note that "i" and "(i+1)" generally denote rows in which the pixels 110 are arranged, and "i" represents an odd number selected from 1, 3, 5, to 319, and "(i+1)" represents an even number, which follows "i", selected from 2, 4, 6, to 320. Similarly, the "j" and the "(j+1)" generally denote columns in which the pixels 110 are arranged, and "j" represents an odd number selected from 1, 3, 5, to 239, and "(j+1)" represents an even number, which follows "j", selected from 2, 4, 6, to 240.

As shown in FIG. 19, each of the pixels 110 includes an n-channel thin film transistor 116 (hereinafter simply referred to as a "TFT") serving as a pixel switching element, a liquid crystal capacitor (pixel capacitor) 120, and a storage capacitor 130. Since the pixels 110 according to this embodiment have identical configurations, a pixel 110 located in the i-th row of the j-th column is extracted and described as an example hereinafter. In the pixel 110 located in the i-th row of the j-th column, a gate electrode of the TFT 116 is connected to an i-th scanning line 112, a source electrode of the TFT 116 is connected to a j-th data line 114, and a drain electrode of the TFT 116 is connected to a first end of the liquid crystal capacitor 120 and a first end of the storage capacitor 130. A second end of the liquid crystal capacitor 120 and a second end of the storage capacitor 130 are connected to a corresponding one of the common electrodes 108.

Note that in FIG. 19, "Yi" and "Y(i+1)" denote scanning signals to be supplied to the i-th scanning line 112 and an (i+1)th scanning line 112, and "Ci" and "C(i+1)" denote voltages of an i-th common electrode 108 and an (i+1)th common electrode 108. Optical characteristics, for example, of the liquid crystal capacitor 120 will be described later.

Referring back to FIG. 18, the control circuit 20 outputs various control signals and controls units included in the electro-optical device 10. Note that the control signals will be described later as needed.

The electro-optical device 10 operates in two modes, that is, a full screen mode (first mode) and a partial mode (second mode). In the full screen mode, an image is displayed using all the pixels 110 arranged in a matrix of 320 rows and 240 columns. In the partial mode, an effective image is displayed using, among the pixels 110, a number of pixels 110 corresponding to a number of scanning lines 112 selected from among the scanning lines 112, and the other pixels are not used to display the image. Note that, hereinafter, the description is based on the full screen mode and the partial mode is described as an exceptional case.

As described above, the peripheral circuits such as the scanning line driving circuit 140, the common electrode driving circuit 170, and the data line driving circuit 190 are arranged near the display region 100.

Figure 22:
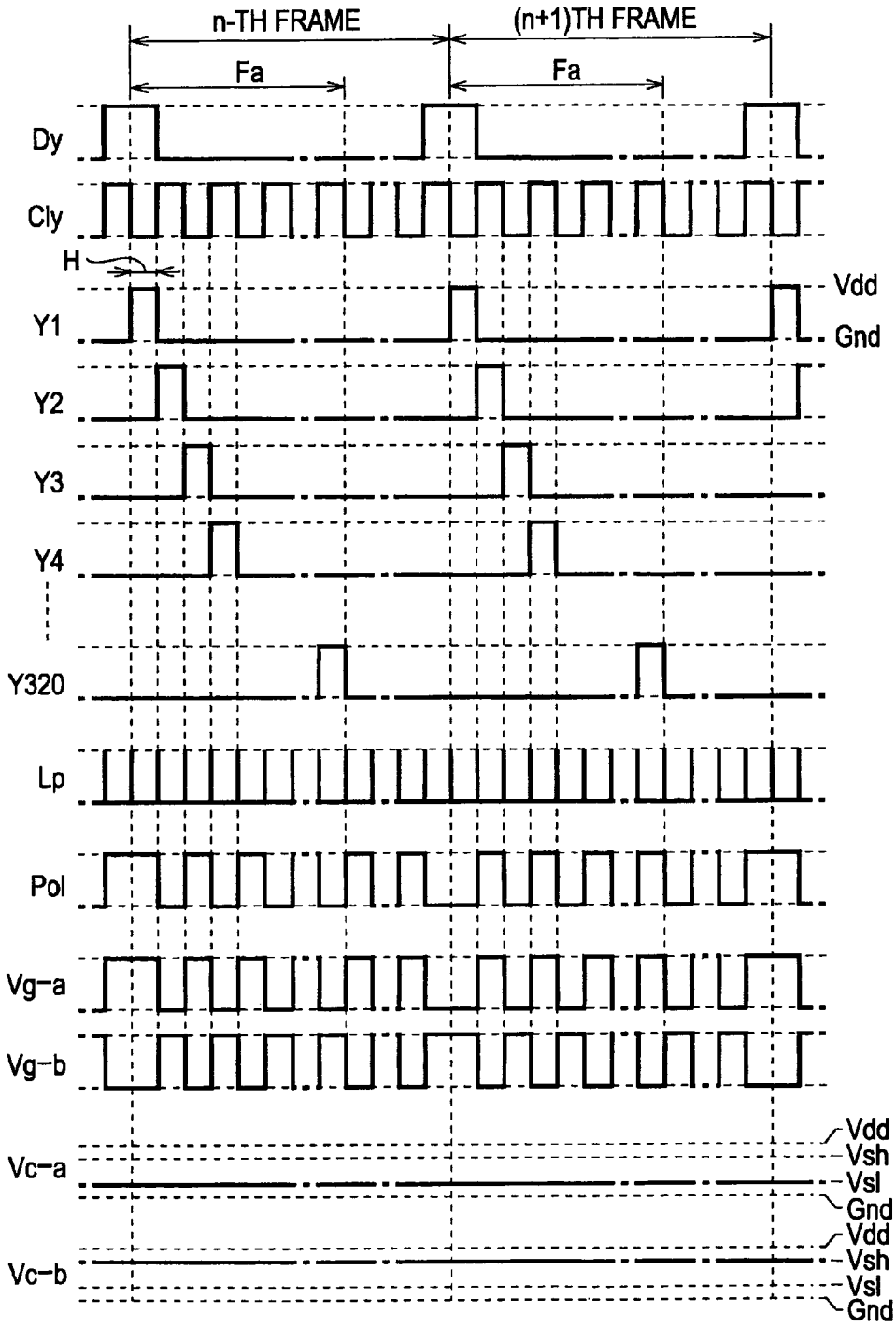
FIG. 22 is a diagram illustrating operations of a full screen mode of the electro-optical device.

Among these peripheral circuits, the scanning line driving circuit 140 supplies scanning signals Y1 to Y320 to the first to 320th scanning lines 112, respectively, in the full screen mode. Specifically, as shown in FIG. 22, the scanning line driving circuit 140 successively selects the first to 320th scanning lines 112 shown in FIG. 18 in ascending order in a period corresponding to one frame. A scanning signal to be supplied to a currently selected scanning line is represented by a selection voltage Vdd having a high level, and scanning signals other than the scanning signal to be supplied to the currently selected scanning line have non-selection voltages (ground potential Gnd) of low levels.

The scanning line driving circuit 140 receives a start pulse Dy from the control circuit 20, and successively shifts the start pulse Dy in accordance with a clock signal Cly so as to generate the scanning signals Y1 to Y320 of high levels in this order. In FIG. 22, a timing at which a level of one of the scanning signals supplied to a corresponding one of the scanning lines 112 is changed from a high level to a low level coincides with a timing at which a level of one of the scanning signals supplied to a subsequent corresponding one of the scanning lines 112 is changed from a low level to a high level. However, an interval may be interposed between the timings by controlling a period in which each of the scanning signals keeps a high level to be short, for example.

In this embodiment, one frame corresponds to a period in which an image is displayed in the full screen mode, that is, 16.7 milliseconds. As shown in FIG. 22, one frame includes an effective scanning period Fa from when a level of the scanning signal Y1 becomes a high level to when a level of the scanning signal Y320 becomes a low level, and also includes a flyback period. Note that the flyback period may be eliminated, and a period in which one of the scanning lines 112 is selected corresponds to a horizontal scanning period (H).

Note that, since, in one frame in the partial mode, an image may not be displayed as will be described later, one frame may correspond to 16.7 milliseconds for convenience sake.

Figure 25:
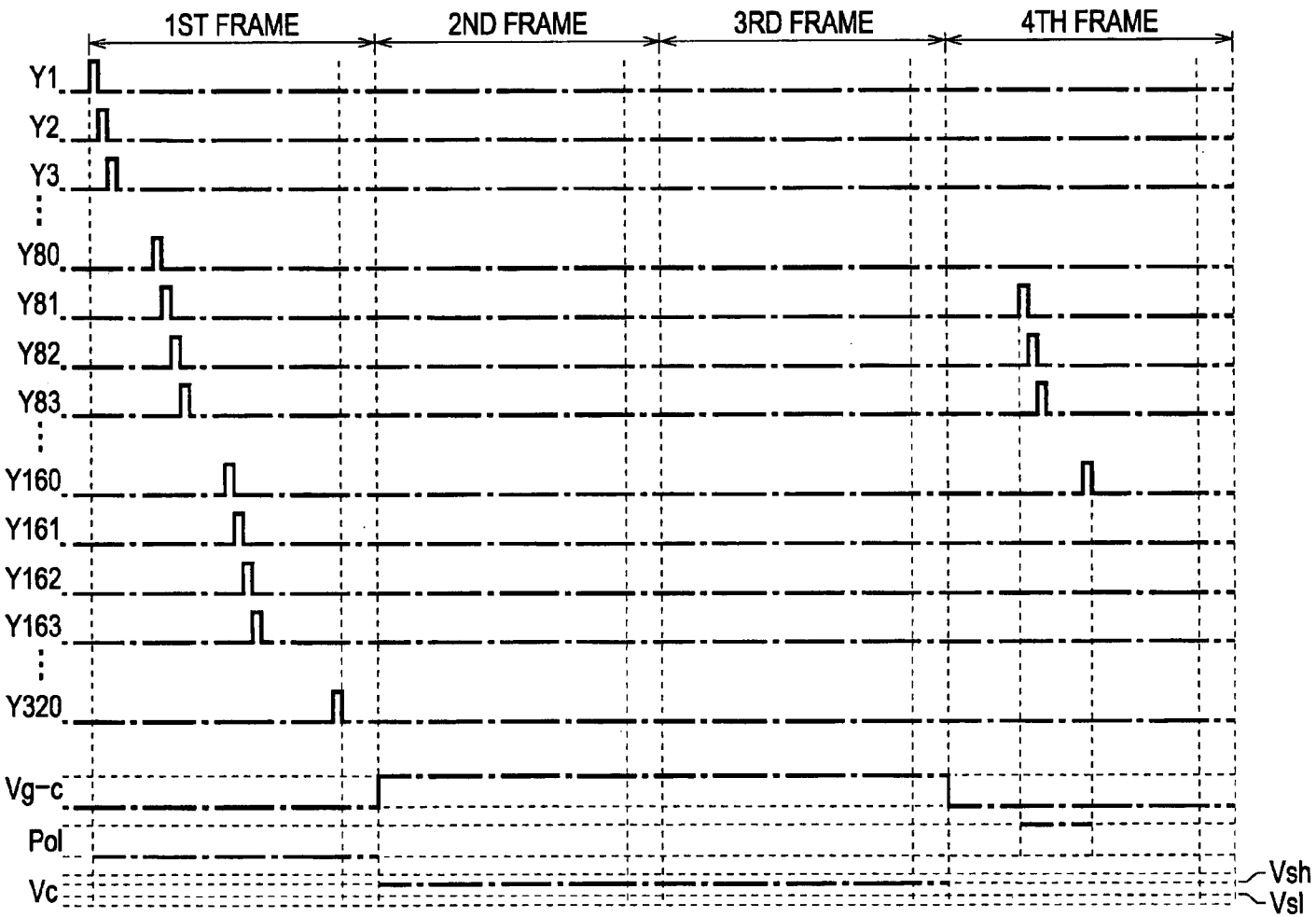
FIG. 25 is a diagram illustrating an operation of the electro-optical device in a partial mode.
Figure 26:
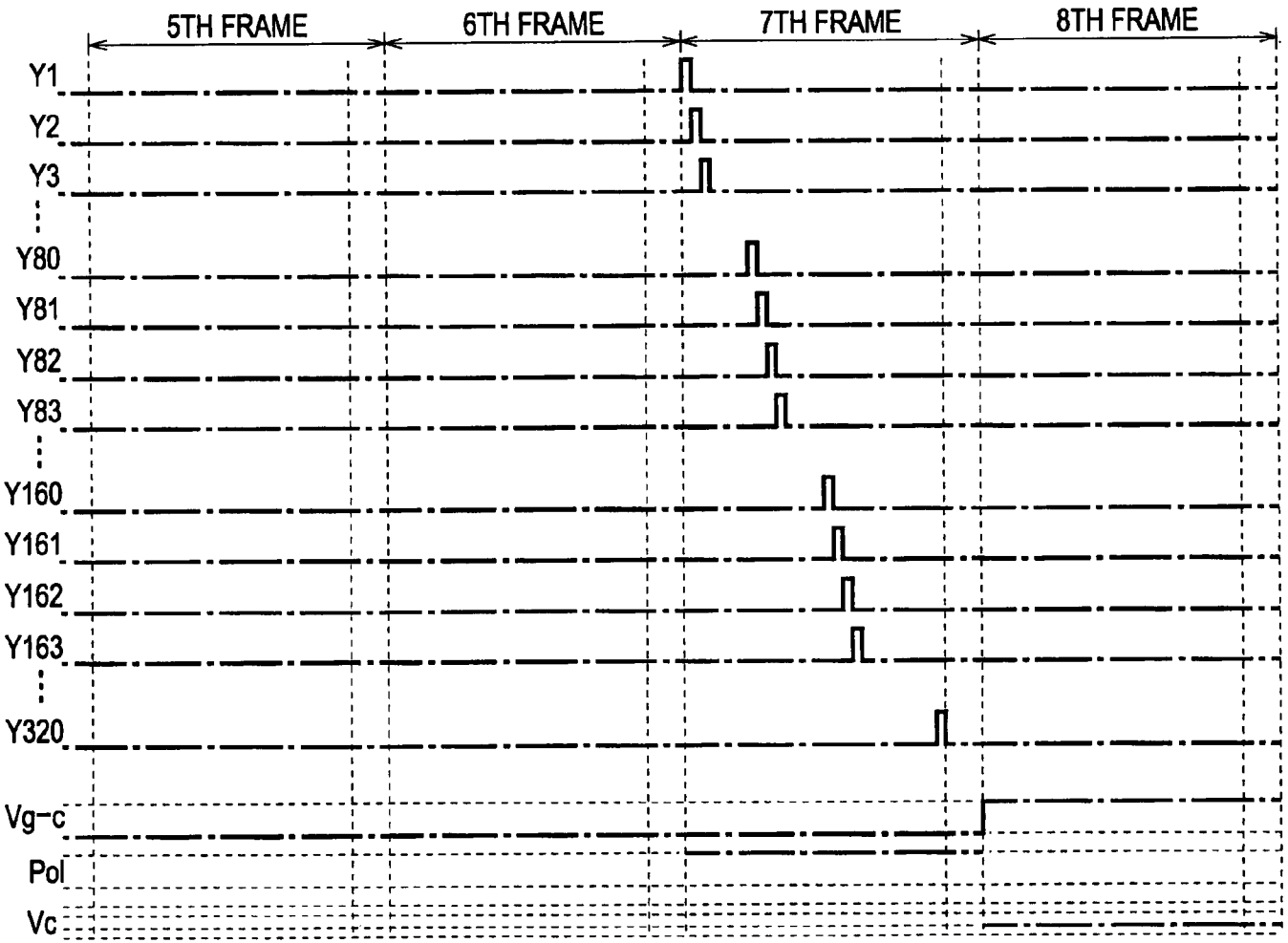
FIG. 26 is a diagram illustrating an operation of the electro-optical device in a partial mode.
Figure 27:
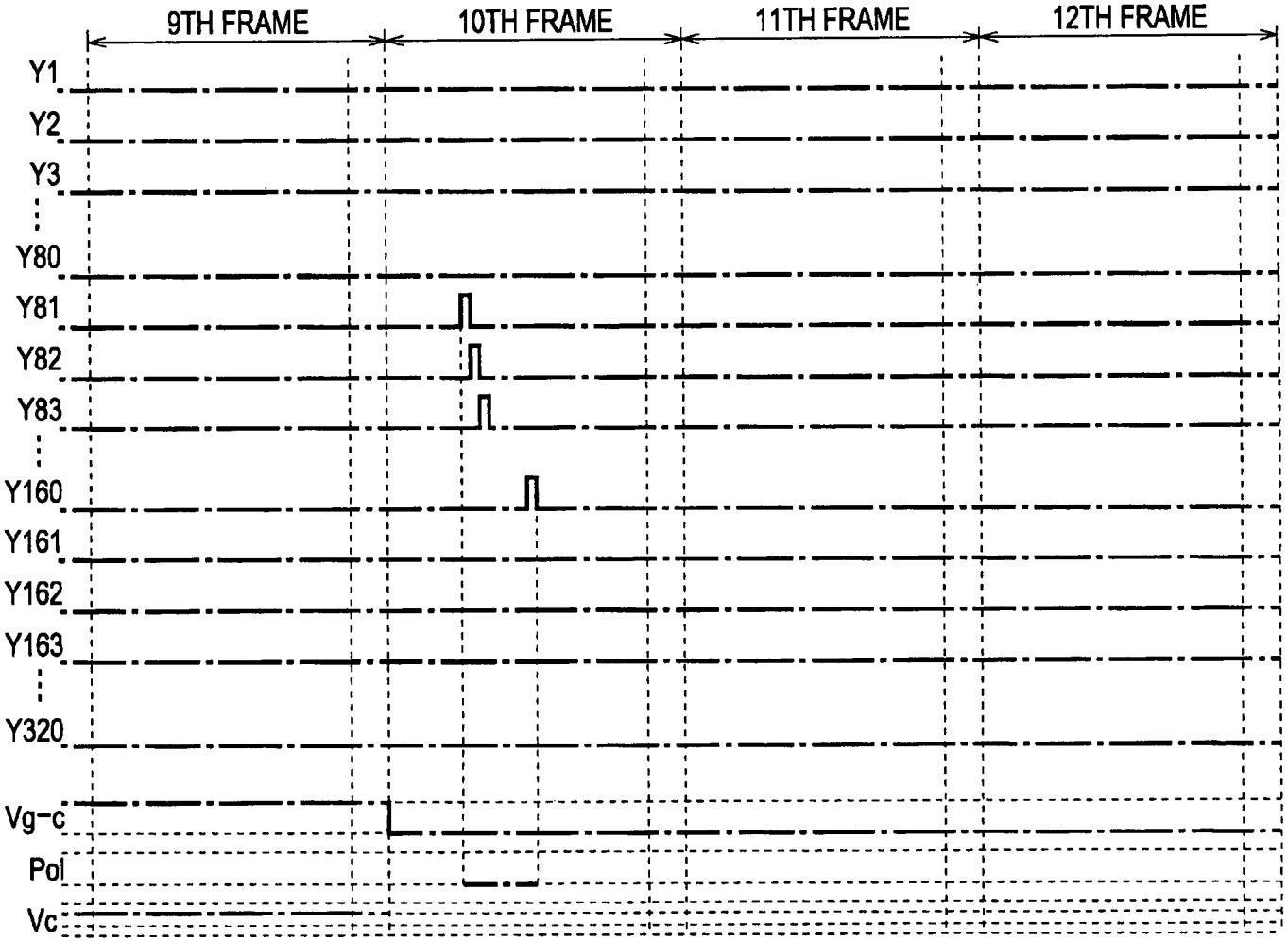
FIG. 27 is a diagram illustrating an operation of the electro-optical device in a partial mode.

In the partial mode, as shown in FIGS. 25 to 27, the scanning line driving circuit 140 outputs scanning signals, among the scanning signals Y1 to Y320 having waveforms in the full screen mode, which are brought to high levels in a number of frames, all the scanning signals or a number of scanning signals being brought to high levels in the number of frames.

The common electrode driving circuits 170*a* and 170*b* drives the common electrodes 108 corresponding to the first to 320th rows, and separately provided for convenience.

In this embodiment, the common electrode driving circuit 170*a* is arranged between the scanning line driving circuit 140 and the display region 100 and includes TFT groups each having n-channel TFTs 171 to 174. The TFT groups correspond to the first to 320th common electrodes 108.

Since connection manners of the TFTs 171 to 174 in the individual TFT groups are identical, a TFT group located in the i-th row will be described as an example. The TFT 171 (first transistor) in the i-th row has a gate electrode connected to the i-th scanning line 112, a source electrode connected to a first power supply line 161, and a drain electrode connected to a gate electrode of the TFT 173. The TFT 172 (second transistor) in the i-th row has a gate electrode connected to the i-th scanning line 112, a source electrode connected to a second power supply line 162, and a drain electrode connected to a gate electrode of the TFT 174.

The TFT 173 (third transistor) in the i-th row has a source electrode connected to a third power supply line 163, the TFT 174 (fourth transistor) in the i-th row has a source electrode connected to a fourth power supply line 164, and a drain electrode of the TFT 173 and a drain electrode of the TFT 174 are connected to the i-th common electrode 108.

The common electrode driving circuit 170*b* is arranged in an opposite side of the common electrode driving circuit 170*a* relative to the display region 100, and includes n-channel TFTs 175 corresponding to the first to 320th common electrodes 108. In each of the TFTs 175 (fifth transistor) corresponding to the individual rows, a gate electrode is connected to a control line 166, a source electrode is connected to a signal line 167, and a drain electrode is connected to a corresponding one of the common electrodes 108.

The data line driving circuit 190 supplies data signals having voltages based on writing polarities specified using a polarity specifying signal Pol, that is, voltages corresponding to levels of gradation of corresponding pixels 110 through the data lines 114 to the pixels 110 connected to, among all the scanning lines 112, scanning lines 112 to which selection voltages are applied using the scanning line driving circuit 140.

The data line driving circuit 190 includes storage regions (not shown) corresponding to the pixels 110 arranged in a matrix of 320 rows and 240 columns. In the storage regions, pieces of display data Da which specify levels of gradation (brightness) of the corresponding pixels 110 are stored. Immediately before a selection voltage is applied to a selected one of the scanning lines 112, the data line driving circuit 190 reads pieces of display data Da corresponding to pixels 110 connected to the selected one of the scanning lines 112 from corresponding storage regions, obtains voltages corresponding to levels of gradation specified by the read pieces of display data Da and a writing polarity, and supplies data signals having the voltages to corresponding data lines 114 when the selection voltage is applied. The data line driving circuit 190 performs this supply operation on each of the first to 240th columns of the selected one of the scanning lines 112.

Note that each the pieces of display data Da is replaced by a new one supplied with its address from the control circuit 20 when display content is changed. Operation of the data line driving circuit 190 in the partial mode will be described later.

The control circuit 20 supplies a latch pulse Lp to the data line driving circuit 190 when a logic level of the clock signal Cly is changed. As described above, the scanning line driving circuit 140 successively shifts the start pulse Dy in accordance with the clock signal Cly so as to generate the scanning signals Y1 to Y320 of high levels in this order. Therefore, a timing at which selection of one of the scanning lines 112 is started coincides with a timing at which the logic level of the clock signal Cly is changed. Accordingly, the data line driving circuit 190 detects a currently selected scanning line by counting supplied latch pulses Lp from a starting point of a frame. Furthermore, the data line driving circuit 190 detects the timing at which selection of one of the scanning lines 112 is started on the basis of a timing at which the latch pulse Lp is supplied.

Note that the scanning line driving circuit 140 performs the shifting operation of the start pulse Dy as described above also in the partial mode, but a limited number of scanning signals are brought to high levels.

In the full screen mode of this embodiment, when a level of the polarity specifying signal Pol is high, positive-polarity writing operations are performed on the pixels 110 corresponding to the scanning lines to which the selection voltages are applied. On the other hand, when the level of the polarity specifying signal Pol is low, negative-polarity writing operations are performed on the same pixels 110. A waveform of the polarity specifying signal Pol is shown in FIG. 22. Specifically, as shown in FIG. 22, in a period of a frame (hereinafter referred to as an "n-th frame"), the level of the polarity specifying signal Pol becomes a high level when the selection voltages are applied to the scanning signals to be supplied to the odd-numbered scanning lines (first, third, fifth, to 319th scanning lines), whereas the level of the polarity specifying signal Pol becomes a low level when the selection voltages are applied to the scanning signals to be supplied to the even-numbered scanning lines (second, fourth, sixth, to 320th scanning lines). Accordingly, in this embodiment, the writing polarities are alternately inverted on a row-by-row basis, that is, a row inversion method (or line inversion method or scanning-line inversion method) is employed in the full screen mode.

Note that in the full screen mode, in a subsequent frame (hereinafter referred to as an "(n+1)th frame"), the level of the polarity specifying signal Pol is logically inverted from that of the n-frame in the same rows. By this, degradation of the liquid crystal due to applied direct current components is prevented.

On the other hand, in the partial mode, as shown in FIGS. 25 to 27, which will be described later, the polarity specifying signal Pol keeps a low level in the entire first frame, keeps a high level in part of the fourth frame, keeps a high level in the entire seventh frame, and keeps a low level in a part of the tenth frame.

As for the writing polarities in this embodiment, in each of the pixels 110, when the positive polarities are specified, potentials of pixel electrodes 118 are higher than potentials of the corresponding common electrodes 108 when voltages in accordance with levels of gradation for the corresponding pixels 110 are applied to corresponding liquid crystal capacitors 120. On the other hand, when the negative polarities are specified, the potentials of the pixel electrodes 118 are lower than the potentials of the corresponding common electrodes 108 when the voltages in accordance with the levels of gradation for the corresponding pixels 110 are applied to the corresponding liquid crystal capacitors 120. As for the voltage, the ground potential Gnd corresponds to a low-level voltage based on a logic level, and is a reference of a zero voltage.

The control circuit 20 supplies signals Vg-a and Vg-b to the first power supply line 161 and the second power supply line 162, respectively. In this embodiment, in each of the full screen mode and the partial mode, the signal Vg-a has a waveform similar to that of the polarity specifying signal Pol whereas the signal Vg-b has a waveform obtained by logically inverting the waveform of the polarity specifying signal Pol.

When the voltages Vdd, which is a voltage of a high level based on a logic level, is applied to a gate electrode of one of TFTs 173 and a gate electrode of a corresponding one of TFTs 174, the source and drain electrodes of the one of the TFTs 173 are brought into conduction states and the source and drain electrodes of the corresponding one of the TFTs 174 are brought into conduction states. That is, the voltage Vdd is an on-voltage. On the other hand, when the ground potential Gnd, which is a voltage of a low level based on the logic level, is applied to a gate electrode of one of the TFTs 173 and a gate electrode of the corresponding one of the TFTs 174, the source and drain electrodes of the one of the TFTs 173 are brought into non-conduction states and the source and drain electrode of the corresponding one of the TFTs 174 are brought into non-conduction states. That is, the ground potential Gnd is an off-voltage.

The control circuit 20 supplies common signals Vc-a and Vc-b to the third power supply line 163 and the fourth power supply line 164, respectively. In this embodiment, in each of the full screen mode and the partial mode, the common signal Vc-a has a fixed voltage Vsl, and the common signal Vc-b has a fixed voltage Vsh. The voltage Vsl and the voltage Vsh has the following relationship: (Gnd≦) Vsl<Vsh (≦Vdd). Accordingly, the voltage Vsl is relatively lower than the voltage Vsh (that is, the voltage Vsh is relatively higher than the voltage Vsl).

The control circuit 20 supplies a control signal Vg-c to the control line 166. In the full screen mode, a level of the control signal Vg-c is low. However, in the partial mode, the control signal Vg-c is brought to a high level only in the second, third, eighth, and ninth frames as shown in FIGS. 25 to 27. Furthermore, the control circuit 20 supplies a common signal Vc to the signal line 167. In the partial mode, a voltage of the common signal Vc corresponds to the voltage Vsh in the second and third frames, and corresponds to the voltage Vsl in the eighth and ninth frames.

Figure 20:
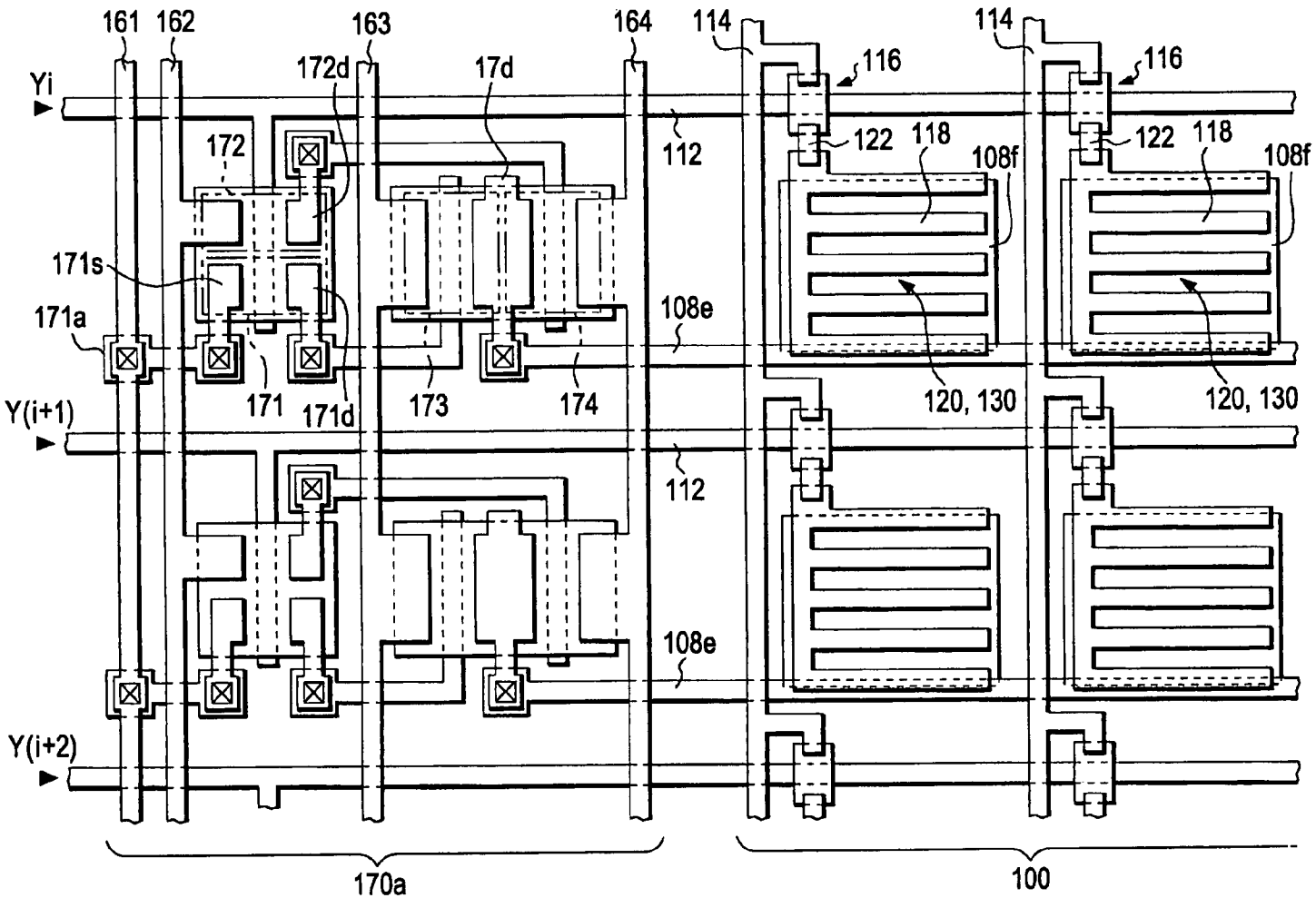
FIG. 20 is a plan view illustrating a configuration of an essential portion of an element substrate of the electro-optical device.
Figure 21:
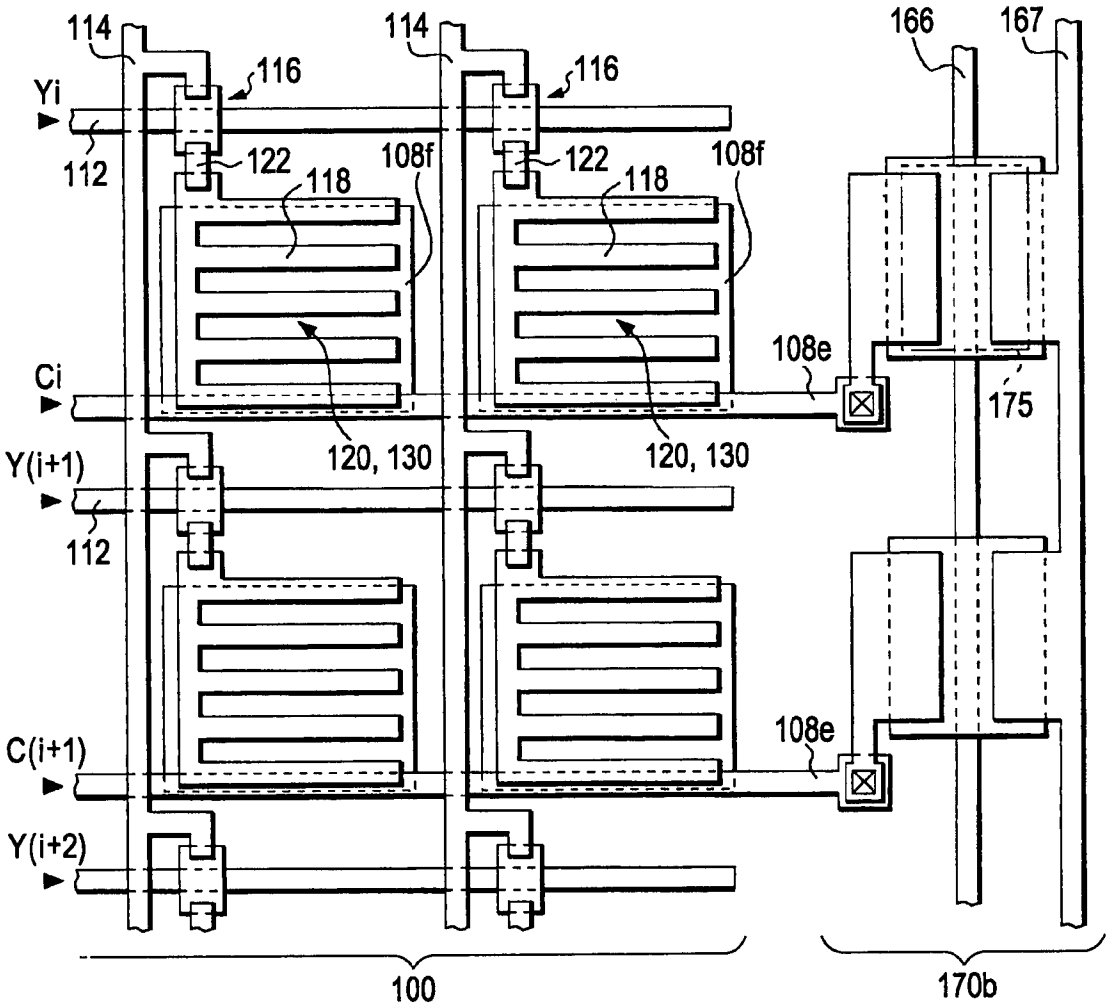
FIG. 21 is a plan view illustrating a configuration of another essential portion of an element substrate of the electro-optical device.

A panel of an electro-optical device is configured such that an element substrate and a counter substrate are attached to each other as a pair with a predetermined gap therebetween, and the gap is filled with liquid crystal. The element substrate includes the scanning lines 112, the data lines 114, the common electrodes 108, pixel electrodes 118, TFTs 116, and TFTs 171 to 175, and is attached to the counter substrate so that a surface in which the electrodes are formed faces the counter substrate. FIG. 20 is a plan view illustrating a portion in the vicinity of a boundary between the display region 100 and the common electrode driving circuit 170*a* according to the configuration of the panel of the electro-optical device. FIG. 21 is a plan view illustrating a portion in the vicinity of a boundary between the display region 100 and the common electrode driving circuit 170*b* according to the configuration of the panel of the electro-optical device.

As is apparent from FIGS. 20 and 21, the display region 100 employs an FFS (fringe field switching) mode which is a modification of an IPS mode in which an electric field of the liquid crystal is applied toward a surface of a substrate. In this embodiment, the TFTs 116 and the TFTs 171 to 175 are amorphous silicon TFTs, and furthermore, each of the TFTs 116 and the TFTs 171 to 175 is a bottom gate TFT in which the gate electrode thereof is positioned lower than a semiconductor layer (a depth side of the figures).

Specifically, rectangular electrodes 108*f* are formed by patterning a (first) ITO (indium tin oxide) layer serving as a first conductive layer, gate lines such as the scanning lines 112, the control line 166, and common lines 108*e* are formed by patterning a gate electrode layer serving as a second conductive layer, and a gate insulating layer (not shown) is formed on the gate lines, and furthermore, TFT semiconductor layers are formed on the gate insulating layer in an isolated manner. Thereafter, a protection insulating layer (not shown) is formed on the semiconductor layers, before pixel electrodes 118 having comb shapes are formed by patterning a (second) ITO layer serving as a third conductive layer. Furthermore, the source electrodes and the drain electrodes of the TFTs, the data lines 114, the first power supply line 161, the second power supply line 162, the third power supply line 163, the fourth power supply line 164, the signal line 167, and various connection electrodes are formed by patterning a metal layer serving as a fourth conductive layer.

Note that, in FIGS. 20 and 21, marks "X", indicate contact holes used to connect the lines formed on the gate electrode layer to the lines formed on the fourth conductive layer.

As shown in FIGS. 20 and 21, the common electrodes 108 shown in FIGS. 18 and 19 include the common lines 108*e* extending parallel to the scanning lines 112 and the rectangular electrodes 108*f* on which the pixel electrodes 118 are arranged through the protection insulating layer. Each of the common lines 108*e* and a corresponding one of the rectangular electrodes 108*f* arranged in an identical row are partly superposed with each other and are electrically connected to each other. Accordingly, each of the common lines 108*e* and a corresponding one of the rectangular electrodes 108*f* arranged in an identical row are electrically identical, and are not required to be distinguished from each other. Therefore, the common lines 108*e* and the corresponding rectangular electrodes 108*f* are referred to as the common electrodes 108 unless a description about a configuration is made.

In this embodiment, storage capacitors 130 are capacitance components generated due to a layer structure of the rectangular electrodes 108*f* and the pixel electrodes 118 with the protection insulating layer interposed therebetween. In addition, since the gap interposed between the element substrate and the counter substrate is filled with the liquid crystal, capacitance components are generated due to the configuration in which the gap is filled with the liquid crystal functioning as a dielectric body. The capacitance components generated due to the gap filled with the liquid crystal are represented by the liquid crystal capacitors 120, in this embodiment.

With this configuration, an electric field is generated along a surface of the element substrate and perpendicular to projecting portions of the pixel electrodes 118 in accordance with holding voltages of parallel capacitors, each of which includes a liquid crystal capacitor 120 and a storage capacitor 130, so as to change the orientation of the liquid crystal. Accordingly, an amount of light transmitting through a polarizing element (not shown) corresponds to actual values of the holding voltages.

Note that although the FFS mode is employed in this embodiment, the IPS mode may be used, and alternatively, another mode may be used as long as an electric equivalent circuit corresponding to the circuit shown in FIG. 19 is employed.

The holding voltages of the parallel capacitors correspond to differential voltages between the pixel electrodes 118 and the common electrodes 108 (rectangular electrodes 108*f*). Accordingly, to obtain a target level of gradation for a pixel arranged in the i-th row of the j-th column, a selection voltage Vdd is applied to the i-th scanning lines 112 so that a corresponding one of the TFTs 116 of the pixel of interest is brought into a conduction state (turned on), and a data signal Xj having a voltage which corresponds to a differential voltage corresponding to the target level of gradation for the pixel is supplied to a corresponding one of the pixel electrodes 118 through the j-th data line and through the TFT 116 which is arranged in the i-th row of the j-th column and which is in a on-state.

Note that in this embodiment, for simplicity, when the actual values of the holding voltages are almost zero, light transmissivity is minimized so that black display is attained, and as the actual values of the holding voltages increase, an amount of transmitting light increases so that white display having the maximum light transmissivity is attained. That is, a normally black mode is employed in this embodiment.

The common electrodes 108 in individual rows intersect with the first to 240th data lines 114 through the gate insulating layer and the other layers. Accordingly, as indicated by dashed lines shown in FIG. 19, the common electrodes 108 are capacitively coupled to the data lines 114 through the parasitic capacitors.

The configuration shown in FIGS. 20 and 21 is merely an example, and other configurations of TFTs may be applicable. For example, in terms of arrangements of the gate electrodes, top gate TFTs may be employed, and in terms of processes, polysilicon TFTs may be employed. Furthermore, instead of configurations in which the TFTs 171 to 175 which are elements of the common electrode driving circuits 170*a* and 170*b* are arranged on the substrate by a process used for the arrangement of the display region 100, a configuration in which an IC chip is implemented in the element substrate may be employed.

In a case where the IC chip is implemented on the element substrate, the scanning line driving circuit 140, the common electrode driving circuits 170*a* and 170*b*, and the data line driving circuit 190 may be integrated as a semiconductor chip or may be configured as individual chips. The control circuit 20 may be included in the element substrate.

Furthermore, in this embodiment, in a direction in which the scanning lines 112 extend, the common electrode driving circuit 170*a* is arranged near the scanning line driving circuit 140, and the common electrode driving circuit 170*b* is arranged on the opposite side of the scanning line driving circuit 140 relative to the display region 100. However inversed arrangement thereof may be employed or the common electrode driving circuits 170*a* and 170*b* may be arranged in an identical region.

In this embodiment, a transmission type panel, a reflection type panel, and a so-called semi-transmissive and semi-reflective panel which is a combination of the transmission type panel and the reflection type panel may be employed. Therefore, a reflection layer, for example, is not particularly referred to.

Operation of the electro-optical device 10 in the full screen mode according to this embodiment will now be described.

As described above, in this embodiment, when the full screen mode is used, the control circuit 20 outputs the polarity specifying signal Pol, the signal Vg-a, and the signal Vg-b in the n-th frame, and the common signal Vc-a has the fixed voltage Vsl and the common signal Vc-b has the fixed voltage Vsh as shown in FIG. 20.

In the n-th frame, the scanning signal Y1 supplied from the scanning line driving circuit 140 to the first scanning line 112 is brought to a high level. Since, in the n-th frame, positive-polarity writing operations are performed on odd-numbered rows, when the scanning signal Y1 is brought to a high level and simultaneously the latch pulse Lp is output, the data line driving circuit 190 supplies data signals X1 to X240 having voltages higher than the voltage Vsl serving as a reference voltage by voltages specified using the pieces of display data Da for pixels arranged in the first to the 240th columns of the first row to the first to the 240th data lines 114, respectively. Accordingly, for example, a data signal Xj to be supplied to the j-th data line 114 has a voltage higher than the voltage Vsl by a voltage specified using display data Da for a pixel arranged in the j-th column of the first row.

When the scanning signal Y1 is brought to a high level, TFTs 116 included in pixels 110 arranged in the first to 240th columns of the first row are turned on. Therefore, the data signals X1 to X240 are supplied to pixel electrodes 118 corresponding to the TFTs 116.

When the level of the scanning signal Y1 is high, in the common electrode driving circuit 170*a*, TFTs 171 and TFTs 172 corresponding to the first row are turned on. Here, when the level of the scanning signal Y1 is high, a level of the signal Vg-a supplied to the first power supply line 161 is high whereas a level of the signal Vg-b supplied to the second power supply line 162 is low. Therefore, when the TFTs 171 and the TFTs 172 corresponding to the first row are turned on, on-voltages of high levels are applied to gate electrodes of TFTs 173 corresponding to the first row, and off-voltages of low levels are applied to gate electrodes of TFTs 174 corresponding to the first row. Accordingly, since the TFTs 173 corresponding to the first row are turned on and the TFTs 174 corresponding to the first row are turned off, the first common electrode 108 is connected to the third power supply line 163 so that the voltage Vsl is applied thereto.

Accordingly, voltages having positive polarities obtained so as to correspond to levels of gradation for corresponding pixels are written to parallel capacitors, each of which includes a liquid crystal capacitor 120 and a storage capacitor 130, corresponding to the first to 240th columns of the first row.

Note that, in the full screen mode, since the level of the control signal Vg-c is low and the TFTs 175 corresponding to all the rows are in off states in the common electrode driving circuit 170*b*, voltages of the common electrodes 108 are not determined by the control signal Vg-c and the TFTs 175.

Next, the scanning signal Y1 is brought to a low level and the scanning signal Y2 is brought to a high level.

When the scanning signal Y1 is brought to a low level, the TFTs 116 included in the pixels 110 arranged in the first to 240th columns of the first row are turned off. Therefore, in the pixels 110 arranged in the first to 240th columns of the first row, the corresponding pixel electrodes 118 are brought into high-impedance states.

In the common electrode driving circuit 170*a*, when the scanning signal Y1 is brought to a high level, the TFTs 172 and the TFTs 172 corresponding to the first row are turned off, and accordingly, the gate electrodes of the TFTs 173 and the gate electrodes of the TFTs 174 are brought into high-impedance states. However, since levels of the gate electrodes of the TFTs 173 and levels of the gate electrodes of the TFTs 174 are maintained in certain states immediately before entering high-impedance states due to parasitic capacitors thereof, that is, levels of the TFTs 173 are high and levels of the TFTs 174 are low, the TFTs 173 and the TFTs 174 are maintained in the on-states and the off-states, respectively. Accordingly, even when the scanning signal Y1 is brought to a low level, the first common electrodes 108 maintains the connection to the third power supply line 163, and therefore, maintains the voltage Vsl. Since one end of each of the parallel capacitors, each of which includes a liquid crystal capacitor 120 and a storage capacitor 130, corresponding to the first to 240th columns of the first row maintains the voltage Vsl, states of voltages which have been written to the parallel capacitors are not changed but maintained.

On the other hand, since, in the n-th frame, negative-polarity writing operations are performed on even-numbered rows, when the scanning signal Y2 is brought to a high level and simultaneously the latch pulse Lp is output, the data line driving circuit 190 supplies the data signals X1 to X240 having voltages lower than the voltage Vsh serving as a reference voltage by voltages specified using the pieces of display data Da for pixels arranged in the first to the 240th columns of the second row to the first to the 240th data lines 114, respectively. Accordingly, for example, a data signal Xj supplied to the j-th data line 114 has a voltage lower than the voltage Vsh by a voltage specified using display data Da for a pixel arranged in the j-th column of the second row.

When the scanning signal Y2 is brought to a high level, the TFTs 116 included in pixels 110 arranged in the first to 240th columns in the second row are turned on. Therefore, the data signals X1 to X240 are supplied to pixel electrodes 118 corresponding to the TFTs 116.

When the level of the scanning signal Y2 is high, in the common electrode driving circuit 170*a*, TFTs 171 and TFTs 172 corresponding to the second row are turned on. Here, when the level of the scanning signal Y2 is high, the signal Vg-a supplied to the first power supply line 161 is brought to a low level whereas the signal Vg-b supplied to the second power supply line 162 is brought to a high level. Therefore, unlike the TFTs 173 and the TFTs 174 corresponding to the first row, the TFTs 173 corresponding to the second row are turned off and the TFTs 174 corresponding to the second row are turned on. Accordingly, the second common electrode 108 is connected to the fourth power supply line 164 so that the voltage Vsh is applied thereto.

Accordingly, voltages having negative polarities obtained so as to correspond to levels of gradation for corresponding pixels are written to parallel capacitors, each of which includes a liquid crystal capacitor 120 and a storage capacitor 130, corresponding to the first to 240th columns of the second row.

Subsequently, the scanning signal Y2 is brought to a low level while the scanning signal Y3 is brought to a high level. When the scanning signal Y2 is brought to a low level, TFTs 116 included in pixels 110 arranged in the first to 240th columns of the second row are turned off. Therefore, in the pixels 110 arranged in the first to 240th columns of the second row, the corresponding pixel electrodes 118 are brought into high-impedance states.

In the common electrode driving circuit 170*a*, since the TFTs 171 and the TFTs 172 corresponding to the second row are turned off when the scanning signal Y2 is brought to a low level, the gate electrodes of the TFTs 173 and the gate electrodes of the TFTs 174 are brought into high-impedance states. However, levels of the gate electrodes of the TFTs 173 are maintained in low levels and levels of the gate electrodes of the TFTs 174 are maintained in high levels due to parasitic capacitors thereof. Therefore, the TFTs 173 and the TFTs 174 are maintained in the off-states and the on-states, respectively. Accordingly, even when the scanning signal Y2 is brought to a low level, the second common electrodes 108 maintains the connection to the fourth power supply line 164, and therefore, maintains the voltage Vsh.

Accordingly, since one end of each of the parallel capacitors, each of which includes a liquid crystal capacitor 120 and a storage capacitor 130, corresponding to the first to 240th columns of the second row maintains the voltage Vsh, states of voltages which have been written to the parallel capacitors are not changed but maintained.

When the scanning signal Y3 is brought to a high level, voltages having the positive polarities corresponding to levels of gradation for corresponding pixels are written to parallel capacitors, each of which includes a liquid crystal capacitor 120 and a storage capacitor 130, corresponding to the third row. Then, when the scanning signal Y4 is brought to a high level, voltages having the negative polarities corresponding to levels of gradation for corresponding pixels are written to parallel capacitors, each of which includes a liquid crystal capacitor 120 and a storage capacitor 130, corresponding to the fourth row.

Operations similar to those described above are repeatedly performed until the 320th row is reached. Accordingly, in the n-th frame, voltages having the positive polarities corresponding to levels of gradation for corresponding pixels are written to parallel capacitors, each of which includes a liquid crystal capacitor 120 and a storage capacitor 130, corresponding to the odd-numbered rows. On the other hand, in the n-th frame, voltages having the negative polarities corresponding to levels of gradation for corresponding pixels are written to parallel capacitors, each of which includes a liquid crystal capacitor 120 and a storage capacitor 130, corresponding to the even-numbered rows. In this way, the voltages corresponding to levels of gradation for corresponding pixels are written to the parallel capacitors in all the pixels 110, and a single (frame) image is displayed using the display region 100.

The polarity specifying signal Pol, the signal Vg-a, and the signal Vg-b of the subsequent (n+1)th frame have logic levels opposite to those of the preceding n-th frame. When one of the scanning lines 112 of the odd-numbered rows is selected, one of the common electrodes 108 corresponding to the selected one of the scanning lines 112 of the odd-numbered rows is connected to the fourth power supply line 164 so that the voltage Vsh is applied thereto. Even when the selected one of the scanning lines 112 becomes a non-selection state (that is, a level of a scanning signal is low), the connection between the one of the common electrodes 108 and the fourth power supply line 164 is maintained. On the other hand, when one of the scanning lines 112 of the even-numbered rows are selected, one of the common electrodes 108 corresponding to the selected one of the scanning lines 112 of the odd-numbered rows is connected to the third power supply line 163 so that the voltage Vsl is applied thereto. Even when the selected one of the scanning lines 112 becomes a non-selection state, the connection between the one of the common electrodes 108 and the third power supply line 163 is maintained.

Accordingly, in the (n+1)th frame, voltages having negative polarities corresponding to levels of gradation for corresponding pixels are written to the parallel capacitors, each of which includes a liquid crystal capacitor 120 and a storage capacitor 130, in the odd-numbered rows. Similarly, voltages having positive polarities corresponding to levels of gradation for corresponding pixels are written to the parallel capacitors, each of which includes a liquid crystal capacitor 120 and a storage capacitor 130, in the even-numbered rows. The parallel capacitors in all the rows maintain the written voltages.

Figure 23:
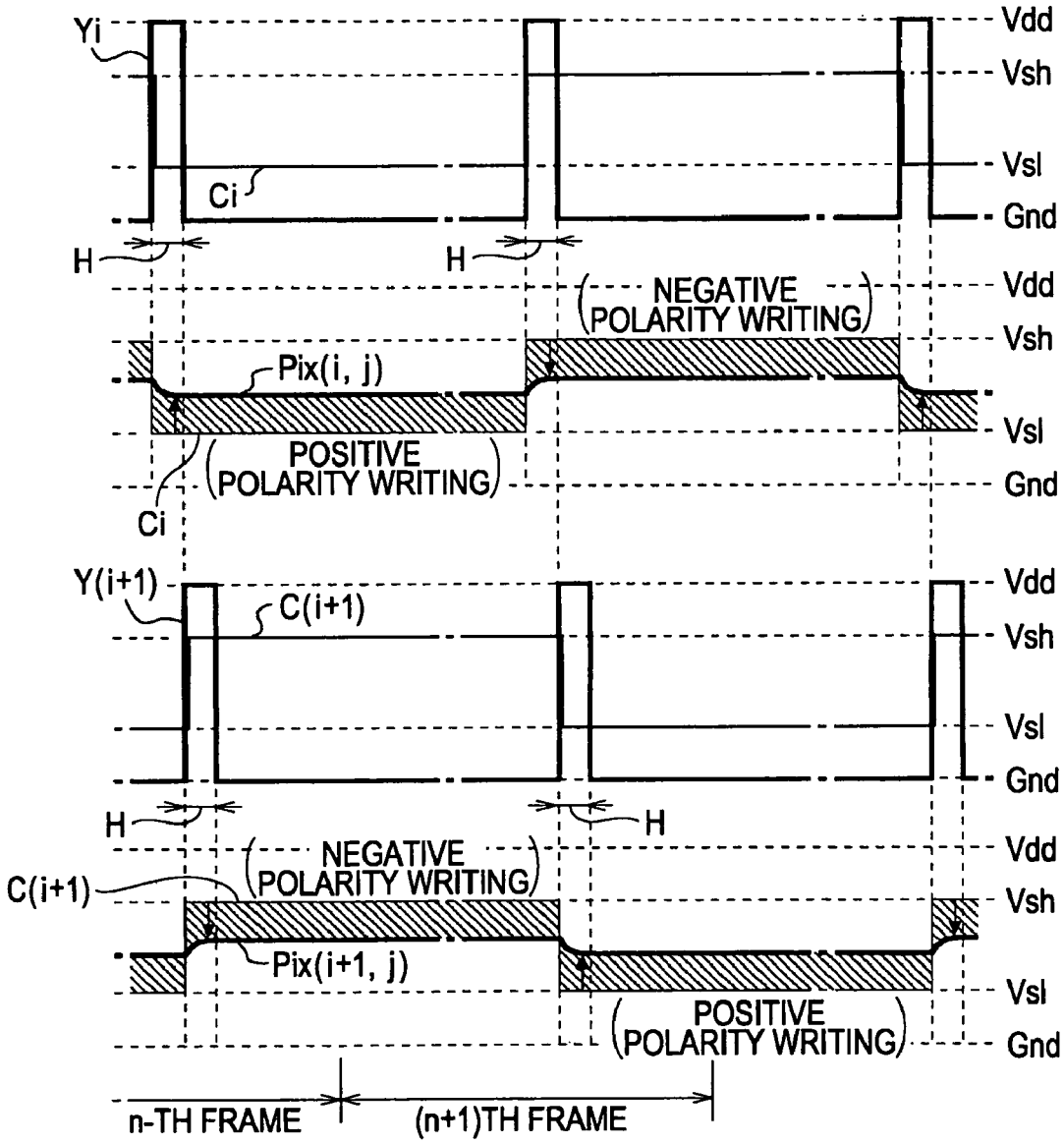
FIG. 23 is a diagram illustrating voltage waveforms of pixel electrodes of the electro-optical device.

Referring to FIG. 23, a voltage writing operation performed in this embodiment will be described. FIG. 23 shows the relationship between a scanning signal Yi and a voltage Pix(i, j) of a pixel electrode 118 arranged in the i-th row of the j-th column and the relationship between a scanning signal Y(i+1) and a voltage Pix(i+1, j) of a pixel electrode 118 arranged in the (i+1)th row of the j-th column. Note that in FIG. 23, the vertical scale indicating voltages is larger than that of FIG. 22 for convenience.

In the n-th frame, since positive-polarity writing operation is performed on an odd-numbered i-th row, while a level of the scanning signal Yi is high, a data signal Xj having a voltage higher than the voltage Vsl (indicated by an upward arrow mark in FIG. 23) by a voltage corresponding to a level of gradation for a pixel arranged in the i-th row of the j-th column is supplied to the j-th data line 114. Therefore, a differential voltage generated using the voltage of the data signal Xj and the voltage Vsl of a corresponding one of the common electrodes 108, that is, a positive polarity voltage corresponding to the level of gradation for the pixel arranged in the i-th row of the j-th column is written to a parallel capacitor including a liquid crystal capacitor 120 and a storage capacitor 130 corresponding to the i-th row of the j-th column.

When the scanning signal Yi is brought to a low level, the pixel electrode 118 of the i-th row of the j-th column is brought into a high-impedance state. Meanwhile, since a common electrode 108 which corresponds to the odd-numbered i-th row is connected to the third power supply line 163 when the scanning signal Yi is brought to a high level in the n-th frame, the voltage Vsl is applied thereto. This connection state is maintained until the scanning signal Yi is brought to a high level again in the subsequent (n+1)th frame. Therefore, the voltage Pix(i, j) of the pixel electrode 118 of the i-th row of the j-th column is not changed, that is, a voltage (corresponding to the voltage of the data signal Xj) obtained when the scanning signal Yi is brought to a high level is maintained. Accordingly, a voltage actual value (a hatched portion) held by the parallel capacitor including the liquid crystal capacitor 120 and the storage capacitor 130 is not influenced by the voltage Pix(i, j).

Note that, in the n-th frame, since a negative-polarity writing operation is performed on pixels arranged in an even-numbered (i+1) row, while a level of the scanning signal Y(i+1) is high, a data signal Xj having a voltage lower than the voltage Vsh (indicated by an downward arrow mark in FIG. 23) by a voltage corresponding to a level of gradation for a pixel arranged in the (i+1)th row of the j-th column is supplied to the j-th data line 114. Therefore, a negative polarity voltage corresponding to a level of gradation for the pixel arranged in the (i+1)th row of the j-th column is written to a parallel capacitor including a liquid crystal capacitor 120 and a storage capacitor 130 corresponding to the (i+1)th row of the j-th column. Since a common electrode 108 corresponding to the even-numbered (i+1)th row is connected to the fourth power supply line 164 when the scanning signal Y(i+1) is brought to a high level in the n-th frame, the voltage Vsh is applied thereto. This connection state is maintained until the scanning signal Y(i+1) is brought to a high level again in the subsequent (n+1)th frame. Therefore, the voltage Pix(i+1, j) is not changed, that is, a voltage (corresponding to the voltage of the data signal Xj) obtained when the scanning signal Yi is brought to a high level is maintained. Accordingly, a voltage actual value (a hatched portion) held by the parallel capacitor, which includes the liquid crystal capacitor 120 and the storage capacitor 130, corresponding to the (i+1)th row of the j-th column is not influenced by the voltage Pix(i+1, j).

Furthermore, in the subsequent (n+1)th frame, the writing polarity opposite to that in the n-th frame is employed, that is, the negative-polarity writing operations are performed on the pixels arranged in the odd-numbered i-th rows and the positive-polarity writing operations are performed on the pixels arranged in the even-numbered (i+1)th rows.

As described above, in this embodiment, the writing polarities are inverted for individual scanning lines in the full screen mode.

According to this embodiment, common electrodes 108 corresponding to rows subjected to the positive-polarity writing operations have relatively lower voltages Vsl when scanning lines 112 corresponding to the rows are selected, and voltages higher than the voltages Vsl by voltages corresponding to levels of gradation for the corresponding pixels are supplied as data signals. On the other hand, common electrodes 108 corresponding to rows subjected to the negative-polarity writing operations have relatively higher voltages Vsh when scanning lines 112 corresponding to the rows are selected, and voltages high than the voltages Vsh by voltages corresponding to levels of gradation for the corresponding pixels are supplied as data signals.

Accordingly, since voltage amplitudes of the data signals are small when compared with a case when the common electrodes 108 have fixed voltages, components of the data line driving circuit 190 may have comparatively smaller pressure resistance, and therefore, configurations thereof may be simplified. In addition, unnecessary power consumption due to voltage changes can be suppressed.

As described above, since the common electrodes 108 (common lines 108*e*) intersect with the first to 240th data lines 114 through the gate insulting layer and other layers, voltage changes of the data lines 114, that is, changes of the data signals X1 to X240 are transmitted to the common electrodes 108 through the parasitic capacitors.

Therefore, when the common electrodes 108 are not electrically connected to any components, the common electrodes 108 are influenced by the voltage changes of the data lines 114 (voltage changes of the data signals X1 to X240), and potentials of the common electrodes 108 are changed. In this embodiment, since the common electrodes 108 are provided for individual rows, amounts of changes of the potentials of the common electrodes 108 for individual rows are different from one another. This may lead to deterioration of display quality.

To address this disadvantage, in this embodiment, in the odd-numbered i-th row, for example, when the scanning signal Yi is brought to a high level, the TFTs 171 and the TFTs 172 in the i-th row are turned on, and accordingly, the TFTs 173 are turned on and the TFTs 174 are turned off, and signals of high levels are written to the parasitic capacitor of the TFTs 173 and signals of low levels are written to the parasitic capacitor of the TFTs 174. Even when the scanning signal Yi is brought to a low level, on-states of the TFTs 173 of the i-th row and off-states of the TFTs 174 of the i-th row are maintained. Consequently, the connection between one of the common electrodes 108 which corresponds to the odd-numbered i-th row and the third power supply line 163 is maintained. Similarly, in the n-th frame, connection between one of the common electrodes 108 which corresponds to the even-numbered (i+1)th row and the fourth power supply line 164 is maintained. Accordingly, in the full screen mode of this embodiment, the voltages Vsl or the voltages Vsh are normally applied to the common electrodes 108 for individual rows, and accordingly, the common electrodes 108 are not brought into high-impedance states. Consequently, the deterioration of display quality caused by the voltage changes of the common electrodes 108 can be prevented.

Operation of the electro-optical device 10 in the partial mode will now be described. FIG. 24 is a diagram illustrating operations in frames in the partial mode. In the partial mode of this embodiment, 12 frames, that is, the first to twelfth frames are used as a unit for the operation.

In this example, the first to 80th rows and the 161st to 320th rows are non-display rows in which display is not performed, that is, pixels corresponding to the non-display rows are not available. On the other hand, the 81st to 160th rows are display rows in which display is performed. FIG. 24 shows writing polarities used in voltage writing operations performed on the pixels corresponding to the first to 320th scanning lines 112, when effective display is to be performed using pixels corresponding to the display rows.

Note that, in the partial mode, the pixels corresponding to the display rows may be simply displayed in binary display, that is, displayed in white which is an on-state and black which is an off-state. In this embodiment, gradation display may be used.

In FIG. 24, "+" denotes a positive polarity and "−" denotes a negative polarity used in the voltage writing operations. In addition, "×" denotes a state in which a voltage writing operation is not performed.

In the partial mode, negative-polarity voltage writing operations are performed on the first to 80th rows and the 161st to 320th rows of the first frame, and positive-polarity voltage writing operations are performed on the first to 80th rows and the 161st to 320th rows of the seventh frame. These voltage writing operations are performed so that voltages corresponding to black (off-states) are forcedly written to the pixels corresponding to the non-display rows in order to attain ineffective display. Meanwhile, the negative-polarity voltage writing operation, the positive-polarity voltage writing operation, the positive-polarity voltage writing operation, and the negative-polarity voltage writing operation are performed in this order on the 81st to 160th rows of the first, fourth, seventh, and tenth frames. Accordingly, in this embodiment, rows adjacent to each other have identical writing polarities in the partial mode.

Referring to FIGS. 25 to 27, waveforms of the scanning signals and other signals in the partial mode described in FIG. 24 will be described. FIG. 25 shows waveforms of the scanning signals Y1 to Y320 and the other signals in the first to fourth frames, FIG. 26 shows waveforms of the scanning signals Y1 to Y320 and the other signals in the fifth to eighth frames, and FIG. 27 shows waveforms of the scanning signals Y1 to Y320 and the other signals in the ninth to 12th frames.

As shown in FIG. 25, in the partial mode, the waveforms of the scanning signals Y1 to Y320 in the first frame are the same as those in the full screen mode. Note that, in this embodiment, since the polarity specifying signal Pol is fixed in a low level in the first frame, voltages having negative polarities corresponding to black (off-states) are written to the non-display rows, that is, the first to 80th rows and the 161st to 320th rows, and voltages having negative polarities corresponding to levels of gradation for corresponding pixels are written in the display rows, that is, the 81st to 160th rows.

In the partial mode, the scanning signals Y1 to Y320 are not brought to high levels in the second and third frames, and accordingly, writing operations are not performed.

In the fourth frame in the partial mode, the scanning signals Y81 to Y160 are successively brought to high levels. Note that, in the fourth frame, while the scanning signals Y81 to Y160 are successively brought to high levels, a level of the polarity specifying signal Pol is high. Accordingly, voltages having positive polarities corresponding to levels of gradation for corresponding pixels are written to the display rows, that is, the 81st to 160th rows.

Then, as shown in FIG. 26, in the fifth and sixth frames in the partial mode, as with the second and third frames, the scanning signals Y1 to Y320 are not brought to high levels, and accordingly, writing operations are not performed.

In the seventh frame, the waveforms of the scanning signals Y1 to Y320 are the same as those in the full screen mode. Note that, in this embodiment, since the polarity specifying signal Pol is fixed in a high level in the seventh frame, voltages having positive polarities corresponding to black (off-states) are written in the non-display rows, that is, the first to 80th rows and the 161st to 320th rows, and voltages having positive polarities corresponding to levels of gradation for corresponding pixels are written to the display rows, that is, the 81st to 160th rows.

In the eighth frame shown in FIG. 26 and the ninth frame shown in FIG. 27, the scanning signals Y1 to Y320 are not brought to high levels, and accordingly, writing operations are not performed. In the tenth frame in the partial mode, the scanning signals Y1 to Y160, that is, the display rows are successively brought to high levels. Since the polarity specifying signal Pol is fixed in a low level while the scanning signals Y81 to Y160 are successively brought to high levels in the tenth frame, voltages having negative polarities corresponding to levels of gradation for corresponding pixels are written in the 81st to 160th rows, that is, the display rows. In the 11th and 12th frames, the scanning signals Y1 to Y320 are not brought to high levels, and accordingly, writing operations are not performed.

Thereafter, in the partial mode, operations performed in the first to 12th frames are repeatedly performed.

In the full screen mode, voltage writing operations are performed for individual frames. However, in the partial mode, off-voltage writing operations are performed every six frames on the pixels corresponding to the non-display rows, whereas voltage wiring operations are performed every three frames on the pixels corresponding to the display rows. Accordingly, power consumption necessary for the voltage writing operations is reduced.

In the full screen mode, in the common electrode driving circuit 170*a*, for example, the TFTs 173 and TFTs 174 corresponding to the i-th row hold, in the parasitic capacitors thereof, on-voltages or off-voltages which were applied to the gate electrodes of the TFTs 173 and the gate electrodes of the TFTs 174 when the level of the scanning signal Yi is high so that the potential of the i-th common electrode 108 is fixed even when the scanning signal Yi becomes a low level.

However, in the partial mode, the number of times the voltage writing operations are performed when the scanning signals are brought to high levels is reduced when compared with the full screen mode. Accordingly, the on-voltages held in the gate electrodes of the TFTs 173 or the gate electrodes of the TFTs 174 are gradually reduced to equal to or smaller than a threshold value due to leakage, for example. Consequently, on-states may not be maintained.

To avoid this problem, a configuration in which capacitance elements are added to the gate electrodes of the TFTs 173 and the gate electrodes of the TFTs 174 so that the voltages are prevented from leaking may be proposed. However, in this configuration, regions for the capacitance elements should be additionally provided, and therefore, a region surrounding the display region 100, that is, a frame region, becomes larger.

Accordingly, in the partial mode in this embodiment, the control circuit 20 supplies the control signal Vg-c and the common signal Vc as described above. Specifically, the control circuit 20 controls the level of the control signal Vg-c to be high in the second, third, eighth, and ninth frames and controls the common signal Vc to have the voltage Vsh in the second and third frames and to have the voltage Vsl in the eighth and ninth frames.

In the first frame, since the level of the polarity specifying signal Pol is low, the level of the signal Vg-a is low, and the level of the signal Vg-b is inversely high. Therefore, in the common electrode driving circuit 170*a*, in an odd-numbered i-th row, when the scanning signal Yi is brought to a high level and therefore the TFTs 171 and the TFTs 172 are turned on, off-voltages are applied to the gate electrodes of the TFTs 173 and on-voltages are applied to the gate electrodes of the TFTs 174. By this, the voltages Vsh of a high-level side are applied to the i-th common electrode 108 in accordance with negative-polarity writing operations. Similarly, in an even-numbered (i+1)th row, since off-voltages and on-voltages are applied to the gate electrodes of the TFTs 173 and the gate electrodes of the TFTs 174, respectively, the voltages Vsh are applied to the (i+1)th common electrode 108.

In the second and third frames, since the scanning signals are not brought to high levels, gate voltages of the TFTs 173 and the TFTs 174 in the individual rows are reduced due to voltage leakage, for example, and on-states thereof may not be maintained. However, since the TFTs 175 in the common electrode driving circuit 170*b* are simultaneously brought into on-states when the control signal Vg-c is brought to a high level, as with the first frame, the common electrodes 108 are determined to have the voltage Vsh corresponding to the voltage of the common signal Vc irrespective of the gate voltages of the TFTs 173 and the TFTs 174, that is, irrespective of the on-state or the off-states of the TFTs 173 and the TFTs 174.

In the fourth frame, while the scanning signals Y80 to Y161 are successively brought to high levels, the level of the polarity specifying signal Pol is high. Accordingly, the level of the signal Vg-a is high and the level of the signal Vg-b is inversely low.

In the common electrode driving circuit 170*a*, when the scanning signals supplied to the display rows are brought to high levels and therefore the TFTs 171 and the TFTs 172 are turned on, on-voltages and off-voltages are applied to the gate electrodes of the TFTs 173 and the gate electrodes of the TFTs 174, respectively. Therefore, the TFTs 173 are turned on and the TFTs 174 are turned off. Accordingly, the voltages Vsl of a low-level side is applied to the common electrodes 108 corresponding to the display rows in accordance with the positive-polarity writing operations.

In the seventh to tenth frames, voltage writing operations having writing polarities opposite to those of the voltage writing operations performed in the first to fourth frames are performed.

As described above, according to this embodiment, in the partial mode, in addition to the first and seventh frames in which the voltage writing operations are performed on all the rows, the potentials of the common electrodes 108 are fixed in the second, third, eighth, and ninth frames. Accordingly, deterioration of display quality may be suppressed.

Note that, in this embodiment, the level of the control signal Vg-c is set to a high level in the second, third, eighth, and ninth frames so that the fixed potentials of the common electrodes 108 are obtained. However, the control signal Vg-c should keep a high level at least all or part of a frame selected from among frames positioned after the first (seventh) frame in which the voltage writing operations are performed on all the rows and before the fourth (tenth) frame in which the voltage writing operations are performed only on the display rows. Accordingly, for example, the control signal Vg-c may be brought to a high level only in the third and ninth frames.

Fourth Embodiment

In the third embodiment described above, in the full screen mode, polarities of the writing operations performed on the pixels are alternately inverted for each row, and in the partial mode, the display rows adjacent to one another have identical writing polarities. Therefore, there arises a problem in that quality of an image displayed using the pixels arranged in the display rows are deteriorated when compared with a case of the full screen mode.

A fourth embodiment in which writing polarities are alternately inverted for each scanning line in the display rows even in the partial mode will be described.

Figure 28:
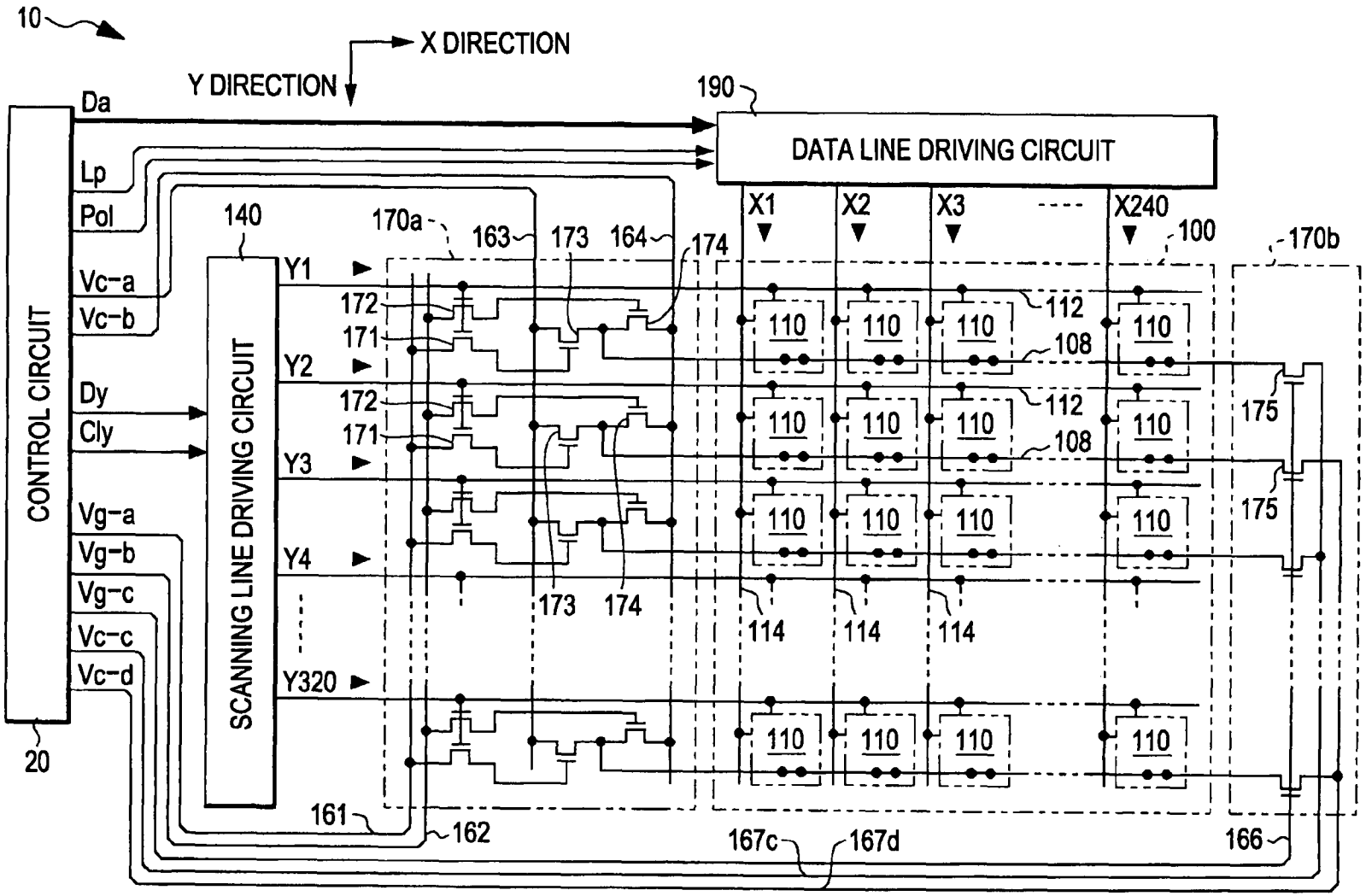
FIG. 28 is a diagram illustrating a configuration of an electro-optical device according to a fourth embodiment of the invention.

FIG. 28 is a block diagram illustrating a configuration of an electro-optical device according to the fourth embodiment.

The configuration shown in FIG. 28 is different from the configuration shown in FIG. 18 in that source electrodes of TFTs 175 corresponding to odd-numbered rows and source electrodes of TFTs 175 corresponding to even-numbered rows are connected to different lines. Specifically, the source electrodes of the TFTs 175 corresponding to the odd-numbered rows are connected to a first signal line 167*c* to which a common signal Vc-c is supplied, and the source electrodes of the TFTs 175 corresponding to the even-numbered rows are connected to a second signal line 167*d* to which a common signal Vc-d is supplied.

Figure 29:
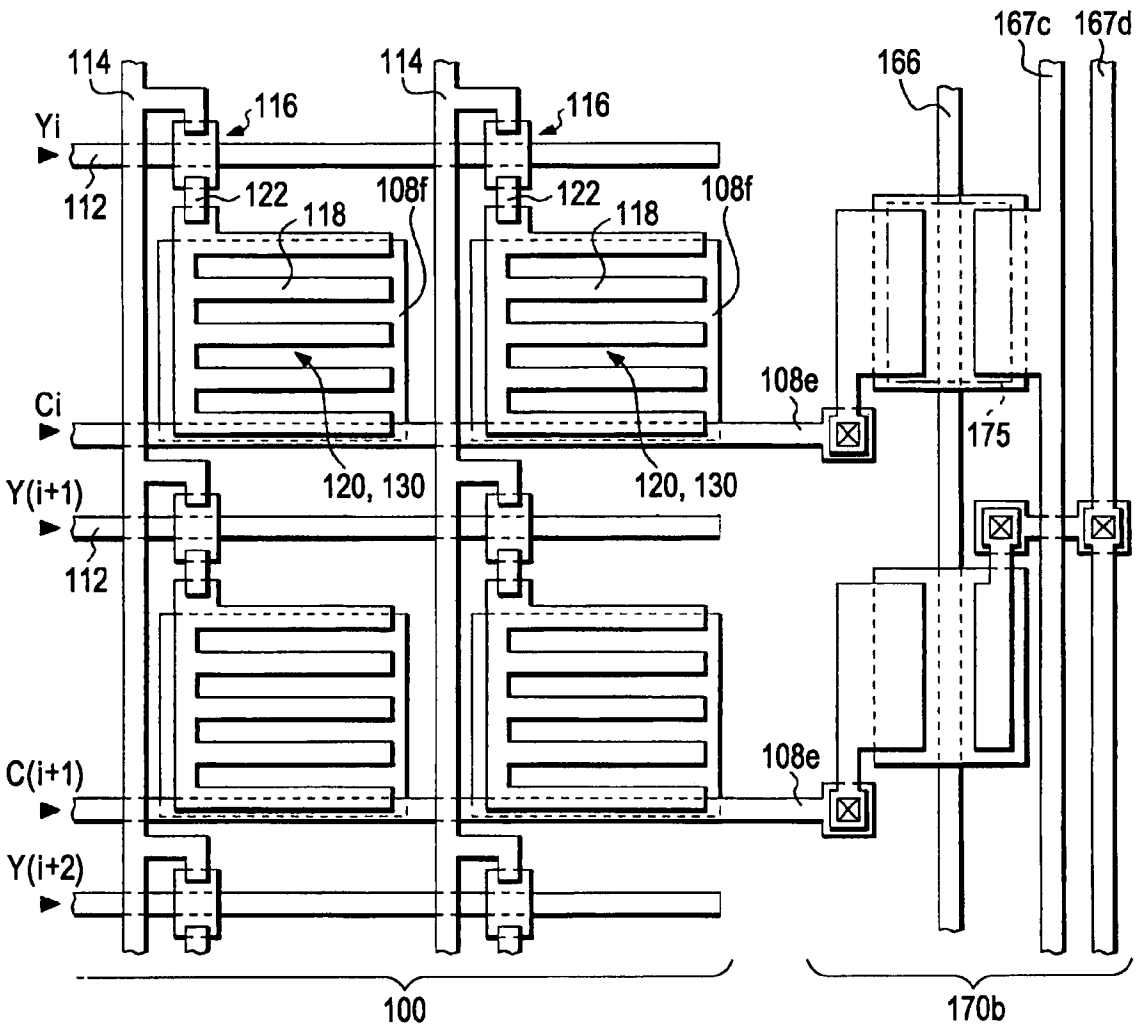
FIG. 29 is a plan view illustrating a configuration of an essential portion of an element substrate of the electro-optical device.

FIG. 29 is a plan view illustrating a portion in the vicinity of a boundary between a display region 100 and a common electrode driving circuit 170*b* in an element substrate of the fourth embodiment.

As shown in FIG. 29, a source electrode of a TFT 175 corresponding to an odd-numbered i-th row is formed of a portion branched from the first signal line 167*c*, and a source electrode of a TFT 175 corresponding to an even-numbered (i+1)th row is connected to the second signal line 167*d* through a line extending across the first signal line 167*c* beneath the first signal line 167*c*.

Note that operation in a full screen mode of the fourth embodiment is the same as the operation in the full screen mode of the third embodiment. Therefore, points of operation in a partial mode of the fourth embodiment which are different from the operation in the partial mode of the third embodiment are mainly described.

FIG. 30 is a diagram illustrating the operation in individual frames in the partial mode.

As with the third embodiment (refer to FIG. 23), in the partial mode of the fourth embodiment, 12 frames, that is, the first to twelfth frames, are used as a unit for the operation. The first to 80th rows and the 161st to 320th rows are non-display rows and the 81st to 160th rows are display rows, for example.

As shown in FIG. 30, in the partial mode, writing polarities in the first frame in both of the display rows and the non-display rows are obtained by inverting writing polarities employed in an operation of a full screen mode performed immediately before the operation in the partial mode is performed, and positive-polarity writing operations are performed on odd-numbered rows and negative-polarity writing operations are performed on even-numbered rows. Furthermore, writing polarities in the seventh frame are obtained by inverting the writing polarities of the first frame. The row inversion method is employed in the first and seventh frames.

Writing polarities in the fourth frame of the display rows are obtained by inverting the writing polarities of the first frame, and writing polarities in the tenth frame of the display rows are obtained by inverting the writing polarities of the seventh frame. The row inversion method is employed in the fourth and tenth frames.

In the second and third frames, a control circuit 20 controls the common signal Vc-c to have a voltage Vsl and controls the common signal Vc-d to have a voltage Vsh. In the eighth and ninth frames, the control circuit 20 controls the common signal Vc-c to have the voltage Vsh, and controls the common signal Vc-d to have the voltage Vsl.

Figure 31:
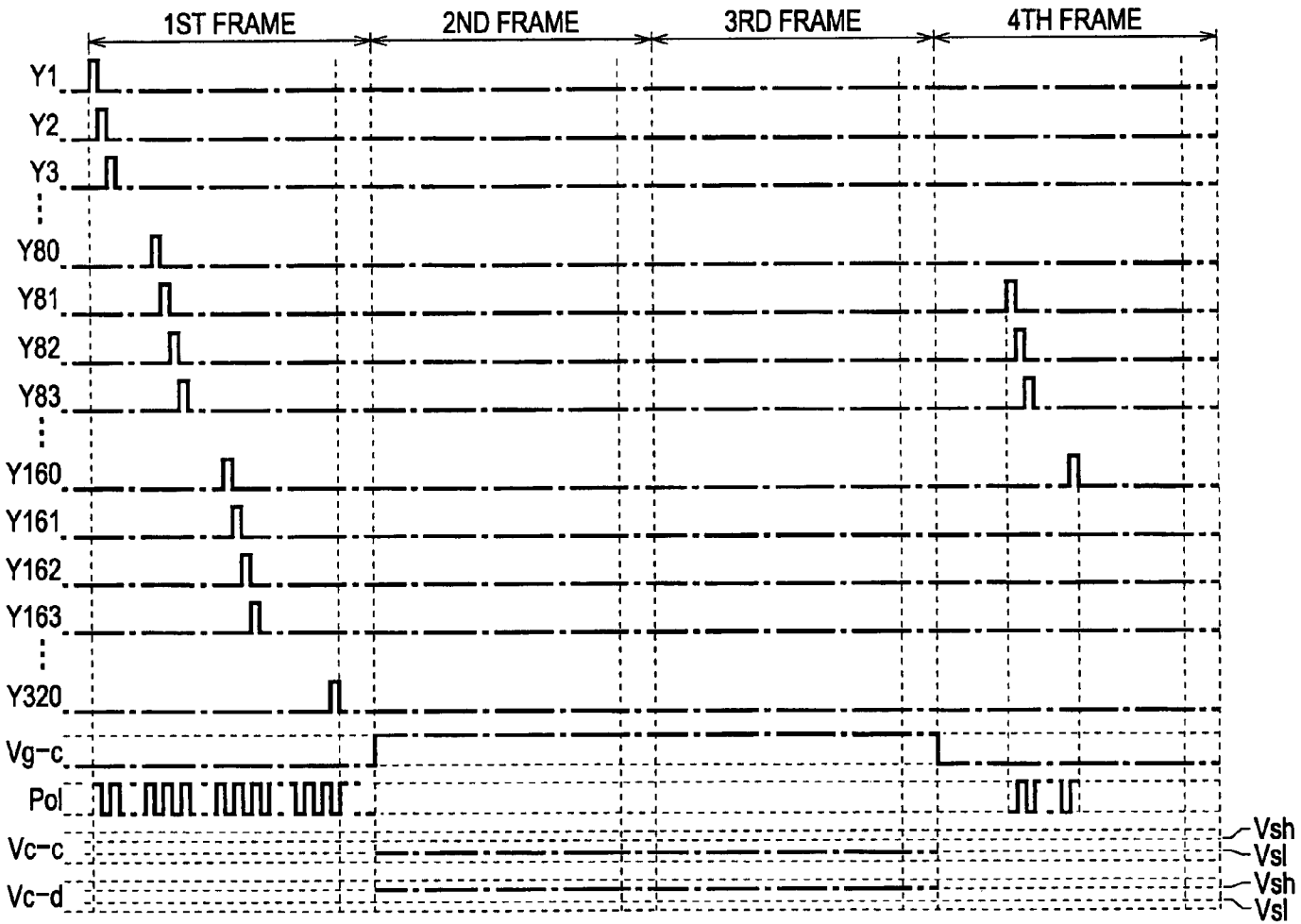
FIG. 31 is a diagram illustrating an operation of the electro-optical device in a partial mode.
Figure 32:
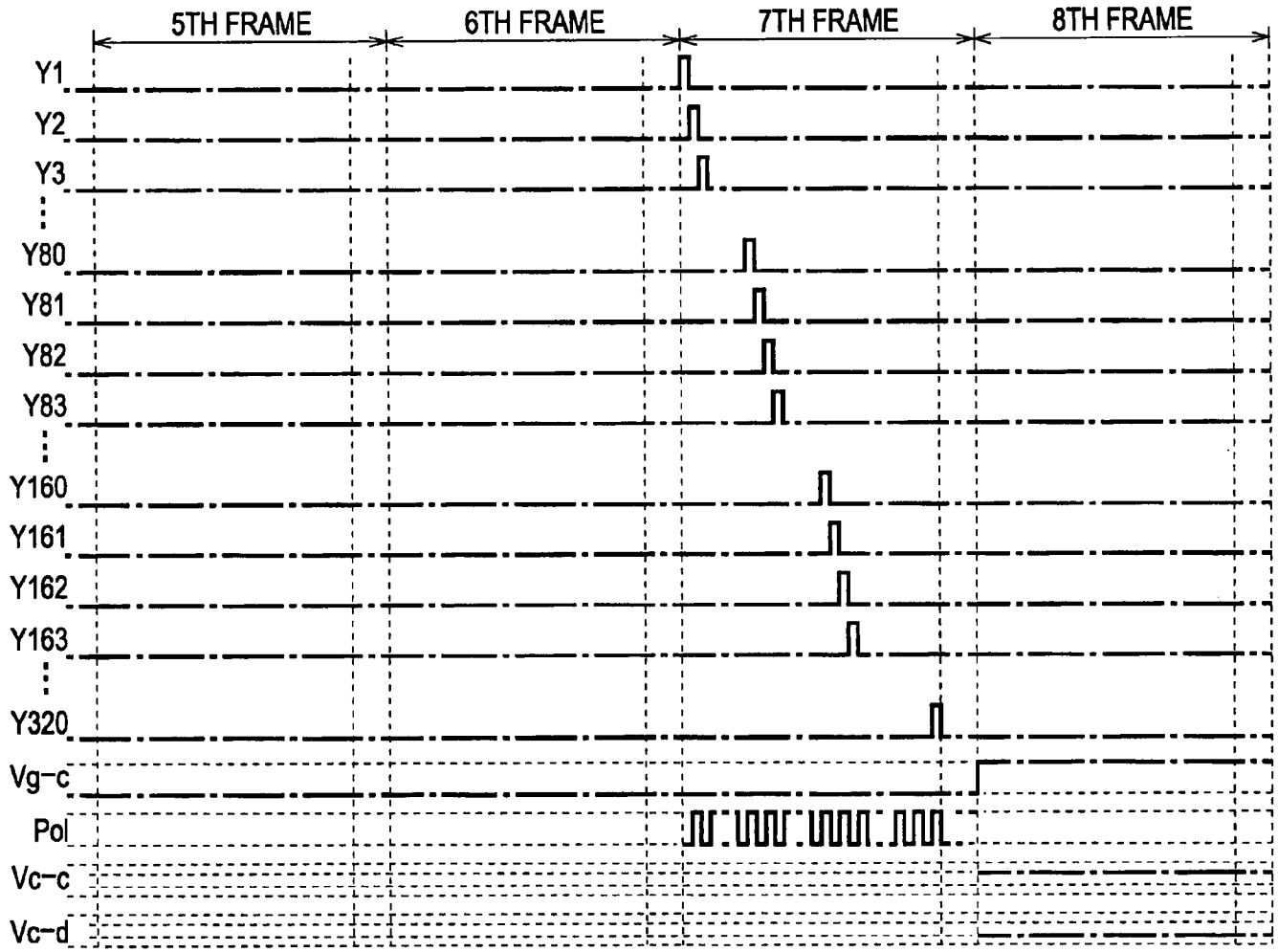
FIG. 32 is a diagram illustrating an operation of the electro-optical device in a partial mode.
Figure 33:
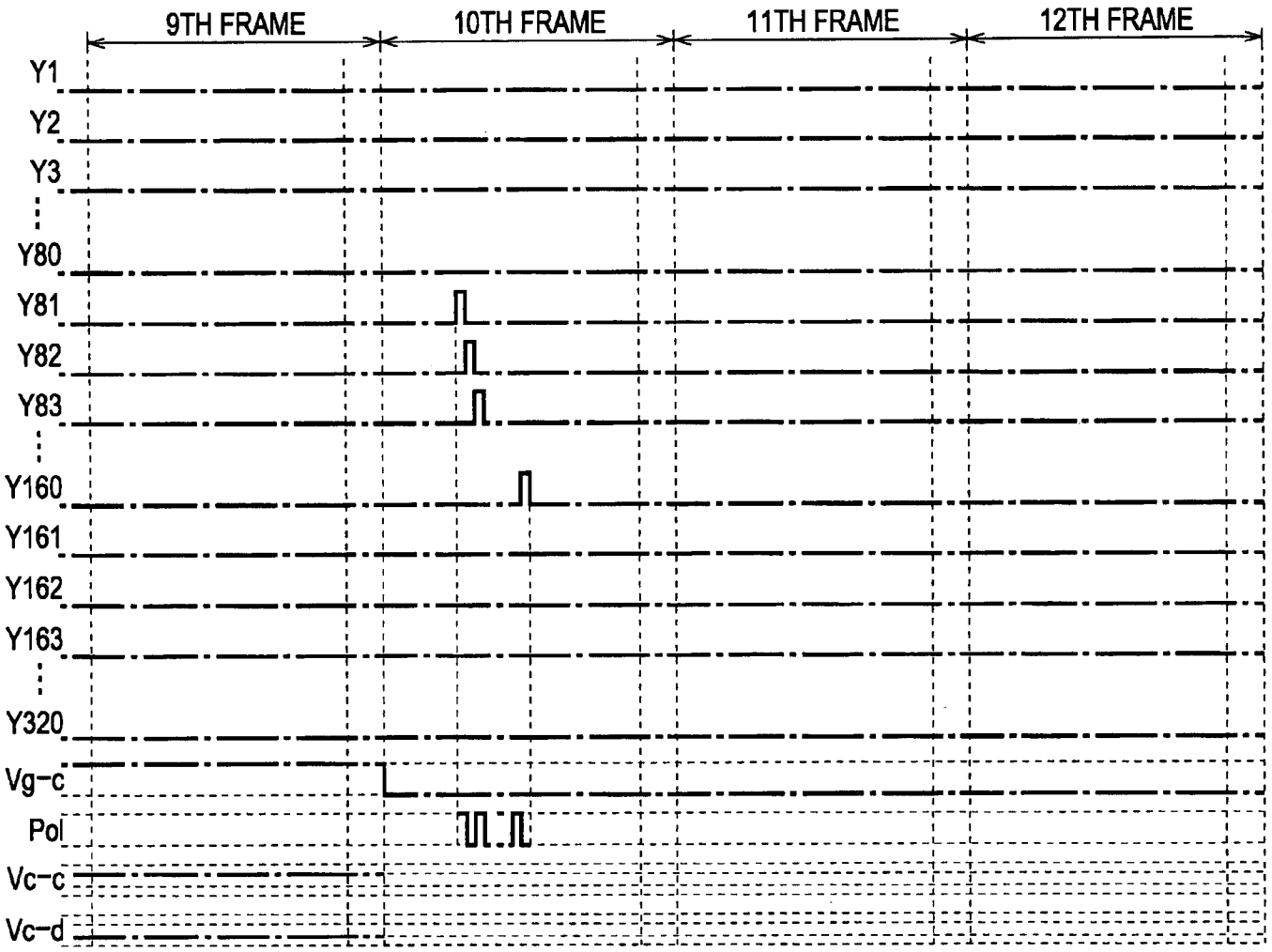
FIG. 33 is a diagram illustrating an operation of the electro-optical device in a partial mode.

Referring to FIGS. 31 to 33, waveforms of scanning signals and other signals in the partial mode described in FIG. 30 will be described. FIG. 31 shows waveforms of scanning signals Y1 to Y320 and the other signals in the first to fourth frames, FIG. 32 shows waveforms of the scanning signals Y1 to Y320 and the other signals in the fifth to eighth frames, and FIG. 33 shows waveforms of the scanning signals Y1 to Y320 and the other signals in the ninth to 12th frames.

As shown in FIGS. 31 to 33, the scanning signals Y1 to Y320 in the partial mode are the same as those in the partial mode of the third embodiment.

In the fourth embodiment, an operation in the first frame in the partial mode is the same as an operation in the full screen mode except that voltages corresponding to black (off-states) are forcedly written to the non-display rows in the partial mode. Accordingly, common electrodes 108 corresponding to the odd-numbered i-th rows have voltages Vsl of a low-level side in accordance with positive-polarity writing operations, and common electrodes 108 corresponding to the even-numbered (i+1)th rows have voltages Vsh of a high-level side in accordance with negative-polarity writing operations.

In the second and third frames in the partial mode, when the level of the control signal Vg-c is high, all the TFTs 175 corresponding to the first to 320th rows in the common electrode driving circuit 170*b* are turned on. Accordingly, the voltage Vsl of the common signal Vc-c is applied to each of the common electrodes 108 corresponding to the odd-numbered rows, and the voltage Vsh of the common signal Vc-d is applied to each of the common electrodes 108 corresponding to the even-numbered rows. Therefore, all the common electrodes 108 maintains voltages the same as those in the first frame.

In the fourth frame, in a period in which the scanning signals Y80 to Y161 are successively brought to high levels, the level of the polarity specifying signal Pol is low when the levels of scanning signals of the odd-numbered rows among rows corresponding to the scanning signals Y81 to Y160 are high. Accordingly, the common electrodes 108 corresponding to the odd-numbered rows in the display rows are determined to have the voltages Vsh in accordance with negative-polarity writing operations, and the common electrodes 108 corresponding to the even-numbered rows in the display rows are determined to have the voltages Vsl in accordance with positive-polarity writing operations using the common electrode driving circuit 170*a*.

Note that individual rows in the seventh to tenth frames are subjected to voltage writing operations employing writing polarities opposite to those employed in the individual rows in the first to fourth frames, respectively.

As described above, according to the fourth embodiment, in the partial mode, in addition to the first and seventh frames in which the voltage writing operations are performed on all the rows, the potentials of the common electrodes 108 are fixed in the second, third, eighth, and ninth frames. Accordingly, deterioration of display quality may be suppressed. Furthermore, according to the fourth embodiment, since, as with a case of the full screen mode, the writing polarities for the display rows in the partial mode are alternately inverted for each scanning line, that is, a row inversion method is employed in the partial mode, display quality the same as that in the full screen mode can be obtained in the partial mode.

Applications and Modifications

In the third and fourth embodiments described above, a row inversion method in which writing polarities for pixels are alternately inverted for each row is employed in the full screen mode. However, a column inversion method in which the writing polarities are alternately inverted for each column, or a dot inversion method in which the writing polarities are alternately inverted for each pixel, that is, for each column and each row may be employed.

Figure 34:
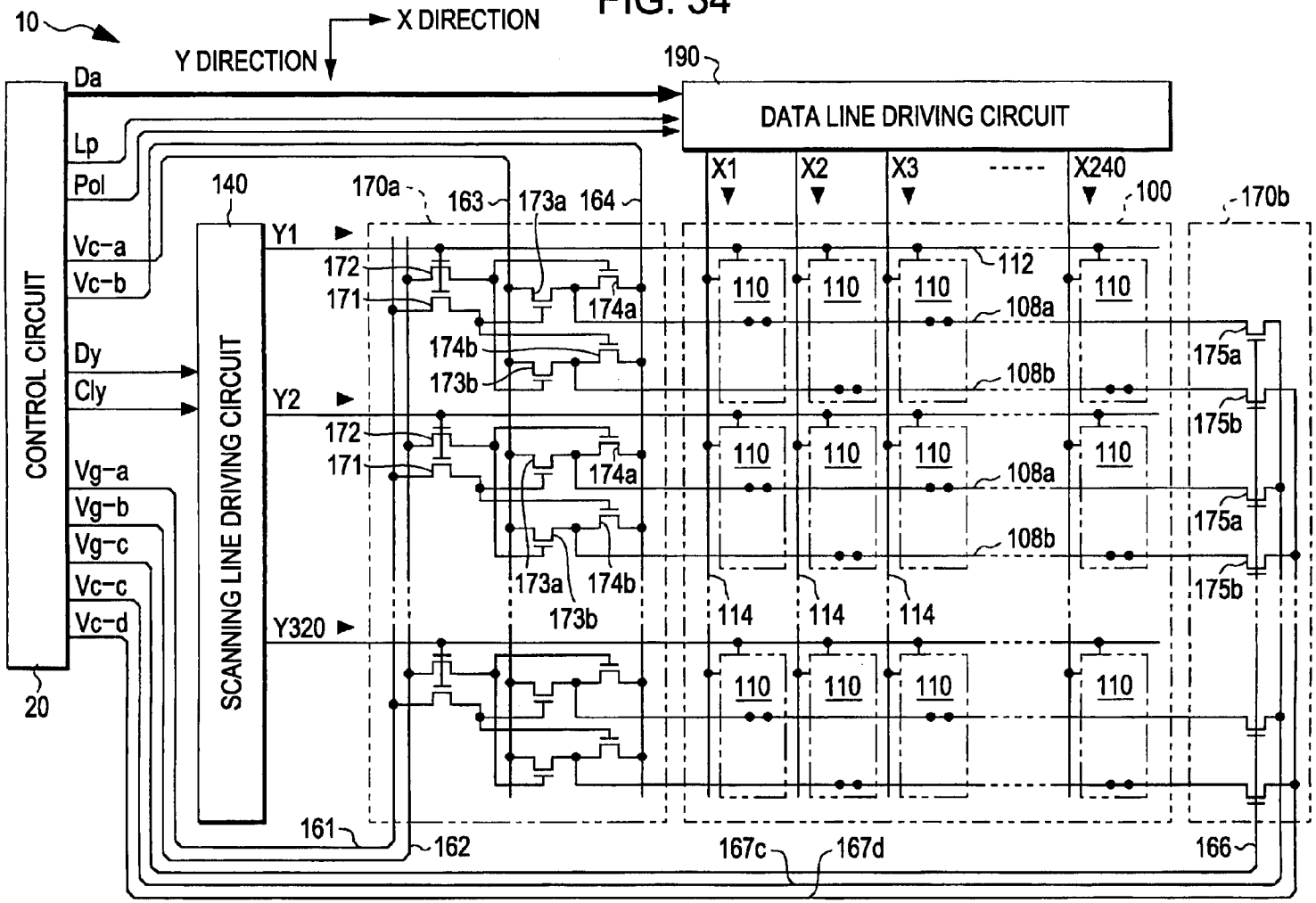
FIG. 34 is a diagram illustrating a configuration of an electro-optical device according to a modification.
Figure 35:
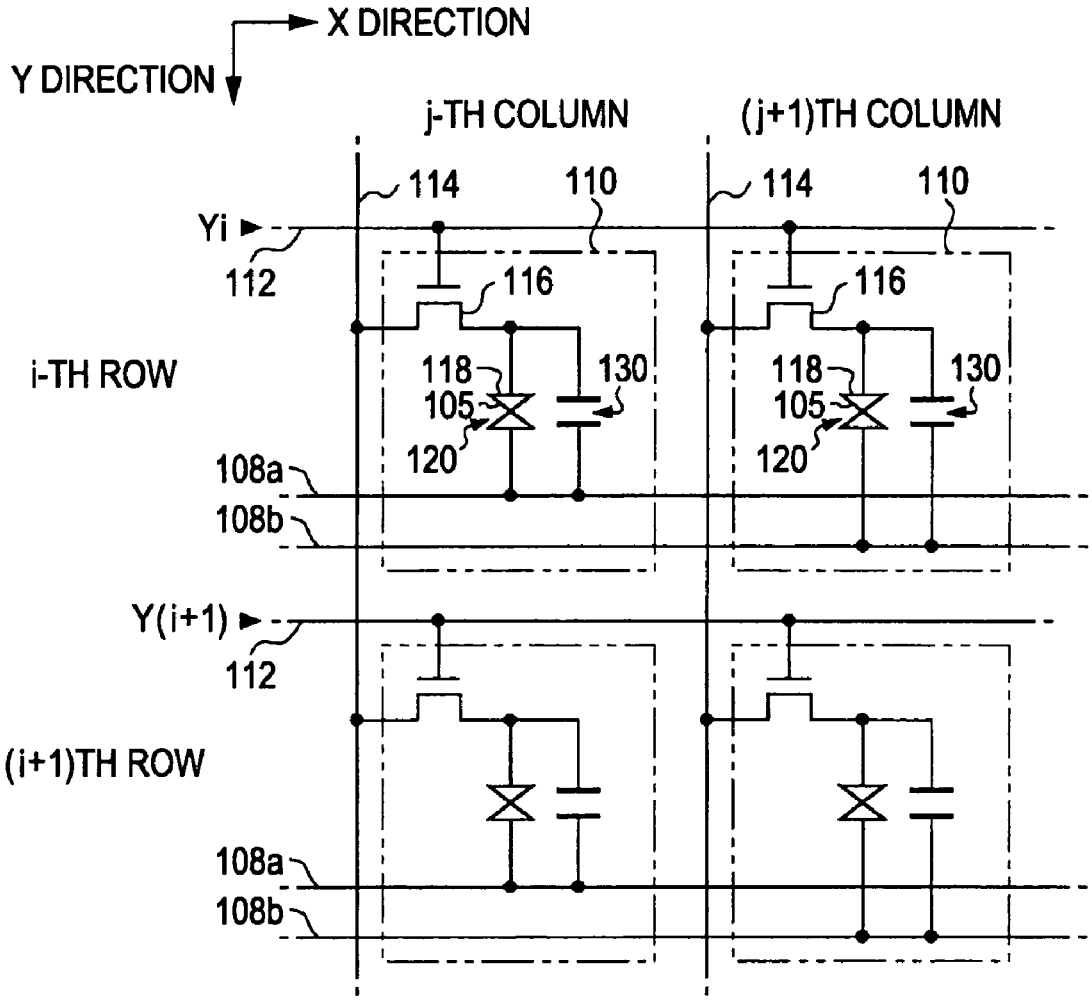
FIG. 35 is a diagram illustrating a configuration of pixels included in the electro-optical device according to the modification.

In a case where the column inversion method or the dot inversion method is employed, for example, pairs of common electrodes 108*a* and 108*b* are arranged in individual rows as shown in FIG. 34. In this case, the common electrodes 108*a* correspond to pixels 110 arranged in odd-numbered j-th columns, and the common electrodes 108*b* correspond to pixels 110 in even-numbered (j+1)th columns as shown in FIG. 35.

Furthermore, in the common electrode driving circuit 170*a*, TFTs 173 corresponding to the individual rows are divided into two systems, that is, TFTs 173*a* and TFTs 173*b*, and TFTs 174 corresponding to the individual rows are divided into the two systems, that is, TFTs 174*a* and TFTs 174*b*. When one of the two systems is used so that common electrodes 108*a* are determined to have ones of voltages Vsl and voltages Vsh, the other system is used so that common electrodes 108*b* are determined to have the others of the voltages Vsl and voltages Vsh.

In the common electrode driving circuit 170*b*, TFTs 175 are divided into two systems, that is, TFTs 175*a* and TFTs 175*b* which correspond to the common electrodes 108*a* and the common electrodes 108*b*, respectively. Specifically, source electrodes of the TFTs 175*a* are connected to the common electrodes 108*a*, drain electrodes of the TFTs 175*a* are connected to a first signal line 167*c*, source electrodes of the TFTs 175*b* are connected to the common electrodes 108*b*, and drain electrodes of the TFTs 175*b* are connected to a second signal line 167*d*.

Here, when the column inversion method is employed, for example, positive-polarity writing operations are performed on odd-numbered columns whereas negative-polarity writing operations are performed on even-numbered columns. Accordingly, when scanning signals supplied to the individual rows are brought to high levels, the voltages Vsl of a low-level side are applied to the common electrodes 108*a* corresponding to the odd-numbered columns in accordance with the positive-polarity writing operations and the voltages Vsh of a high-level side are applied to the common electrodes 108*b* corresponding to the even-numbered columns in accordance with the negative-polarity writing operations.

Furthermore, the dot inversion method is attained using a combination of the column inversion method and the row inversion method. For example, positive-polarity writing operations are performed on odd-numbered rows of odd-numbered columns, and negative-polarity writing operations are performed on odd-numbered rows of even-numbered columns. Thereafter, negative-polarity writing operations are performed on even-numbered rows of odd-numbered columns, and positive-polarity writing operations are performed on even-numbered rows of even-numbered columns. Therefore, when scanning signals supplied to the odd-numbered rows are brought to high levels, the voltages Vsl of a low-level side are applied to the common electrodes 108*a* corresponding to the odd-numbered columns in accordance with the positive-polarity writing operations, and the voltages Vsh of a high-level side are applied to the common electrodes 108*b* corresponding to the even-numbered columns in accordance with the negative-polarity writing operations. Furthermore, when scanning signals subsequently supplied to the even-numbered rows are brought to high levels, the voltages Vsh of a high-level side are applied to the common electrodes 108*a* corresponding to the odd-numbered columns in accordance with the negative-polarity writing operations, and the voltages Vsl of a low-level side are applied to the common electrodes 108*b* corresponding to the even-numbered columns in accordance with the positive-polarity writing operations.

Note that in the column inversion method and the dot inversion method, when a selection voltage is applied to one of scanning lines, waveforms of data signals supplied to the odd-numbered columns and waveforms of data signals supplied to the even-numbered columns are opposite to each other. In addition, polarities of the data signals are alternately changed for each predetermined frame period so that direct currents are not applied to liquid crystal capacitors 120.

in the forgoing embodiments, the common signals Vc-a and Vc-b, and the signals Vg-a and Vg-b have the waveforms shown in FIG. 22. However, the waveforms of the common signals Vc-a and Vc-b may be inverted (replaced by each other) for each frame period or each horizontal scanning period (H), and logic levels of the signals Vg-a and Vg-b may be determined in accordance with the inversion.

Specifically, for example, when a scanning signal supplied to one of scanning lines is brought to a high level, a voltage corresponding to a writing polarity for a corresponding one of rows is applied to a corresponding one of common electrodes, and even when the scanning signal is brought to a low level, the same voltage of the corresponding one of the common electrodes is maintained.

In the forgoing embodiments, the TFTs 171 and the TFTs 172 of the i-th row are turned on when the i-th scanning line is selected and the scanning signal Yi is brought to a high level. Here, it is important that when the TFTs 171 and the TFTs 172 of the i-th row are turned on, the gate electrodes of the TFTs 173 and the gate electrodes of the TFTs 174 are connected to the first power supply line 161 and the second power supply line 162 so that ones of the TFTs 173 and the TFTs 174 are turned on and the others are turned off. Accordingly, as long as the common electrode 108 corresponding to the i-th row has a potential obtained in accordance with a writing polarity, a timing at which the TFTs 171 and the TFTs 172 are turned on is not so important.

In a vertical flyback period, since it is not necessary to specify a writing polarity, logic signals such as the polarity specifying signal Pol and the common signals Vc-a and Vc-b may be fixed in predetermined levels, or these signals may be brought into high-impedance states.

Furthermore, in the forgoing embodiments, the normally-black mode is employed for the liquid crystal capacitors 120. However, a normally-white mode in which white display is attained when voltages are not applied may be employed. Moreover, dots each of which includes three pixels corresponding to three colors R(red), G(green), and B(blue) may be used to perform color display. In addition, another color (cyan (C), for example) may be added to the three colors so that the single dot includes the four colors. By this, color reproducibility is improved.

Electronic Apparatus

An electronic apparatus which employs the electro-optical device 10 according to one of the forgoing embodiments as a display apparatus will now be described.

Figure 36:
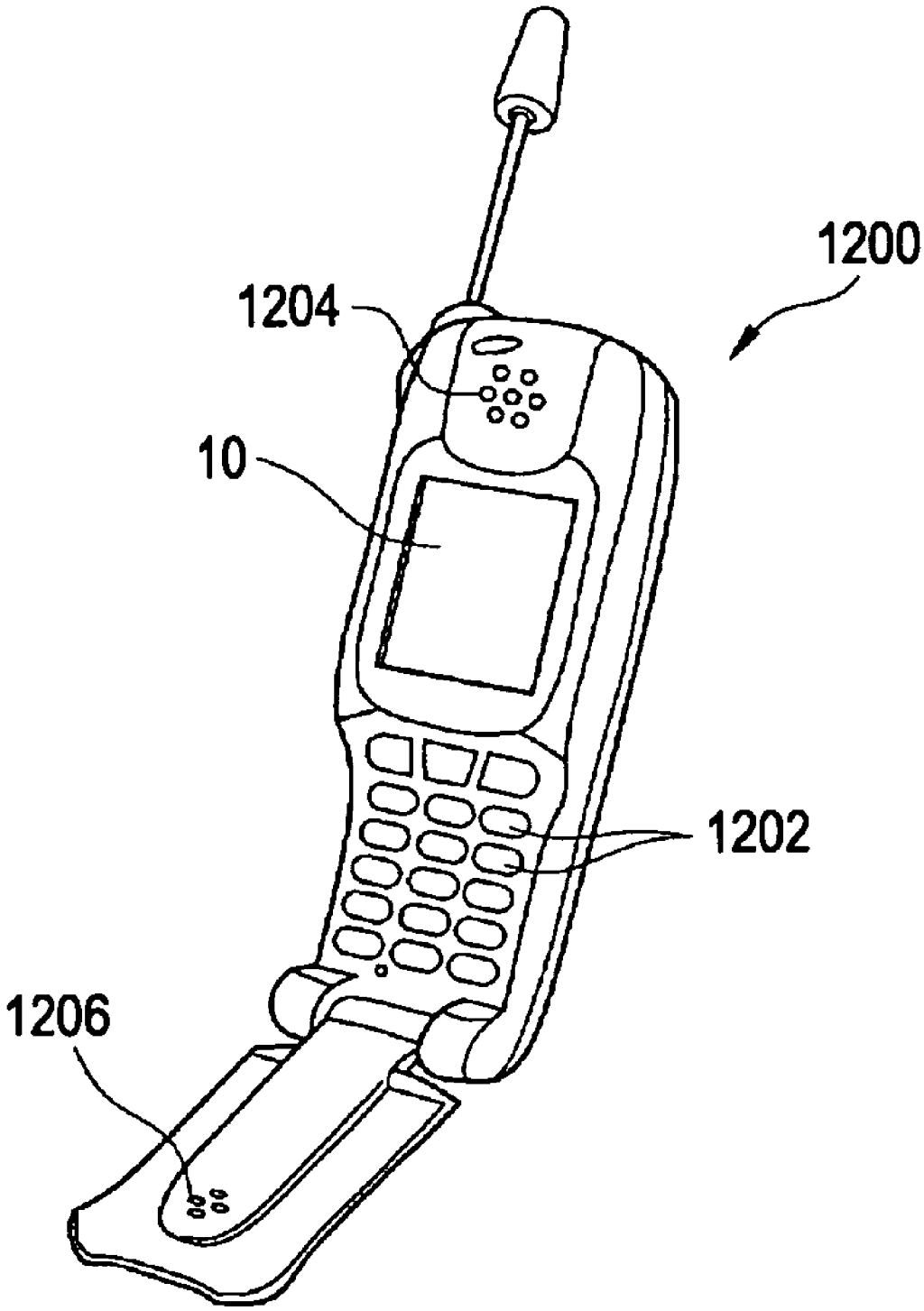
FIG. 36 is a diagram illustrating a cellular phone employing the electro-optical device of one of the embodiments.

FIG. 36 is a diagram illustrating a configuration of a cellular phone 1200 which employs the electro-optical device 10 according to one of the forgoing embodiments. As shown in FIG. 36, the cellular phone 1200 includes a plurality of operation buttons 1202, an earpiece 1204, a microphone 1206, and the electro-optical device 10 described above.

Examples of the electronic apparatus employing the electro-optical device 10 include, in addition to the cellular phone shown in FIG. 36, digital still cameras, laptop computers, liquid crystal display television sets, video recorders, car navigation systems, pagers, electronic notebooks, calculators, word processors, work stations, videophones, POS (point-of-sales) terminals, and touch panels. The electro-optical device 10 is employed in each of these various electronic apparatuses as a display device.

The entire disclosure of Japanese Patent Application Nos. 2007-181768, filed Jul. 11, 2007 and 2007-181436, Jul. 10, 2007 are expressly incorporated by reference herein.

What is claimed is:

1. A driving circuit included in an electro-optical device, comprising:

a plurality of scanning lines, a plurality of data lines, and a plurality of common electrodes provided for the individual scanning lines;

pixels which are arranged at intersections of the scanning lines and the data lines, which include pixel switching elements which have first ends connected to the corresponding data lines and which are brought into conduction states when selection voltages are applied to the corresponding scanning lines, which include pixel capacitors having first ends connected to second ends of the corresponding pixel switching elements and second ends connected to the corresponding common electrodes, and which have levels of gradation corresponding to holding voltages of the pixel capacitors;

a scanning line driving circuit which applies the selection voltages to the plurality of scanning lines in a predetermined order;

a common electrode driving circuit which drives the plurality of common electrodes individually; and a data line driving circuit which supplies, to pixels corresponding to scanning lines to which the selection voltages are applied, data signals having voltages corresponding to levels of gradation for the corresponding pixels through corresponding data lines, wherein the common electrode driving circuit includes switching circuits which are turned on or turned off in accordance with voltages held in gate electrodes of the switching circuits, and which apply voltages of a low-level side or voltages of a high-level side to the corresponding common electrodes when being turned on, includes first voltage-applying circuits which apply on-voltages to the gate electrodes of the switching circuits when the selection voltages are applied to the scanning lines corresponding to the common electrodes so that the switching circuits are turned on, and includes second voltage-applying circuits which apply on-voltages to the gate electrodes of the switching circuits when instruction signals are transmitted through a predetermined control line in a period in which the selection voltages are not applied to-the scanning lines, and wherein the first voltage-applying circuits each include first and second transistors, the switching circuits each include third and fourth transistors, the second voltage-applying circuits each include fifth and sixth transistors, the first transistors have gate electrodes connected to the corresponding scanning lines and source electrodes connected to a first power supply line to which voltages which cause the third transistors to be turned on or off are supplied, the second transistors have gate electrodes connected to the corresponding scanning lines and source electrodes connected to a second power supply line to which voltages which cause the fourth transistors to be turned on or off are supplied, the third transistors have gate electrodes connected to drain electrodes of the first transistors and source electrodes connected to a third power supply line to which one of voltages of the low-level side and voltages of the high-level side-are supplied, the fourth transistors have gate electrodes connected to drain electrodes of the second transistors and source electrodes connected to a fourth power supply line to which the other of the voltages of the low-level side and the voltages of the high-level side are supplied, drain electrodes of the third transistors and drain electrodes of the fourth transistors are connected to the corresponding common electrodes, the fifth transistors have gate electrodes connected to the control line, source electrodes connected to one of the first and second power supply lines, and drain electrodes connected to the gate electrodes of the third transistors, and the sixth transistors have gate electrodes connected to the control line, source electrodes connected to the other of the first and second power supply lines, and drain electrodes connected to the gate electrodes of the fourth transistors.

2. The driving circuit included in an electro-optical device according to claim 1, wherein, in the common electrode driving circuit, the source electrodes of the fifth transistors corresponding to the scanning lines and the common electrodes are connected to-the first power supply line and the source electrodes of the sixth transistors corresponding to the scanning lines and the common electrodes are connected to the second power supply line.

3. The driving circuit included in an electro-optical device according to claim 2 which operates in a first mode in which effective display is performed using all the pixels and in a second mode in which effective display is performed only using pixels corresponding to a number of scanning lines among all the pixels, wherein, in the first mode, the scanning line driving circuit performs, in a predetermined cycle, an operation of applying the selection voltages to the plurality of scanning lines in the predetermined order, the voltages which are inverted every time each of the selection voltages is applied to a corresponding one of the scanning lines so as to cause the third transistors to be turned on or turned off are supplied to the first power supply line, the voltages of the low-level side or the voltages of the high-level side are supplied to the third power supply lines at least in a period of one frame, and voltages which cause the fifth and sixth transistors to be turned off are supplied to the control line, and in the second mode, the scanning line driving circuit alternately performs a first operation of applying the selection voltages to the plurality of scanning lines in the predetermined order and a second operation of applying a number of selection voltages to a corresponding number of scanning lines in a predetermined order in a cycle longer than the predetermined cycle, one of voltages which cause the third transistors to be turned on and voltages which cause the third transistors to be turned off are applied to the first power supply line in the first operation, and the other of the voltages which cause the third transistors to be turned on and the voltages which cause the third transistors to be turned off are applied to the first power supply line in the second operation while the selection voltages are applied to the number of scanning lines, the voltages of the low-level side or the voltages of the high-level side are applied to the third power supply line at least in a period of one frame, and voltages which cause the fifth and sixth transistors to be turned on are supplied to the control line in the entirety or part of a period from when the first operation is terminated to when the second operation is started, and voltages which cause the fifth and sixth transistors to be turned off are supplied to the control line in all other periods.

4. The driving circuit included in an electro-optical device according to claim 1, wherein, in the common electrode driving circuit, source electrodes of fifth transistors corresponding to scanning lines and common electrodes of odd-numbered rows are connected to the second power supply line, and source electrodes of sixth transistors corresponding to scanning lines and common electrodes of the odd-numbered rows are connected to the first power supply line, source electrodes of fifth transistors corresponding to scanning lines and common electrodes of even-numbered rows are connected to the first power supply line, and source electrodes of sixth transistors corresponding to scanning lines and common electrodes of the even-numbered rows are connected to the second power supply line.

5. The driving circuit included in an electro-optical device according to claim 4 which operates in a first mode in which effective display is performed using all the pixels and in a second mode in which effective display is performed only using pixels corresponding to a number of pixels among all the pixels, wherein, in the first mode, the scanning line driving circuit performs, in a predetermined cycle, an operation of applying the selection voltages to the plurality of scanning lines in the predetermined order, the voltages which cause the third transistors to be turned on or turned off are inverted every time each of the selection voltages is applied to a corresponding one of the scanning lines and the inverted voltages are supplied to the first power supply line, and the voltages of the low-level side or the voltages of the high-level side are supplied to the third power supply lines at least in a period of one frame, and voltages which cause the fifth and sixth transistors to be turned off are supplied to the control line, and in the second mode, the scanning line driving circuit alternately performs a first operation of applying the selection voltages to the plurality of scanning lines in the predetermined order and a second operation of applying the selection voltages to a number of scanning lines in a predetermined order in a cycle longer than the predetermined cycle, voltages which cause the third transistors to be turned on and turned off are inverted every time one of the selection voltages are applied to a corresponding one of the scanning lines and the inverted voltages are supplied to the first power supply line in the first and second operations, the voltages of the low-level side or the voltages of the high-level side are applied to the third power supply line at least in a period of one frame, and voltages which cause the fifth and sixth transistors to be on-states in the entirety or part of a period from when the first operation is terminated to when the second operation is started are supplied to the control line, and voltages which cause the fifth and sixth transistors to be off-states in all other periods are supplied to the control line.

6. An electro-optical device, comprising:

a plurality of scanning lines, a plurality of data lines, and a plurality of common electrodes provided for the individual scanning lines;

pixels which are arranged at intersections of the scanning lines and the data lines, which include pixel switching elements which have first ends connected to the corresponding data lines and which are brought into conduction states when selection voltages are applied to the corresponding scanning lines, which include pixel capacitors having first ends connected to second ends of the corresponding pixel switching elements and second ends connected to the corresponding common electrodes, and which have levels of gradation corresponding to holding voltages of the pixel capacitors;

a scanning line driving circuit which applies the selection voltages to the plurality of scanning lines in a predetermined order;

a common electrode driving circuit which drives the plurality of common electrodes individually; and a data line driving circuit which supplies, to pixels corresponding to scanning lines to which the selection voltages are applied, data signals having voltages corresponding to levels of gradation for the corresponding pixels through corresponding data lines, wherein the common electrode driving circuit includes, for individual common electrodes, switching circuits which are turned on or turned off in accordance with voltages held in gate electrodes thereof and which apply voltages of a low-level side or voltages of a high-level side to the corresponding common electrodes when being turned on, first voltage-applying circuits which apply on-voltages to the gate electrodes of the switching circuits when the selection voltages are applied to the scanning lines corresponding to the common electrodes so that the switching circuits are turned on, and second voltage-applying circuits which apply on-voltages to the gate electrodes of the switching circuits when instruction signals are transmitted through a predetermined control line in a period in which the selection voltages are not applied to the scanning lines, and wherein the first voltage-applying circuits each include first and second transistors, the switching circuits each include third and fourth transistors, the second voltage-applying circuits each include fifth and sixth transistors, the first transistors have gate electrodes connected to the corresponding scanning lines and source electrodes connected to a first power supply line to which voltages which cause the third transistors to be turned on or off are supplied, the second transistors have gate electrodes connected to the corresponding scanning lines and source electrodes connected to a second power supply line to which voltages which cause the fourth transistors to be turned on or off are supplied, the third transistors have gate electrodes connected to drain electrodes of the first transistors and source electrodes connected to a third power supply line to which one of voltages of the low-level side and voltages of the high-level side-are supplied, the fourth transistors have gate electrodes connected to drain electrodes of the second transistors and source electrodes connected to a fourth power supply line to which the other of the voltages of the low-level side and the voltages of the high-level side are supplied, drain electrodes of the third transistors and drain electrodes of the fourth transistors are connected to the corresponding common electrodes, the fifth transistors have gate electrodes connected to the control line, source electrodes connected to one of the first and second power supply lines, and drain electrodes connected to the gate electrodes of the third transistors, and the sixth transistors have gate electrodes connected to the control line, source electrodes connected to the other of the first and second power supply lines, and drain electrodes connected to the gate electrodes of the fourth transistors.

7. An electronic apparatus including the electro-optical device according to claim 6.

8. A driving circuit included in an electro-optical device, comprising:

a plurality of scanning lines, a plurality of data lines, and a plurality of common electrodes provided for the individual scanning lines;

pixels which are arranged at intersections of the scanning lines and the data lines, which include pixel switching elements which have first ends connected to the corresponding data lines and which are brought into conduction states when selection voltages are applied to the corresponding scanning lines, which include pixel capacitors having first ends connected to second ends of the corresponding pixel switching elements and second ends connected to the corresponding common electrodes, and which have levels of gradation corresponding to holding voltages of the pixel capacitors;

a scanning line driving circuit which applies the selection voltages to the plurality of scanning lines in a predetermined order;

a common electrode driving circuit which drives the plurality of common electrodes individually; and a data line driving circuit which supplies, to pixels corresponding to scanning lines to which the selection voltages are applied, data signals having voltages corresponding to levels of gradation for the corresponding pixels through corresponding data lines, wherein the common electrode driving circuit includes, for individual common electrodes, switching circuits which are turned on or turned off in accordance with voltages held in gate electrodes of the switching circuits and which apply voltages of a low-level side or voltages of a high-level side to the corresponding common electrodes when being turned on, first voltage-applying circuits which apply on-voltages to the gate electrodes of the switching circuits when the selection voltages are applied to the scanning lines corresponding to the common electrodes so that the switching circuits are turned on, and second voltage-applying circuits which apply the voltages of the low-level side or the voltages of the high-level side again to the individual common electrodes when instruction signals are supplied through a predetermined control line after an operation of applying the selection voltages to the scanning lines is terminated, and wherein the first voltage-applying circuits each include first and second transistors, the switching circuits each include third and fourth transistors, the second voltage-applying circuits each include fifth transistors, the first transistors have gate electrodes connected to the corresponding scanning lines and source electrodes connected to a first power supply line to which voltages which cause the third transistors to be turned on or off are supplied, the second transistors have gate electrodes connected to the corresponding scanning lines and source electrodes connected to a second power supply line to which voltages which cause the fourth transistors to be turned on or off are supplied, the third transistors have gate electrodes connected to drain electrodes of the first transistors and source electrodes connected to a third power supply line to which one of voltages of the low-level side and voltages of the high-level side are supplied, the fourth transistors have gate electrodes connected to drain electrodes of the second transistors and source electrodes connected to a fourth power supply line to which the other of the voltages of the low-level side and the voltages of the high-level side are supplied, drain electrodes of the third transistors and corresponding drain electrodes of the fourth transistors are connected to the corresponding common electrodes, the fifth transistors have gate electrodes connected to the control line, source electrodes connected to a signal line to which voltages of the low-level side or voltages of the high-level side are supplied, and drain electrodes connected to the common electrodes.

9. The driving circuit included in an electro-optical device according to claim 8, wherein the source electrodes of the fifth transistors are connected to the signal line provided in common for all rows of the scanning lines and the common electrodes.

10. The driving circuit included in an electro-optical device according to claim 9 which operates in a first mode in which effective display is performed using all the pixels and in a second mode in which effective display is performed only using pixels corresponding to a number of pixels among all the pixels, wherein, in the first mode, the scanning line driving circuit performs, in a predetermined cycle, an operation of applying the selection voltages to the plurality of scanning lines in the predetermined order, the voltages which cause the third transistors to be turned on or turned off are inverted every time each of the selection voltages is applied to a corresponding one of the scanning lines and the inverted voltages are supplied to the first power supply line, the voltages of the low-level side or the voltages of the high-level side are supplied to the third power supply lines at least in a period of one frame, and voltages which cause the fifth transistors to be turned off are supplied to the control line, and in the second mode, the scanning line driving circuit alternately performs a first operation of applying the selection voltages to the plurality of scanning lines in the predetermined order and a second operation of applying the selection voltages to a number of scanning lines in a predetermined order in a cycle longer than the predetermined cycle, one of voltages which cause the third transistors to be turned on and voltages which cause the third transistors to be turned off are applied to the first power supply line in the first operation, and the other of the voltages which cause the third transistors to be turned on and the voltages which cause the third transistors to be turned off are applied to the first power supply line in the second operation while the selection voltages are applied to the number of scanning lines, the voltages of the low-level side or the voltages of the high-level side are applied to the third power supply line at least in a period of one frame, and voltages which cause the fifth transistors to be on-states in the entirety or part of a period from when the first operation is terminated to when the second operation is started are supplied to the control line, and voltages which cause the fifth transistors to be off-states in all other periods are supplied to the control line.

11. The driving circuit included in an electro-optical device according to claim 8, wherein source electrodes of fifth transistors corresponding to scanning lines and common electrodes of odd-numbered rows are connected to a first signal line to which one of voltages of the low-level side and voltages of the high-level side are supplied, and source electrodes of fifth transistors corresponding to scanning lines and common electrodes of even-numbered rows are connected to a second signal line to which the other of voltages of the low-level side and voltages of the high-level side are supplied.

12. The driving circuit included in an electro-optical device according to claim 11 which operates in a first mode in which effective display is performed using all the pixels and in a second mode in which effective display is performed only using pixels corresponding to a number of pixels among all the pixels, wherein, in the first mode, the scanning line driving circuit performs, in a predetermined cycle, an operation of applying the selection voltages to the plurality of scanning lines in the predetermined order, the voltages which cause the third transistors to be turned on or turned off are inverted every time each of the selection voltages is applied to a corresponding one of the scanning lines and the inverted voltages are supplied to the first power supply line, the voltages of the low-level side or the voltages of the high-level side are supplied to the third power supply lines at least in a period of one frame, and voltages which cause the fifth transistors to be turned off are supplied to the control line, and in the second mode, the scanning line driving circuit alternately performs a first operation of applying the selection voltages to the plurality of scanning lines in the predetermined order and a second operation of applying the selection voltages to a number of scanning lines in a predetermined order in a cycle longer than the predetermined cycle, the voltages which cause the third transistors to be turned on or turned off are inverted every time each of the selection voltages is applied to a corresponding one of the scanning lines and the inverted voltages are supplied to the first power supply line, the voltages of the low-level side or the voltages of the high-level side are applied to the third power supply line at least in a period of one frame, and voltages which cause the fifth transistors to be on-states in entire or part of a period from when the first operation is terminated to when the second operation is started are supplied to the control line, and voltages which cause the fifth transistors to be off-states in all other periods are supplied to the control line.

13. An electro-optical device, comprising:

a plurality of scanning lines, a plurality of data lines, and a plurality of common electrodes provided for the individual scanning lines;

pixels which are arranged at intersections of the scanning lines and the data lines, which include pixel switching elements which have first ends connected to the corresponding data lines and which are brought into conduction states when selection voltages are applied to the corresponding scanning lines, which include pixel capacitors having first ends connected to second ends of the corresponding pixel switching elements and second ends connected to the corresponding common electrodes, and which have levels of gradation corresponding to holding voltages of the pixel capacitors;

a scanning line driving circuit which applies the selection voltages to the plurality of scanning lines in a predetermined order;

a common electrode driving circuit which drives the plurality of common electrodes individually; and a data line driving circuit which supplies, to pixels corresponding to scanning lines to which the selection voltages are applied, data signals having voltages corresponding to levels of gradation for the corresponding pixels through corresponding data lines, wherein the common electrode driving circuit includes, for individual common electrodes, switching circuits which are turned on or turned off in accordance with voltages held in gate electrodes of the switching circuits and which apply voltages of a low-level side or voltages of a high-level side to the corresponding common electrodes when being turned on, first voltage-applying circuits which apply on-voltages to the gate electrodes of the switching circuits when the selection voltages are applied to the scanning lines corresponding to the common electrodes so that the switching circuits are turned on, and second voltage-applying circuits which apply the voltages of the low-level side or the voltages of the high-level side again to the individual common electrodes when instruction signals are supplied through a predetermined control line after an operation of applying the selection voltages to the scanning lines is terminated, and wherein the first voltage-applying circuits each include first and second transistors, the switching circuits each include third and fourth transistors, the second voltage-applying circuits each include fifth transistors, the first transistors have gate electrodes connected to the corresponding scanning lines and source electrodes connected to a first power supply line to which voltages which cause the third transistors to be turned on or off are supplied, the second transistors have gate electrodes connected to the corresponding scanning lines and source electrodes connected to a second power supply line to which voltages which cause the fourth transistors to be turned on or off are supplied, the third transistors have gate electrodes connected to drain electrodes of the first transistors and source electrodes connected to a third power supply line to which one of voltages of the low-level side and voltages of the high-level side-are supplied, the fourth transistors have gate electrodes connected to drain electrodes of the second transistors and source electrodes connected to a fourth power supply line to which the other of the voltages of the low-level side and the voltages of the high-level side are supplied, drain electrodes of the third transistors and drain electrodes of the fourth transistors are connected to the corresponding common electrodes, the fifth transistors have gate electrodes connected to the control line, source electrodes connected to a signal line to which voltages of the low-level side or voltages of the high-level side are supplied, and drain electrodes connected to the common electrodes.

* * * * *